US007355572B2

(12) United States Patent
Uchino et al.

(10) Patent No.: US 7,355,572 B2
(45) Date of Patent: Apr. 8, 2008

(54) PIXEL CIRCUIT, DISPLAY DEVICE, AND METHOD OF DRIVING PIXEL CIRCUIT

(75) Inventors: Katsuhide Uchino, Kanagawa (JP); Junichi Yamashita, Tokyo (JP); Teturou Yamamoto, Kanagawa (JP)

(73) Assignee: Sony Corporation (JP)

( * ) Notice: Subject to any disclaimer, the term of this patent is extended or adjusted under 35 U.S.C. 154(b) by 89 days.

(21) Appl. No.: 10/578,002

(22) PCT Filed: Nov. 10, 2004

(86) PCT No.: PCT/JP2004/016640

§ 371 (c)(1),
(2), (4) Date: May 3, 2006

(87) PCT Pub. No.: WO2005/045797

PCT Pub. Date: May 19, 2005

(65) Prior Publication Data

US 2007/0052644 A1 Mar. 8, 2007

(30) Foreign Application Priority Data

Nov. 10, 2003 (JP) ..... 2003-380171

(51) Int. Cl.
*G09G 3/30* (2006.01)

(52) U.S. Cl. ..... 345/77; 345/80; 345/690; 315/169.3

(58) Field of Classification Search ..... 315/160, 315/161, 167, 169.1–169.3; 345/76–77, 345/80, 82, 84, 87, 90, 92, 98, 103, 204, 345/690

See application file for complete search history.

(56) References Cited

U.S. PATENT DOCUMENTS 5,684,365 A 11/1997 Tang et al.

(Continued)

FOREIGN PATENT DOCUMENTS

JP 08-234683 9/1996

(Continued)

OTHER PUBLICATIONS

International Search Report dated Dec. 28, 2004.

*Primary Examiner*—Thuy V. Tran
*Assistant Examiner*—Tung X Le
(74) *Attorney, Agent, or Firm*—Rader Fishman & Grauer PLLC; Ronald P. Kananen

(57) ABSTRACT

A pixel circuit, a display device, and a method of driving a pixel circuit able to obtain a source-follower output without luminance deterioration even when the current-voltage characteristic of a light emitting element changes due to aging, making a source-follower circuit of n-channel transistors possible, and in addition able to display uniform and high quality images not without regard to variations of threshold values and mobilities of the active elements inside pixels, wherein a capacitor C111 is connected between a gate and a source of a TFT 111, the source side of the TFT 111 is connected to a fixed potential (GND) through a TFT 114, a predetermined reference current Iref is supplied to the source of the TFT 111 with a predetermined timing, a voltage corresponding to the reference current Iref is held, and an input signal voltage centered about the voltage is coupled, whereby an EL light emitting element 19 is driven centered about the center value of variation of the mobilities.

13 Claims, 47 Drawing Sheets

U.S. PATENT DOCUMENTS

| | | | | |
|---|---|---|---|---|
| 2003/0062844 | A1* | 4/2003 | Miyazawa | 315/169.3 |
| 2005/0116907 | A1* | 6/2005 | Miyazawa | 345/76 |
| 2005/0127845 | A1* | 6/2005 | Kasai | 315/169.3 |
| 2006/0208972 | A1* | 9/2006 | Kasai et al. | 345/76 |
| 2006/0290617 | A1* | 12/2006 | Miyazawa | 345/76 |

FOREIGN PATENT DOCUMENTS

| | | |
|---|---|---|
| JP | 2002-514320 A | 5/2002 |
| JP | 2003-173165 | 6/2003 |
| JP | 2003-195809 | 7/2003 |
| JP | 2003-216019 | 7/2003 |
| JP | 2003-271095 | 9/2003 |

* cited by examiner

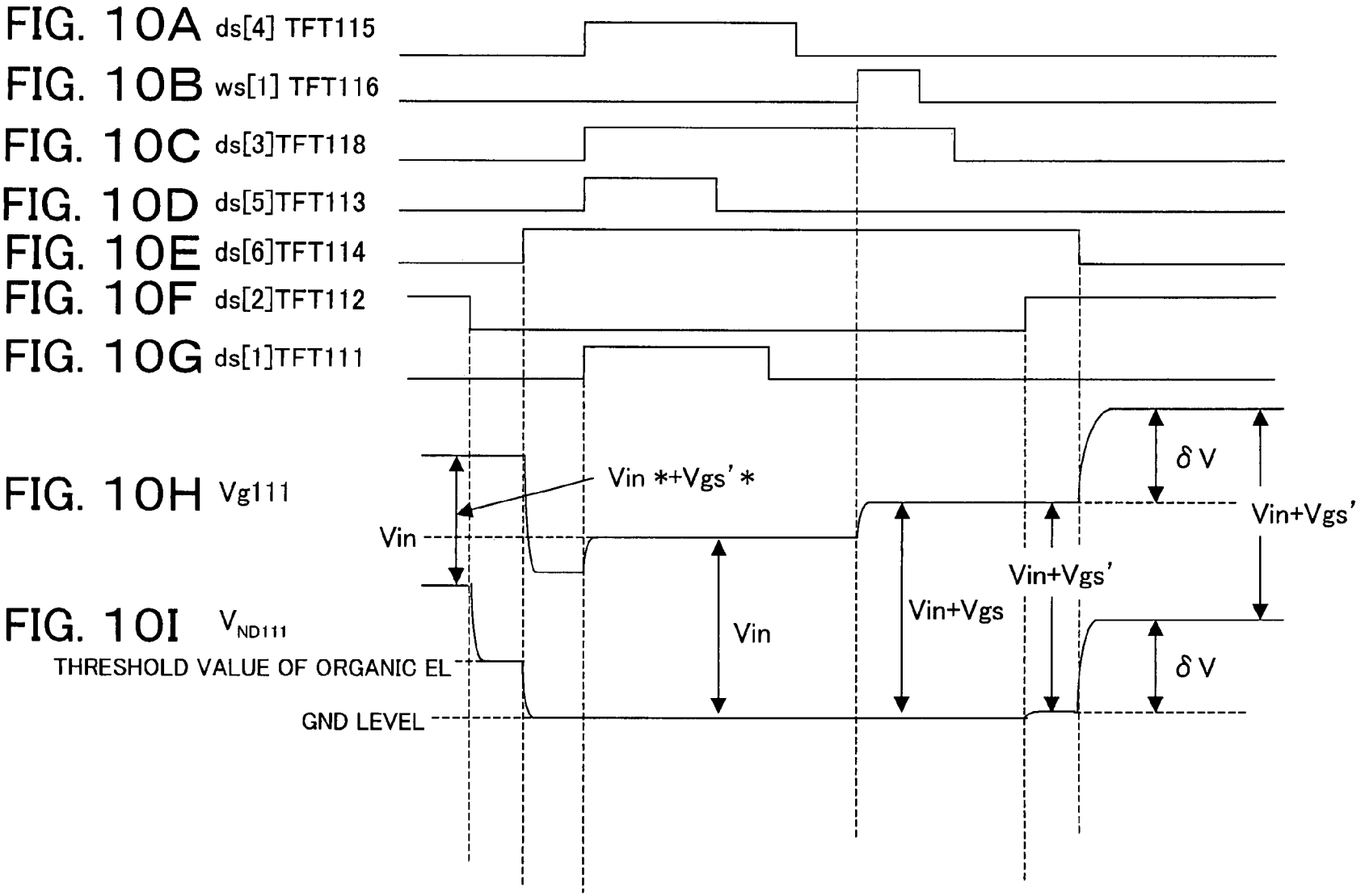
FIG. 10A ds[4] TFT115
FIG. 10B ws[1] TFT116
FIG. 10C ds[3]TFT118
FIG. 10D ds[5]TFT113
FIG. 10E ds[6]TFT114
FIG. 10F ds[2]TFT112
FIG. 10G ds[1]TFT111
FIG. 10H Vg111
FIG. 10I $V_{ND111}$
THRESHOLD VALUE OF ORGANIC EL
GND LEVEL
Vin
Vin *+Vgs' *
Vin
Vin+Vgs
Vin+Vgs'
Vin+Vgs'
δV
δV FIG. 20A ds[4] TFT115

FIG. 20B ws[1] TFT116

FIG. 20C ds[3]TFT118

FIG. 20D ds[5]TFT113

FIG. 20E ds[6]TFT114

FIG. 20F ds[2]TFT112

FIG. 20G ds[1]TFT111

FIG. 20H Vg111

FIG. 20I $V_{ND111}$

FIG. 23A ds[4] TFT115
FIG. 23B ws[1] TFT116
FIG. 23C ds[5]TFT113
FIG. 23D ds[6]TFT114
FIG. 23E ds[2]TFT112
FIG. 23F ds[1]TFT111
FIG. 23G Vg111
FIG. 23H $V_{ND111}$
THRESHOLD VALUE OF ORGANIC EL
GND LEVEL
Vin
Vin *+Vgs' *
Vin
Vin+Vgs
Vin+Vgs'
Vin+Vgs'
δV
δV

FIG. 25A ds[4] TFT115
FIG. 25B ws[1] TFT116
FIG. 25C ds[5]TFT113
FIG. 25D ds[6]TFT114
FIG. 25E ds[2]TFT112
FIG. 25F ds[1]TFT111
FIG. 25G Vg111
FIG. 25H VND111
THRESHOLD VALUE OF ORGANIC EL
GND LEVEL
V0
V0+Vgs'*
V0
V0+Vgs
V0+Vgs'
δV
V+Vgs'
δV

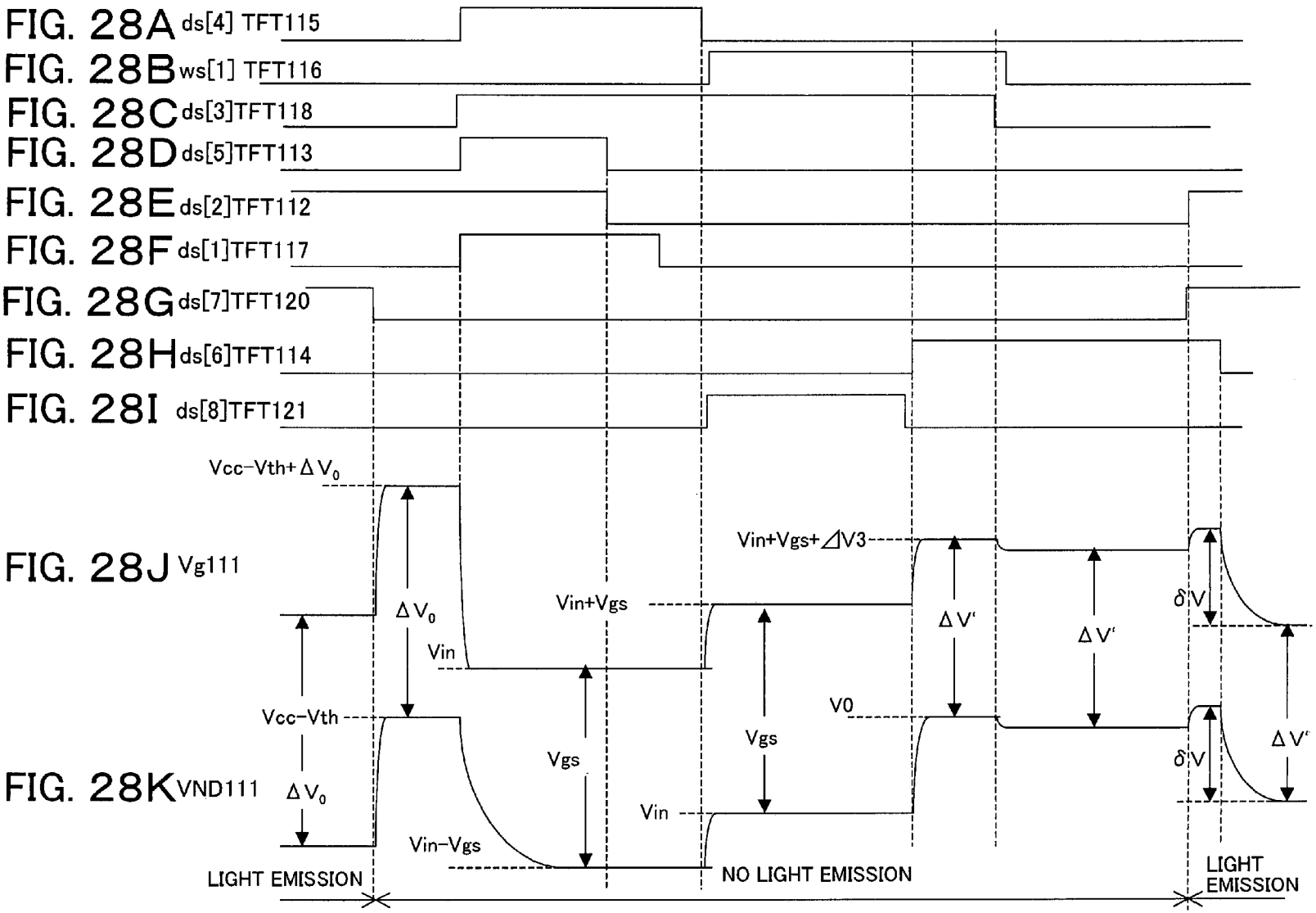
FIG. 28A ds[4] TFT115
FIG. 28B ws[1] TFT116
FIG. 28C ds[3]TFT118
FIG. 28D ds[5]TFT113
FIG. 28E ds[2]TFT112
FIG. 28F ds[1]TFT117
FIG. 28G ds[7]TFT120
FIG. 28H ds[6]TFT114
FIG. 28I ds[8]TFT121
FIG. 28J Vg111
FIG. 28K VND111
Vcc−Vth+ΔV0
Vin+Vgs+ΔV3
Vin+Vgs
Vcc−Vth
Vin−Vgs
Vin
V0
Vgs
ΔV0
ΔV'
δ'V
LIGHT EMISSION
NO LIGHT EMISSION FIG. 38A ds[4] TFT115
FIG. 38B ws[1] TFT116
FIG. 38C ds[3]TFT118
FIG. 38D ds[5]TFT113
FIG. 38E ds[2]TFT112
FIG. 38F ds[1]TFT117
FIG. 38G ds[7]TFT120
FIG. 38H ds[6]TFT114
FIG. 38I ds[8]TFT121
FIG. 38J Vg111
FIG. 38K VND111
Vcc−Vth+ΔV0
Vcc−Vth
ΔV0
V1
V1−Vgs
Vin+Vgs
Vgs
Vin
Vin+Vgs+ΔV3
V0
ΔV'
δ'V
LIGHT EMISSION
NO LIGHT EMISSION FIG. 39A ds[4] TFT115
FIG. 39B ws[1] TFT116
FIG. 39C ds[3]TFT118
FIG. 39D ds[5]TFT113
FIG. 39E ds[2]TFT112
FIG. 39F ds[1]TFT117
FIG. 39G ds[7]TFT120
FIG. 39H ds[6]TFT114
FIG. 39I ds[8]TFT121
Vcc−Vth+ΔV0
FIG. 39J Vg111
FIG. 39K VND111
Vin+Vgs+ΔV3
Vin+Vgs
V0
Vgs
Vin
V1
V1−Vgs
ΔV0
Vcc−Vth
ΔV'
δV
THRESHOLD VALUE OF ORGANIC EL
NO LIGHT EMISSION
LIGHT EMISSION FIG. 42A ds[4] TFT115
FIG. 42B ws[1] TFT116
FIG. 42C ds[5]TFT113
FIG. 42D ds[2]TFT112
FIG. 42E ds[1]TFT117
FIG. 42F ds[7]TFT120
FIG. 42G ds[6]TFT114
FIG. 42H ds[8]TFT121
FIG. 42I Vg111
FIG. 42J VND111
Vcc−Vth+ΔV0
Vcc−Vth
ΔV0
Vin
Vin+Vgs
Vin−Vgs
Vgs
Vin+Vgs+ΔV3
V0
ΔV'
δV
LIGHT EMISSION
NO LIGHT EMISSION FIG. 43A ds[4] TFT115
FIG. 43B ws[1] TFT116
FIG. 43C ds[5]TFT113
FIG. 43D ds[2]TFT112
FIG. 43E ds[1]TFT117
FIG. 43F ds[7]TFT120
FIG. 43G ds[6]TFT114
FIG. 43H ds[8]TFT121
FIG. 43I Vg111
FIG. 43J VND111
Vcc−Vth+ΔV0
Vcc−Vth
ΔV0
Vin
Vin+Vgs
Vin−Vgs
Vgs
Vin+Vgs+ΔV3
V0
ΔV'
δV
THRESHOLD VALUE OF ORGANIC EL
NO LIGHT EMISSION
LIGHT EMISSION

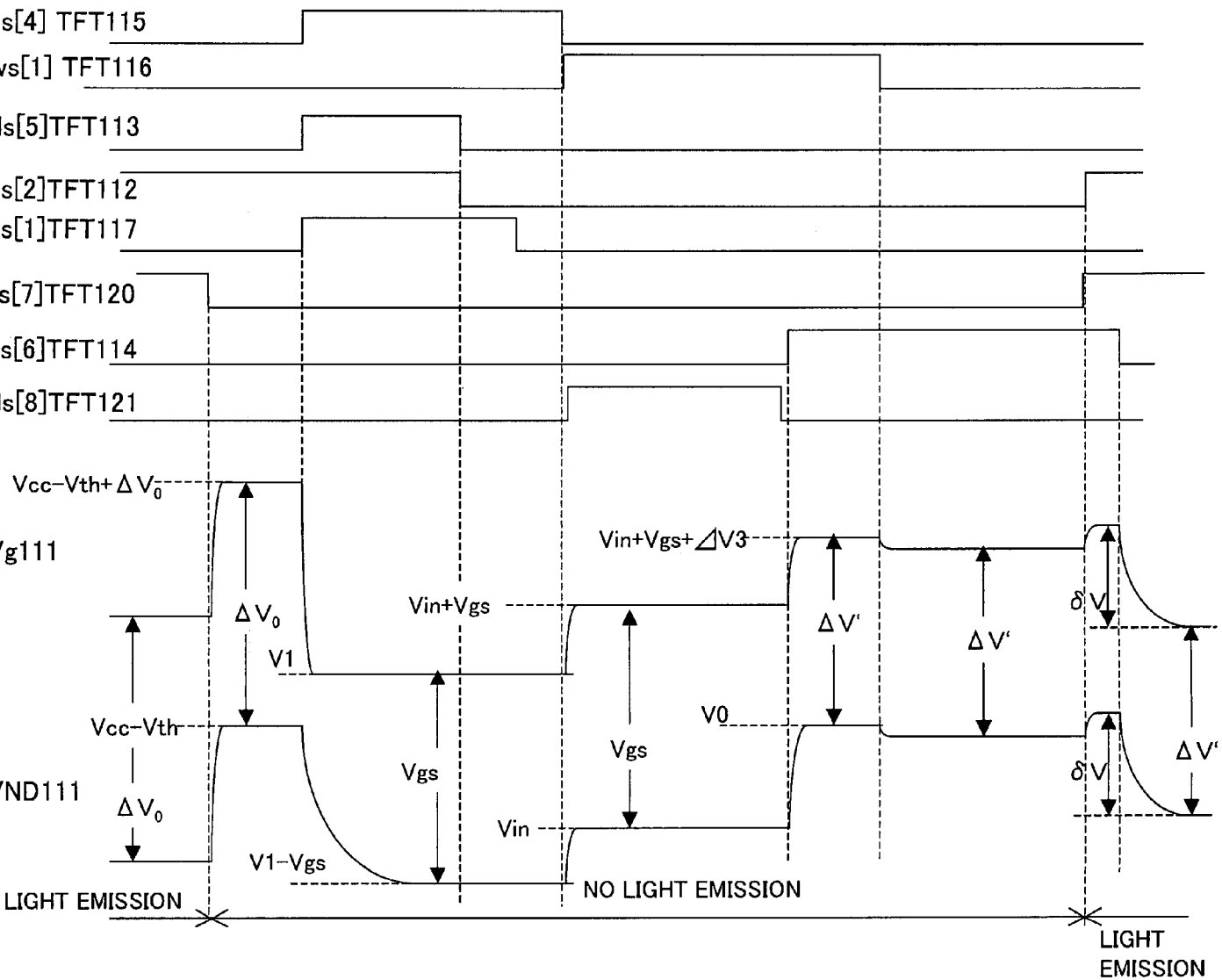
FIG. 46A ds[4] TFT115
FIG. 46B ws[1] TFT116
FIG. 46C ds[5]TFT113
FIG. 46D ds[2]TFT112
FIG. 46E ds[1]TFT117
FIG. 46F ds[7]TFT120
FIG. 46G ds[6]TFT114
FIG. 46H ds[8]TFT121
FIG. 46I Vg111
FIG. 46J VND111

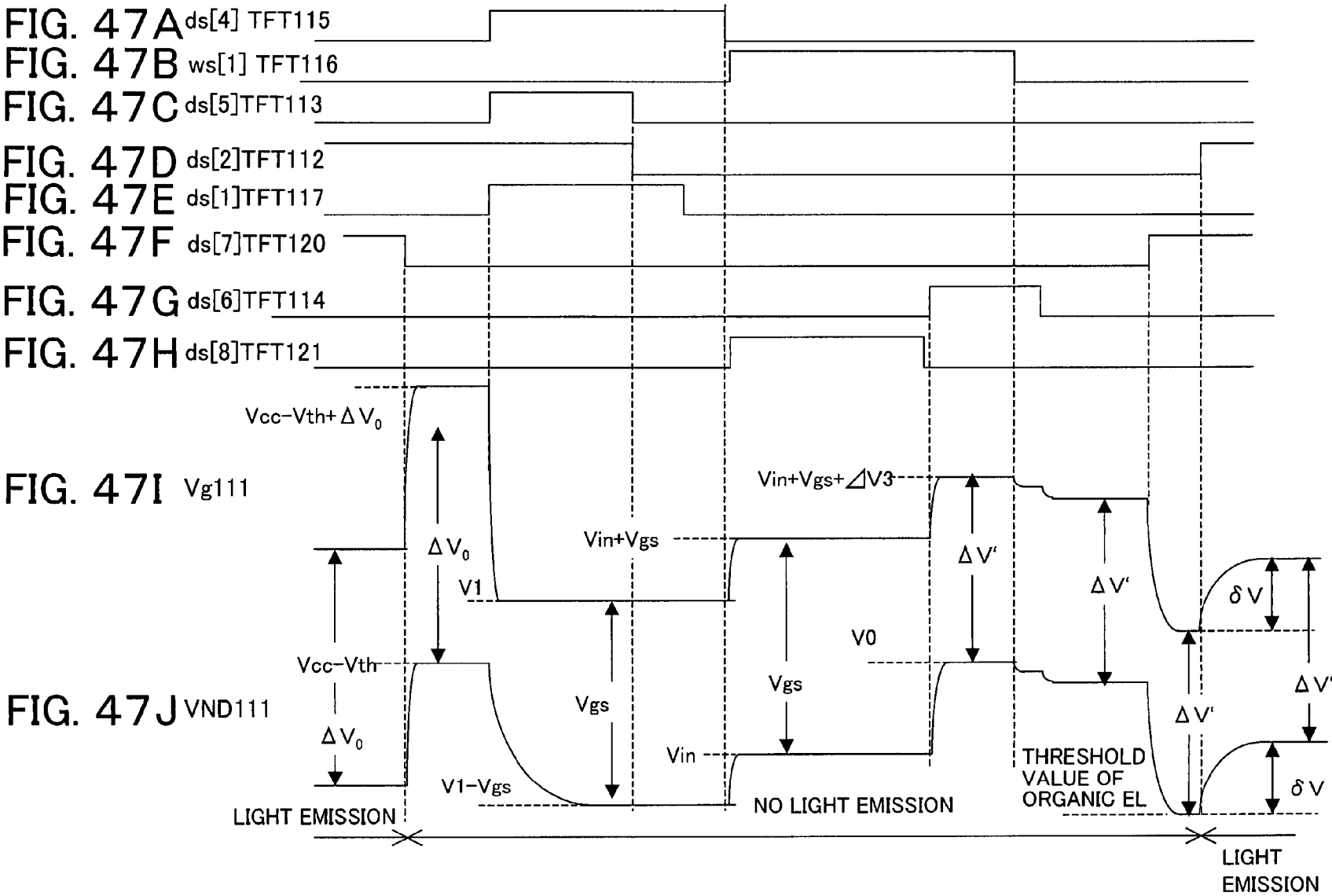
FIG. 47A ds[4] TFT115
FIG. 47B ws[1] TFT116
FIG. 47C ds[5]TFT113
FIG. 47D ds[2]TFT112
FIG. 47E ds[1]TFT117
FIG. 47F ds[7]TFT120
FIG. 47G ds[6]TFT114
FIG. 47H ds[8]TFT121
FIG. 47I Vg111
FIG. 47J VND111
Vcc−Vth+ΔV0
Vin+Vgs+ΔV3
Vin+Vgs
Vcc−Vth
ΔV0
V1
V1−Vgs
Vgs
Vin
V0
ΔV'
δV
THRESHOLD VALUE OF ORGANIC EL
NO LIGHT EMISSION
LIGHT EMISSION

PIXEL CIRCUIT, DISPLAY DEVICE, AND METHOD OF DRIVING PIXEL CIRCUIT

TECHNICAL FIELD

The present invention relates to a pixel circuit having an electro-optical element controlled in luminance by a current value in an organic EL (electroluminescence) display etc., and more particularly, among image display devices in which these pixel circuits are arranged in a matrix, to a so-called active matrix type image display device in which the value of the current flowing in each electro-optical element is controlled by an insulating gate type field effect transistor provided inside each pixel circuit, and a method of driving the pixel circuit.

BACKGROUND ART

In an image display device, for example, a liquid crystal display etc., the image is displayed by arranging a large number of pixels in a matrix and controlling the intensity of light for each pixel in accordance with image information to be displayed.

The same is also true for an organic EL display etc., but an organic EL display is a so-called self light emission type display having a light emitting element in each pixel circuit and has the advantages that the viewability of the image is high in comparison with a liquid crystal display, no backlight is necessary, the response speed is fast, and so on.

Further, this is very different from a liquid crystal display in the point that the luminance of each light emitting element can be controlled by the value of the current flowing through it so as to obtain scales of color, that is, each light emitting element is a current controlled type.

In an organic EL display, in the same way as a liquid crystal display, the simple matrix system and the active matrix system are possible as the method for driving the same. The former is simple in structure, but has the problems that realization of a large sized and high definition display is difficult and so on. Therefore, there has been much development work on the active matrix system for controlling the current flowing in the light emitting element inside each pixel circuit by an active element provided inside the pixel circuit, generally a TFT (thin film transistor).

FIG. 1 is a block diagram showing the configuration of a general organic EL display device.

This display device, as shown in FIG. 1, has a pixel array 2 comprised of pixel circuits (PXLC) 2*a* arranged in an m×n matrix, a horizontal selector (HSEL) 3, a write scanner (WSCN) 4, data lines DTL1 to DTLn selected by the horizontal selector 3 and supplied with data signals in accordance with the luminance information, and scanning lines WSL1 to WSLm selected and driven by the write scanner 4.

Note that the horizontal selector 3 and the write scanner 4 are sometimes formed on polycrystalline silicon or formed on the periphery of the pixels by MOSIC etc.

FIG. 2 is a circuit diagram showing an example of the configuration of the pixel circuit 2*a* of FIG. 1 (see for example Patent Documents 1 and 2).

The pixel circuit of FIG. 2 has the simplest circuit configuration among the large number of circuits proposed and is a circuit of the so-called two-transistor drive system.

The pixel circuit 2*a* of FIG. 2 has a p-channel thin film field effect transistor (hereinafter referred to as an TFT) 11 and TFT 12, a capacitor C11, and a light emitting element constituted by an organic EL element (OLED) 13. Further, in FIG. 42, DTL indicates the data line, and WSL indicates the scanning line.

The organic EL element has a rectification property in many cases, so sometimes is called an OLED (organic light emitting diode). The symbol of a diode is used as the light emitting element in FIG. 2 and other figures, but a rectification property is not always required for the OLED in the following explanation.

In FIG. 2, a source of the TFT 11 is connected to a power supply potential VCC, and a cathode of the light emitting element 13 is connected to a ground potential GND. The operation of the pixel circuit 2*a* of FIG. 2 is as follows.

Step ST1:

When the scanning line WSL is in a selected state (low level here) and a write potential Vdata is supplied to the data line DTL, the TFT 12 becomes conductive and the capacitor C11 is charged or discharged, and a gate potential of the TFT 11 becomes Vdata.

Step ST2:

When the scanning line WSL is in a non-selected state (high level here), the data line DTL and the TFT 11 are electrically disconnected, but the gate potential of the TFT 11 is held stably by the capacitor C11.

Step ST3:

The current flowing in the TFT 11 and the light emitting element 13 becomes a value in accordance with a voltage Vgs between the gate and source of the TFT 11, and the light emitting element 13 continuously emits light with a luminance in accordance with the current value.

As in above step ST1, the operation of selecting the scanning line WSL and transferring the luminance information given to the data line to the inside of the pixel will be called "writing" below.

As explained above, in the pixel circuit 2*a* of FIG. 2, when once writing the Vdata, during the period up to when next rewriting the data, the light emitting element 13 continues emitting light with a constant luminance.

As explained above, in the pixel circuit 2*a*, by changing the gate voltage of the drive transistor constituted by the TFT 11, the value of the current flowing in the EL light emitting element 13 is controlled.

At this time, the source of the p-channel drive transistor 11 is connected to a power supply potential VCC, so this TFT 11 is constantly operating in the saturated region. Accordingly, it becomes a constant current source having a value shown in the following equation 1.

(Equation 1)

$$Ids=\tfrac{1}{2}\cdot\mu(W/L)Cox(Vgs-|Vth|)^2 \quad (1)$$

Here, μ indicates the mobility of a carrier, Cox indicates a gate capacitance per unit area, W indicates a gate width, L indicates a gate length, Vgs indicates a gate-source voltage of the TFT 11, and Vth indicates a threshold value of the TFT 11.

In a simple matrix type image display device, each light emitting element emits light only at an instant when it is selected, but in contrast, in an active matrix, as explained above, the light emitting element continues emitting light even after the end of writing, therefore this becomes advantageous especially in a large sized and high definition display in the point that a peak luminance and a peak current of the light emitting element can be lowered in comparison with the simple matrix.

FIG. 3 is a diagram showing aging of the 10 current-voltage (I-V) characteristic of an organic EL element. In FIG. 3, the curve indicated by a solid line indicates the characteristic at the time of an initial state, and the curve indicated by a broken line indicates the characteristic after the aging.

In general, the I-V characteristic of the organic EL element deteriorates when time passes as shown in FIG. 3.

However, the two-transistor drive of FIG. 2 is a constant current drive, therefore a constant current continuously flows in the organic EL element as explained above. Even when the I-V characteristic of the organic EL element deteriorates, the light emission luminance thereof will not deteriorate by aging.

The pixel circuit 2*a* of FIG. 2 is configured by a p-channel TFT, but if it could be configured by an n-channel TFT, it would become possible to use a usual amorphous silicon (a-Si) process in TFT fabrication. By this, a reduction of the cost of the TFT substrate would become possible.

Next, a pixel circuit replacing the transistor by an n-channel TFT will be considered.

FIG. 4 is a circuit diagram showing a pixel circuit replacing the p-channel TFT of the circuit of FIG. 2 by an n-channel TFT.

A pixel circuit 2*b* of FIG. 4 has an n-channel TFT 21 and TFT 22, a capacitor C21, and a light emitting element constituted by an organic EL element (OLED) 23. Further, in FIG. 4, DTL indicates the data line, and WSL indicates the scanning line.

In this pixel circuit 2*b*, a drain side of the drive transistor constituted by the TFT 21 is connected to the power supply potential VCC, and the source is connected to an anode of the EL element 23 to thereby form a source-follower circuit.

FIG. 5 is a diagram showing operation points of the drive transistor constituted by the TFT 21 and the EL element 23 in the initial state. In FIG. 5, an abscissa indicates a drain/source voltage Vds of the TFT 21, and an ordinate indicates a drain/source current Ids.

As shown in FIG. 5, the source voltage is determined by the operation points of the drive transistor constituted by the TFT 21 and the EL element 23. The voltage thereof has a different value according to the gate voltage.

This TFT 21 is driven in a saturated region, therefore a current Ids having a current value shown in the above equation 1 flows concerning Vgs with respect to the source voltage of the operation point.

Patent Document 1: U.S. Pat. No. 5,684,365

Patent Document 1: Japanese Patent Publication (A) No. 8-234683

DISCLOSURE OF THE INVENTION

Problem to be Solved by the Invention

However, here as well, the I-V characteristic of the El element deteriorates in the same way by aging. As shown in FIG. 6, the operation point fluctuates by this aging deterioration, therefore, even when the same gate voltage is applied, the source voltage fluctuates.

Due to this, the gate/source voltage Vgs of the drive transistor constituted by the TFT 21 changes, and the value of flowing current fluctuates. Simultaneously, the value of the current flowing in the EL element 23 changes, therefore, when the I-V characteristic of the EL element 23 deteriorates, in the source-follower circuit of FIG. 4, the light emission luminance changes by aging.

Further, as shown in FIG. 7, a circuit configuration connecting the source of the drive transistor constituted by the n-channel TFT 31 to the ground potential GND, connecting the drain to the cathode of the EL element 33, and connecting the anode of the EL element 33 to the power supply potential VCC can be considered.

With this system, in the same way as a drive operation by the p-channel TFT of FIG. 2, the potential of the source is fixed. Therefore, the drive transistor constituted by the n-channel TFT 31 operates as the constant current source and can prevent a change in luminance due to the deterioration of the I-V characteristic of the EL element 33.

With this system, however, it is necessary to connect the drive transistor to the cathode side of the EL element. This cathode connection requires new development of the anode/cathode electrodes. This is considered to be very difficult by the current art.

From the above, in the usual, an organic EL element using an n-channel transistor not changing in luminance has not yet been developed.

Further, even developing an organic EL element using an n-channel transistor not changing in luminance, the TFT transistor is generally characterized in that the variations of mobility μ and threshold values Vth are large, therefore even when a voltage having the same value is supplied to the gate of the drive transistor, the current value varies for each pixel according to the mobility μ and threshold value Vth of the drive transistor, so a uniform image quality cannot be obtained.

An object of the present invention is to provide a pixel circuit in which a source-follower output free from luminance deterioration can be obtained even when the current-voltage characteristic of a light emitting element changes by aging, a source-follower circuit of an n-channel transistor becomes possible, an n-channel transistor can be used as the drive element of the optical element by using current anode/cathode electrodes as they are, and uniform, high quality images can be displayed without regard as to variations of threshold values and mobilities of the active elements inside the pixel, a display device, and a method of driving a pixel circuit.

Means for Solving the Problem

To achieve the above object, according to a first aspect of the present invention, there is provided a pixel circuit for driving an electro-optical element changing in luminance according to a flowing current, comprising a data line to which a data signal in accordance with a luminance information is supplied; first, second, third, and fourth nodes; first and second reference potentials; a reference current supplying means for supplying a predetermined reference current; an electric connecting means connected to the second node; a pixel capacitor element connected between the first node and the second node; a coupling capacitor element connected between the electric connecting means and the fourth node; a drive transistor forming a current supply line between a first terminal and a second terminal and controlling a current flowing in the current supply line in accordance with the potential of the control terminal connected to the second node; a first switch connected between the first node and the third node; a second switch connected between the third node and the fourth node; a third switch connected between the first node and a fixed potential; a fourth switch connected between the second node and a predetermined potential line; a fifth switch connected between the data line and the fourth switch; and a sixth switch connected between the third node and the reference current supplying means, wherein, between the first reference potential and the second reference potential, the current supply line of the drive transistor, the first node, the third node, the first switch, and the electro-optical element are connected in series.

Preferably, the electric connecting means includes an interconnect for directly connecting the second node and the coupling capacitor element.

Preferably, the electric connecting means includes a seventh switch selectively connecting the second node and the coupling capacitor element.

Preferably, it includes a seventh switch connected between the first node and the electro-optical element and an eighth switch connected between the first node and the data line.

Alternatively, it includes a seventh switch connected between the first node and the electro-optical element and an eighth switch connected between the first node and the fourth node.

Preferably, the predetermined potential line is shared together with the data line.

Further, the drive transistor is a field effect transistor, a source is connected to the third node, and a drain is connected to the first reference potential.

Preferably, when the electro-optical element is driven, as a first stage, in a state where the first, second, fourth, fifth, and sixth switches are held in a non-conductive state, the third switch is held in the conductive state and the first node is connected to a fixed potential; as a second stage, the second, fourth, and sixth switches are held in the conductive state, a predetermined potential is input to the second node, the reference current flows in the third node, and the predetermined potential is charged in the pixel capacitor element; as a third stage, the second and sixth switches are held in the non-conductive state, further the fourth switch is held in the non-conductive state, the fifth switch is held in the conductive state, the data propagated through the data line is input to the second node, then the fifth switch is held in the non-conductive state; and as a fourth stage, the first switch is held in the conductive state, and the third switch is held in the non-conductive state.

Alternatively, preferably, when driving the electro-optical element, as a first stage, in a state where the first, second, fourth, fifth, sixth, and seventh switches are held in the non-conductive state, the third switch is held in the conductive state, and the first node is connected to the fixed potential; as a second stage, the second, fourth, sixth, and seventh switches are held in the conductive state, the data potential propagated through the data line is input to the second node, the reference current flows in the third node, and a predetermined potential is charged in the pixel capacitor element; as a third stage, the second and sixth switches are held in the non-conductive state, further the fourth switch is held in the non-conductive state, the fifth switch is held in the conductive state, the data propagated through the data line is input to the second node via the fourth node, then the fifth and seventh switches are held in the non-conductive state; and as a fourth stage, the first switch is held in the conductive state, and the third switch is held in the non-conductive state.

According to a second aspect of the present invention, there is provided a display device comprising a plurality of pixel circuits arranged in a matrix; data lines interconnected for each column of a matrix array of the pixel circuits and supplied with a data signal in accordance with the luminance information; first and second reference potentials; and a reference current supplying means for supplying a predetermined reference current, wherein the pixel circuit has an electro-optical element changing in luminance according to a flowing current; first, second, third, and fourth nodes; an electric connecting means connected to the second node; a pixel capacitor element connected between the first node and the second node; a coupling capacitor element connected between the electric connecting means and the fourth node; a drive transistor forming a current supply line between a first terminal and a second terminal and controlling a current flowing in the current supply line in accordance with the potential of the control terminal connected to the second node; a first switch connected between the first node and the third node; a second switch connected between the third node and the fourth node; a third switch connected between the first node and a fixed potential; a fourth switch connected between the second node and a predetermined potential line; a fifth switch connected between the data line and the fourth switch; and a sixth switch connected between the third node and the reference current supplying means, and, between the first reference potential and the second reference potential, the current supply line of the drive transistor, the first node, the third node, the first switch, and the electro-optical element are connected in series.

According to a third aspect of the present invention, there is provided a method for driving a pixel circuit having an electro-optical element changing in luminance according to a flowing current, a data line to which a data signal in accordance with luminance information is supplied; first, second, third, and fourth nodes; first and second reference potentials; a reference current supplying means for supplying a predetermined reference current; an electric connecting means connected to the second node; a pixel capacitor element connected between the first node and the second node; a coupling capacitor element connected between the electric connecting means and the fourth node; a drive transistor forming a current supply line between a first terminal and a second terminal and controlling a current flowing in the current supply line in accordance with the potential of the control terminal connected to the second node; a first switch connected between the first node and the third node; a second switch connected between the third node and the fourth node; a third switch connected between the first node and a fixed potential; a fourth switch connected between the second node and a predetermined potential line; a fifth switch connected between the data line and the fourth switch; and a sixth switch connected between the third node and the reference current supplying means, wherein the current supply line of the drive transistor, the first node, the third node, the first switch, and the electro-optical element are connected in series between the first reference potential and the second reference potential, comprising steps of holding the third switch in the conductive state and connecting the first node to a fixed potential in the state where the first, second, fourth, fifth, and sixth switches are held in the non-conductive state; holding the second, fourth, and the sixth switches' in the conductive state and inputting the predetermined potential to the second node, sending the reference current in the third node, and charging the predetermined potential in the pixel capacitor element; holding the second and sixth switches in the non-conductive state, and further holding the fourth switch in the non-conductive state, holding the fifth switch in the conductive state and inputting the data propagated through the data line to the second node, then holding the fifth switch in the non-conductive state; and holding the first switch in the conductive state and holding the third switch in the non-conductive state.

According to the present invention, at the time of for example the light emission state of the electro-optical element, the first switch is held in an ON state (conductive state), and the second to seventh switches are held in an OFF state (non-conductive state).

The drive transistor is designed so as to operate in the saturated region, and the current Ids flowing in the electro-optical element takes a value shown by the above equation 1.

Next, the first switch becomes OFF, and the third switch becomes ON in the state where the second and the fourth to seventh switches are held in the OFF state as they are.

At this time, the current flows via the third switch, and the potential of the first node falls to a ground potential GND. For this reason, a voltage supplied to the electro-optical element becomes 0V, and the electro-optical element no longer emits light.

Next, in the state where the third switch is held in the ON state and the first and fifth switches are held in the OFF state as they are, the second, fourth, sixth, and seventh switches become ON.

Due to this, for example the predetermined potential 0V or an input potential Vin propagated through the data line is input to the second node, and the reference current flows in the third node by the reference current supplying means parallel to this. As a result, a gate/source voltage Vgs of the drive transistor is charged in the coupling capacitor element.

At this time, the drive transistor operates in the saturated region, therefore the gate/source voltage Vgs of the drive transistor becomes a term including a mobility μ and a threshold value Vth. Further, V0 or Vin is charged in the pixel capacitor element at this time.

Next, the second and sixth switches become OFF. Due to this, the source potential of the drive transistor (potential of the third node) rises up to for example (V0 or Vin−Vth).

Then, further, in the state where the third and seventh switches are held in the ON state, and the first, second, and sixth switches are held in the OFF state as they are, the fifth switch becomes ON, and the fourth switch becomes OFF. By the turning on of the fifth switch, the input voltage Vin propagated through the data line via the fifth switch couples a voltage ΔV with the gate of the drive transistor through the coupling capacitor element.

This coupling amount ΔV is determined according to a voltage change amount (Vgs of the drive transistor) between the first node and the second node, a pixel capacitor element, a coupling capacitor element, and a parasitic capacitance of the drive transistor, almost all of the change amount is coupled with the gate of the drive transistor if the capacitance of the coupling capacitor element is made large in comparison with the pixel capacitor element and the parasitic capacitance, and the gate potential of the drive transistor becomes V0 or (Vin+Vgs).

After the end of the writing, the fifth and seventh switches become OFF, and further the first switch becomes ON and the third switch becomes OFF.

Due to this, the source potential of the drive transistor once falls to the ground potential GND, then rises, and the current starts to flow also in the electro-optical element. Irrespective of the fact that the source potential of the drive transistor fluctuates, there is a pixel capacitor element between the gate and the source thereof. By making the capacitance of the pixel capacitor element larger than the parasitic capacitance of the drive transistor, the gate/source potential is always held at a constant value such as (Vin+Vgs).

At this time, the drive transistor is driven in the saturated region, therefore the value of the current Ids flowing in the drive transistor becomes the value shown by Equation 1. That is determined by the gate/source voltage. This Ids flows also in the electro-optical element in the same way, whereby the electro-optical element emits light.

EFFECT OF THE INVENTION

According to the present invention, even when the I-V characteristic of the EL light emitting element changes by aging, a source-follower output without luminance deterioration can be achieved.

A source-follower circuit of an n-channel transistor becomes possible, and an n-channel transistor can be used as a drive element of an EL light emitting element by using current anode/cathode electrodes as they are.

Further, not only the variation of threshold values of drive transistors, but also the variation of mobilities can be greatly suppressed, and image quality having good uniformity can be obtained.

Further, variation of the threshold values of drive transistors is cancelled out by the reference current, therefore it is not necessary to cancel the threshold value by setting the ON/OFF timing of the switch for each panel, therefore an increase of the number of steps for setting the timing can be suppressed.

Further, the capacitance inside the pixel can be easily designed, and the capacitance can be made smaller, therefore the pixel area can be reduced, and it becomes possible to make the definition of the panel higher.

Further, almost all of the voltage change can be coupled with the gate of the drive transistor when inputting the input voltage, therefore variation of the current value for each pixel can be reduced, and a uniform image quality can be obtained.

Further, the time during which the input voltage from the signal line is input into the pixel can be shortened by inputting the fixed potential to the gate of the drive transistor and sending the reference current Iref, the data can be written into the pixel at a high speed, and it becomes possible to cope with a drive system dividing that 1H into several parts and writing that data into the pixel as in a three-part write system.

Further, the transistors of the pixel circuits can be configured by only n-channel transistors, and it becomes able to use the a-Si process in TFT fabrication. Due to this, a reduction of the cost of the TFT substrate becomes possible.

BRIEF DESCRIPTION OF THE DRAWINGS

FIGS. 10A to 10I are timing charts for explaining a method of driving the circuit of FIG. 9.

FIGS. 28A to 28K are timing charts for explaining the operation of the circuit of FIG. 26.

FIGS. 46A to 46J are timing charts for explaining the operation of the circuit of FIG. 44.

FIGS. 47A to 47J are timing charts for explaining the operation of the circuit of FIG. 45.

Figure 1:
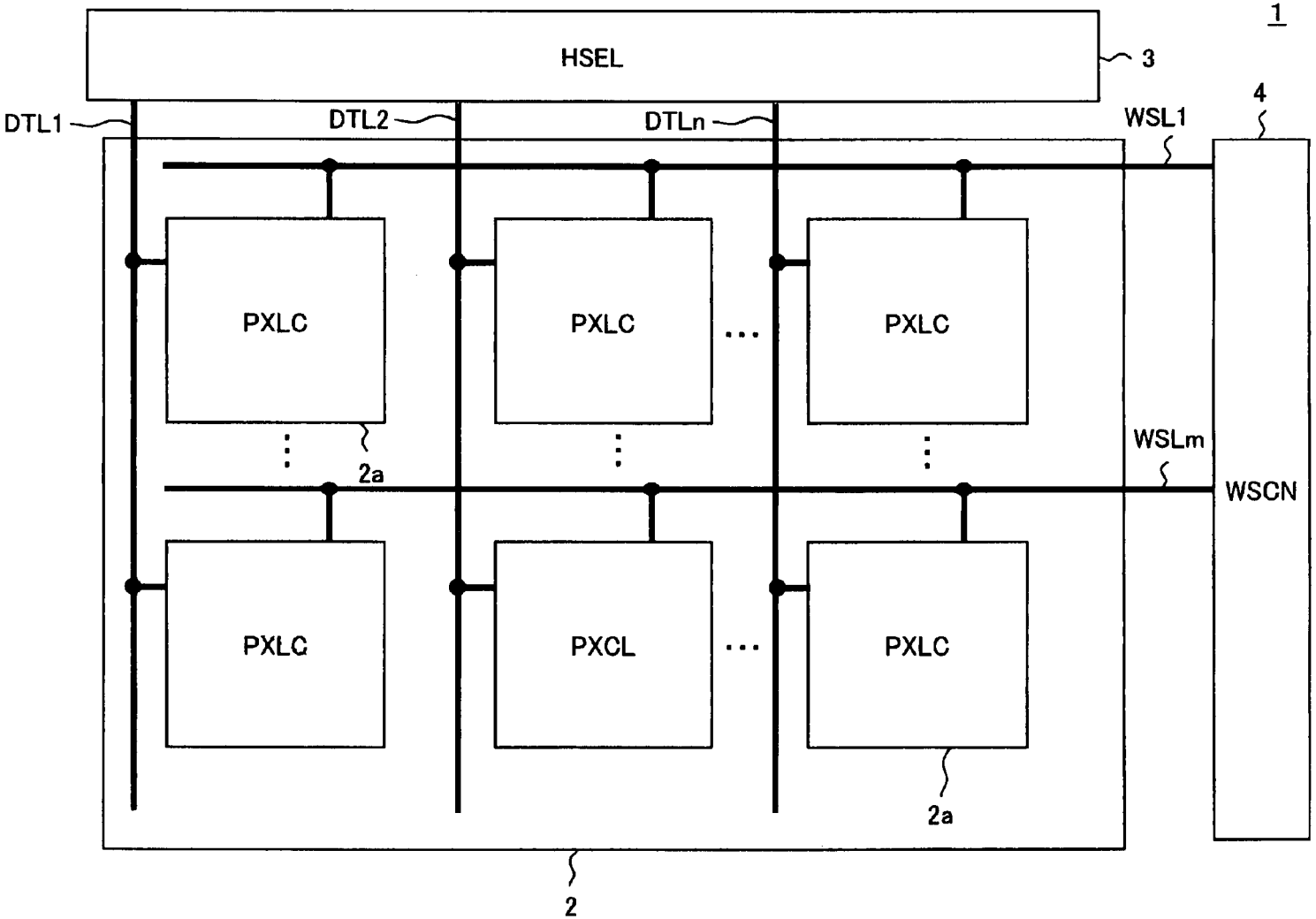
FIG. 1 is a block diagram showing the configuration of a general organic EL display device.
Figure 2:
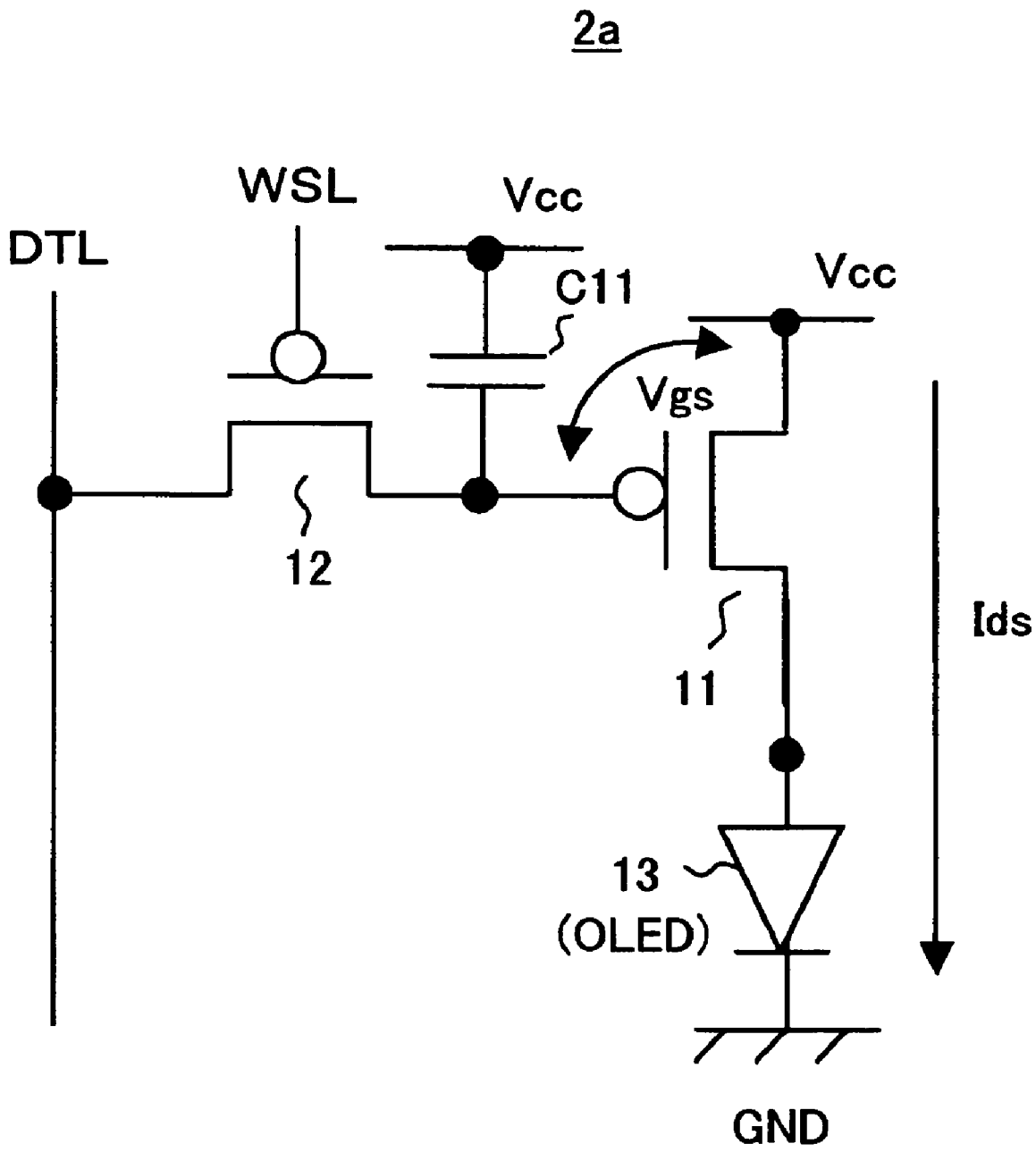
FIG. 2 is a circuit diagram showing an example of the configuration of the pixel circuit of FIG. 1.
Figure 3:
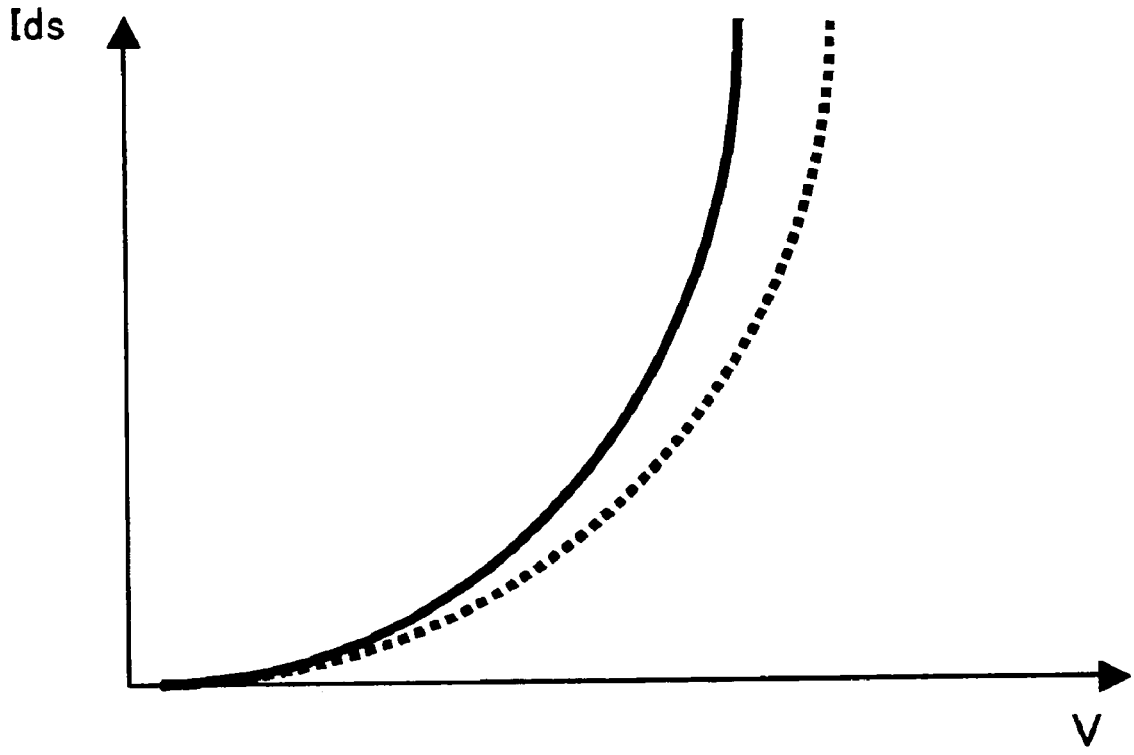
FIG. 3 is a diagram showing aging of the current-voltage (I-V) characteristic of the organic EL element.
Figure 4:
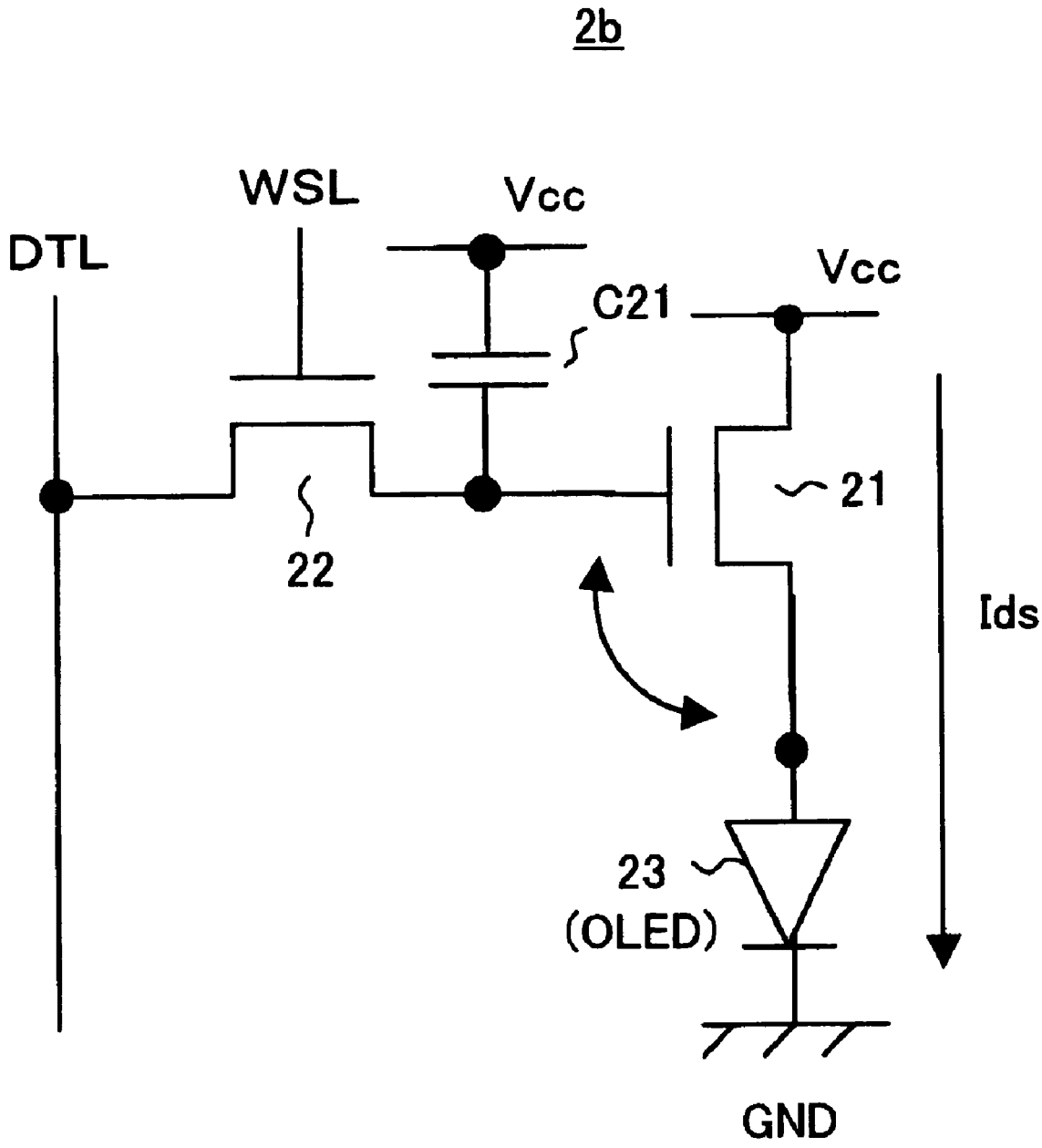
FIG. 4 is a circuit diagram showing a pixel circuit obtained by replacing a p-channel TFT of the circuit of FIG. 2 by an n-channel TFT.
Figure 5:
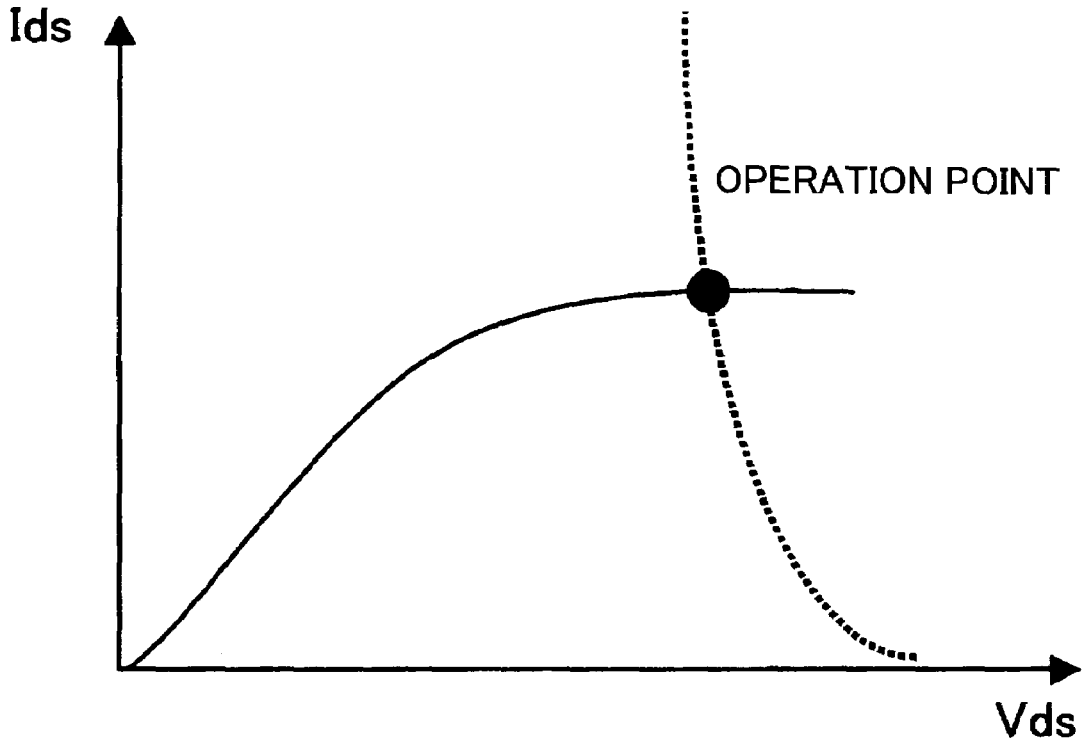
FIG. 5 is a diagram showing operation points of a drive transistor constituted by a TFT and an EL element in an initial state.
Figure 6:
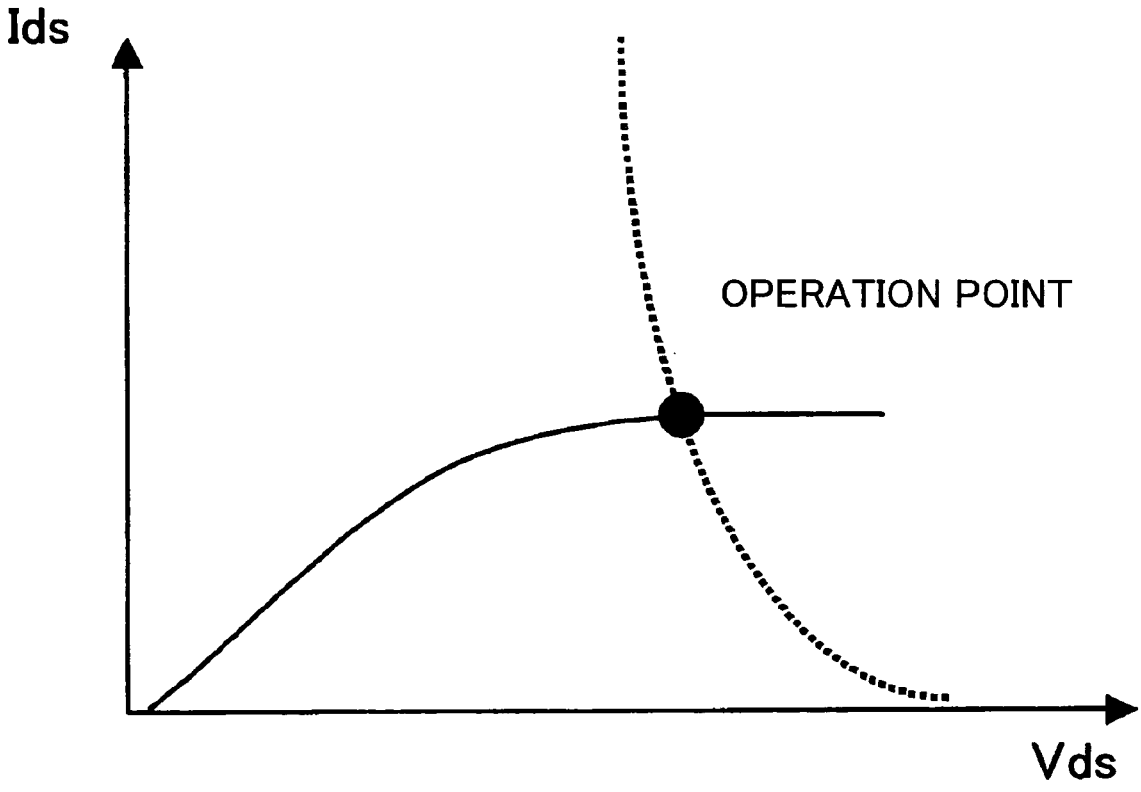
FIG. 6 is a diagram showing operation points of a drive transistor constituted by a TFT and an El element after aging.
Figure 7:
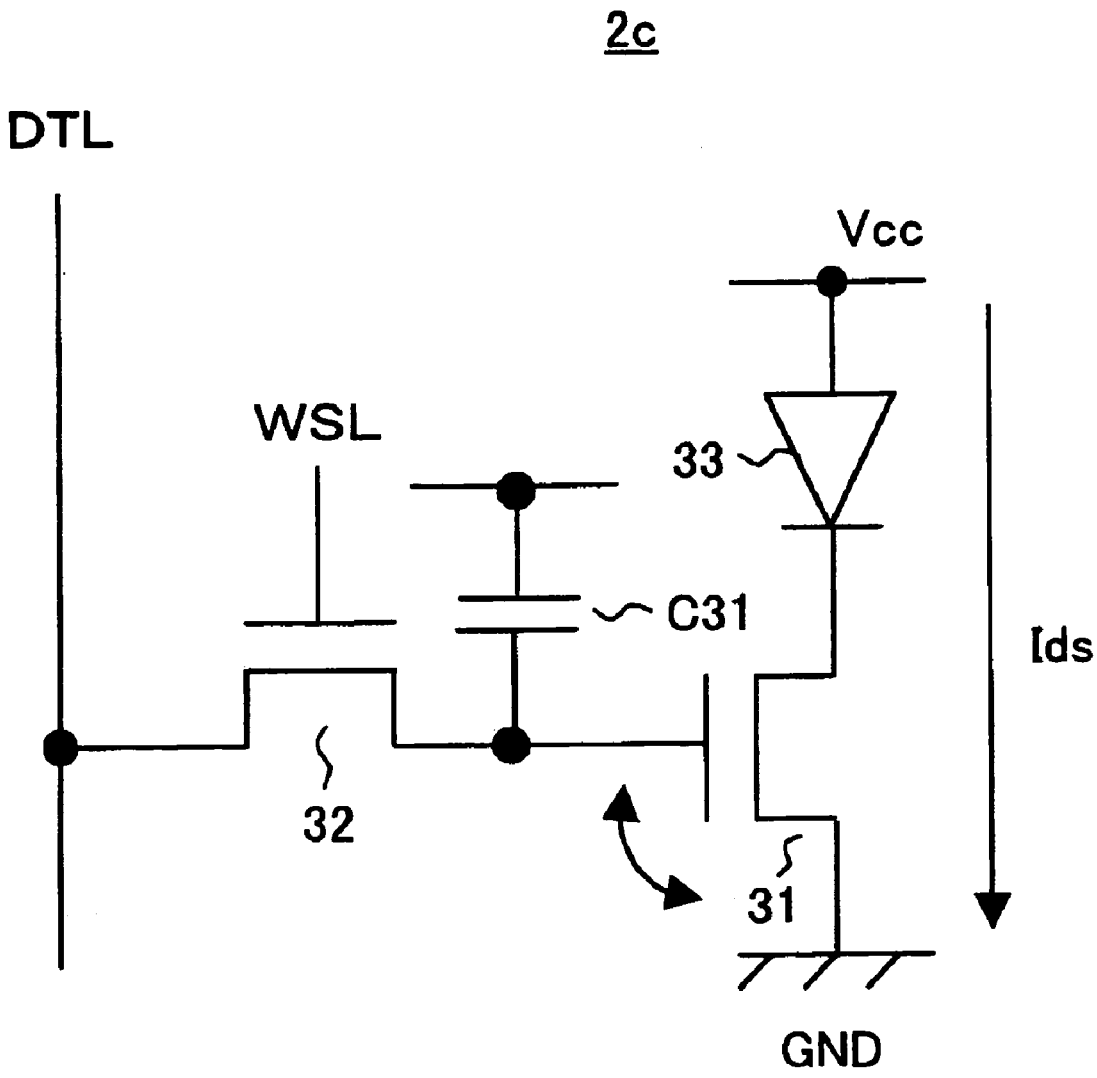
FIG. 7 is a circuit diagram showing a pixel circuit in which a source of the drive transistor constituted by an n-channel TFT is connected to a ground potential.

In general, the reference numerals used refer to elements as described; 100, 100A to 100J . . . display device, 101 . . . pixel circuit (PXLC), 102 . . . pixel array, 103 . . . horizontal selector (HSEL), 104 . . . write scanner (WSCN), 105 . . . first drive scanner (DSCN1), 106 . . . second drive scanner (DSCN2), 107 . . . third drive scanner (DSCN3), 108 . . . fourth drive scanner (DSCN4), 109 . . . fifth drive scanner (DSCN5), 110 . . . sixth drive scanner (DSCN6), DTL101 to DTL10n . . . data line, WSL101 to WSL10m . . . scanning lines, DSL101 to DSL10m, DSL111 to DSL11m , DSL121 to DSL12m, DSL131 to DSL13m, DSL141 to DSL14m, DSL151 to DSL15m, DSL161 to DSL16m . . . drive lines, 111 . . . drive transistor constituted by TFT, 112 . . . first switch constituted by TFT, 113 . . . second switch constituted by TFT, 114 . . . third switch constituted by TFT, 115 . . . fourth switch constituted by TFT, 116 . . . fifth switch constituted by TFT, 117 . . . sixth switch constituted by TFT, 118 . . . seventh switch constituted by TFT, 119 . . . light emitting element, 120 . . . seventh or eighth switch constituted by TFT, 121 . . . eighth or ninth switch constituted by TFT, ND111 . . . first node, ND112 . . . second node, ND113 . . . third node, ND114 . . . fourth node.

BEST MODE FOR WORKING THE INVENTION

Below, embodiments of the present invention will be explained with reference to the attached drawings.

First Embodiment

Figure 8:
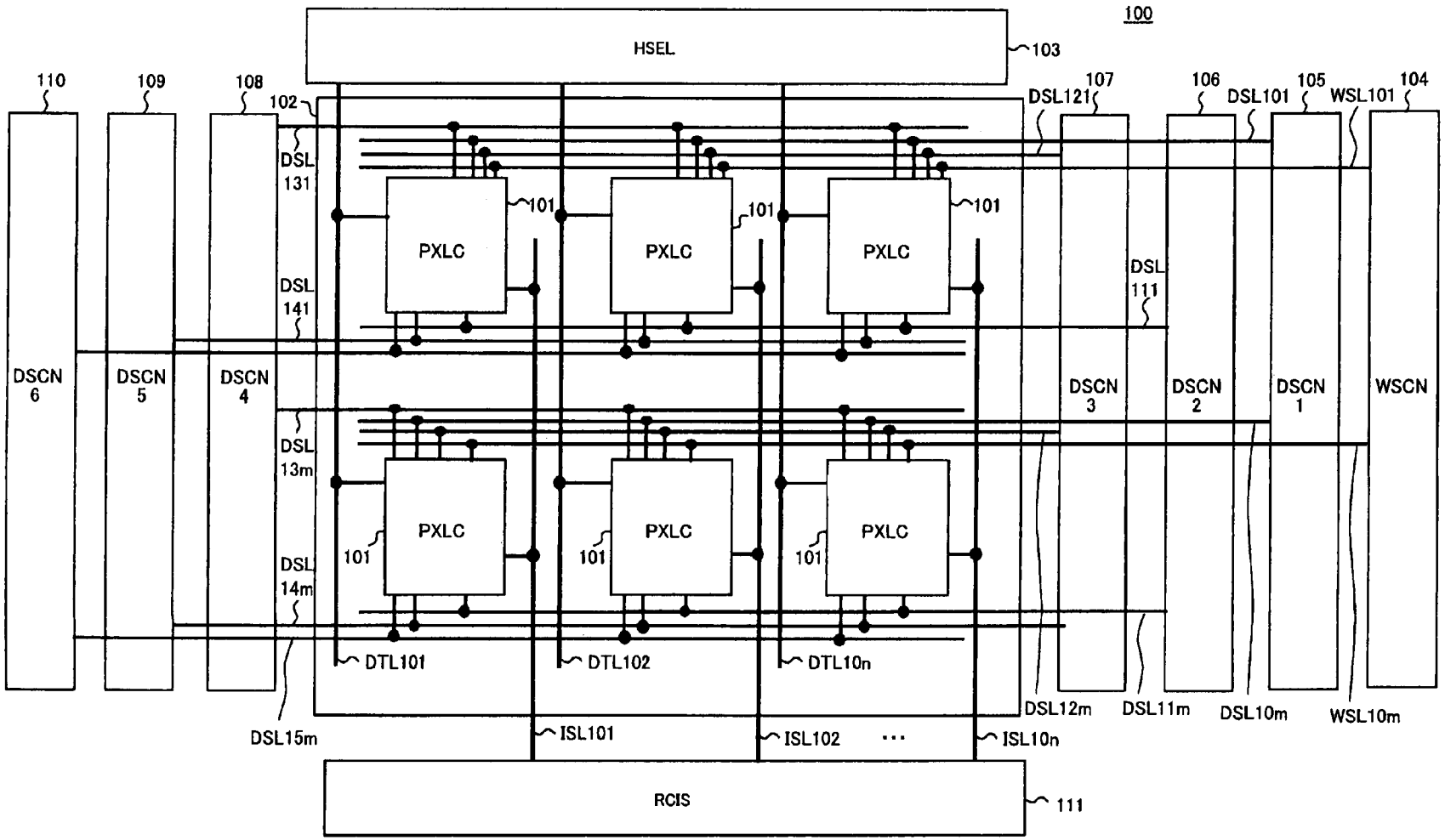
FIG. 8 is a block diagram showing the configuration of an organic EL display device employing a pixel circuit according to a first embodiment.

FIG. 8 is a block diagram showing the configuration of an organic EL display device employing a pixel circuit according to the first embodiment.

Figure 9:
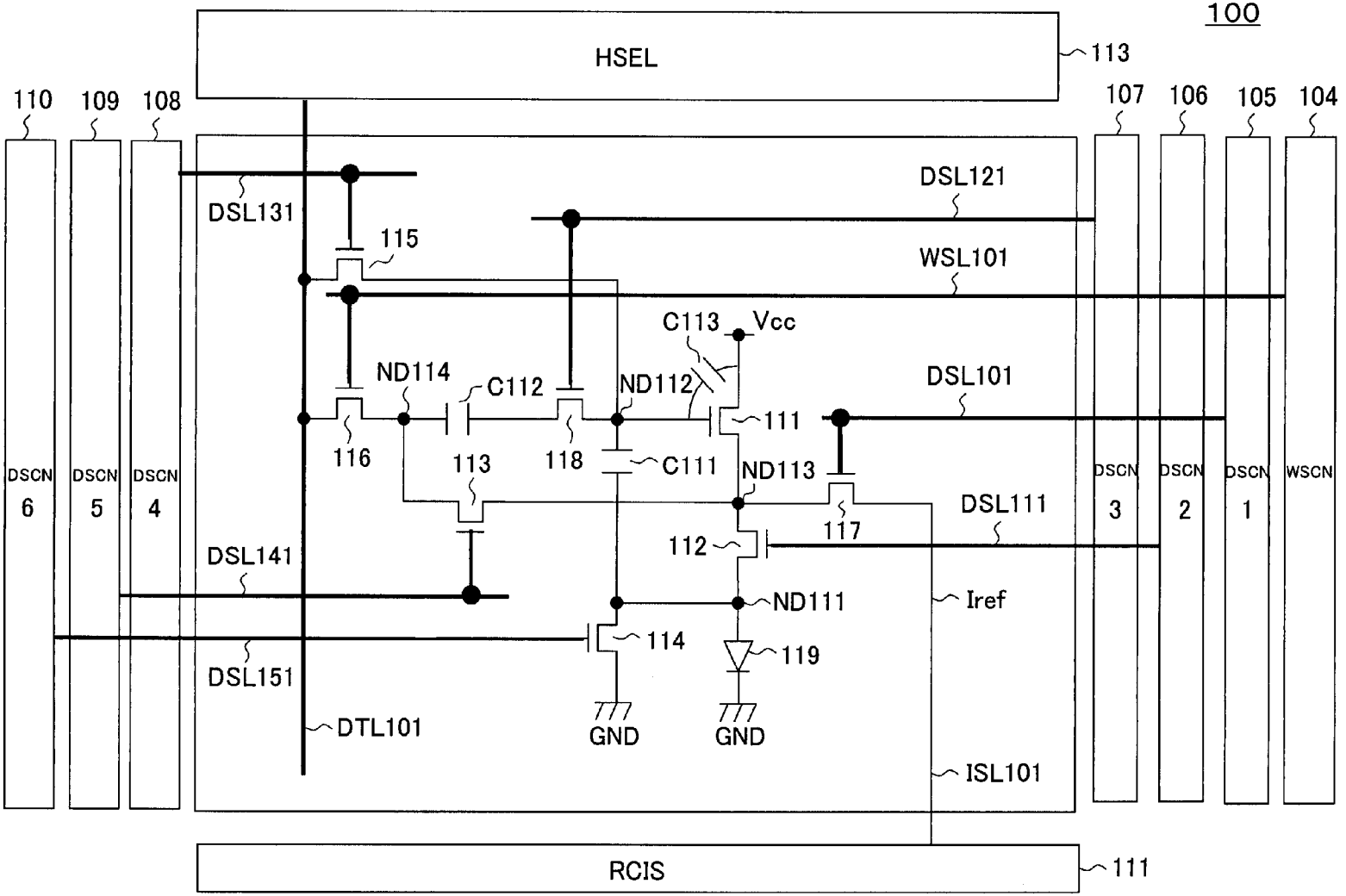
FIG. 9 is a circuit diagram showing a specific configuration of a pixel circuit according to the first embodiment in the organic EL display device of FIG. 8.

FIG. 9 is a circuit diagram showing a specific configuration of a pixel circuit according to the first embodiment in the organic EL display device of FIG. 8.

This display device 100, as shown in FIG. 8 and FIG. 9, has a pixel array 102 comprised of pixel circuits (PXLC) 101 arranged in an m×n matrix, horizontal selector (HSEL) 103, write scanner (WSCN) 104, first drive scanner (DSCN1) 105, second drive scanner (DSCN2) 106, third drive scanner (DSCN3) 107, fourth drive scanner (DSCN4) 108, fifth drive scanner (DSCN5) 109, sixth drive scanner (DSCN6) 110, reference constant current source (RCIS) 111, data lines DTL101 to DTL10n selected by the horizontal selector 103 and supplied with data signals in accordance with the luminance information, scanning lines WSL101 to WSL10m selected and driven by the write scanner 104, drive lines DSL101 to DSL10m selected and driven by the first drive scanner 105, drive lines DSL111 to DSL11m selected and driven by the second drive scanner 106, drive lines DSL121 to DSL12m selected and driven by the third drive scanner 107, drive lines DSL131 to DSL13m selected and driven by the fourth drive scanner 108, drive lines DSL141 to DSL14m selected and driven by the fifth drive scanner 109, drive lines DSL151 to DSL15m selected and driven by the sixth drive scanner 110, and reference current supply lines ISL101 to ISL10n supplied with the reference current Iref by the constant current source 111.

Note that, in the pixel array 102, the pixel circuits 101 are arranged in an m×n matrix, but in FIG. 8, for simplification of the drawing, an example in which they are arranged in a 2(=m)×3(=n) matrix is shown.

Further, in FIG. 9 as well, for simplification of the drawing, the specific configuration of one pixel circuit is shown.

The pixel circuit 101 according to the first embodiment, as shown in FIG. 9, has n-channel TFT 111 to TFT 118, capacitors C111 and C112, a light emitting element 119 made of an organic EL element (OLED: electro-optical element), a first node ND111, a second node ND112, a third node ND113, and a fourth node ND114.

Further, in FIG. 9, DTL101 indicates the data line, WSL101 indicates the scanning line, and DSL101, DSL111, DSL121, DSL131, DSL141, and DSL151 indicate drive lines.

Among these components, the TFT 111 configures the field effect transistor (drive transistor) according to the present invention, the TFT 112 configures the first switch, the TFT 113 configures the second switch, the TFT 114 configures the third switch, the TFT 115 configures the fourth switch, the TFT 116 configures the fifth switch, the TFT 117 configures the sixth switch, the TFT 118 configures the seventh switch as the electric connecting means, the capacitor C111 configures the pixel capacitor element according to the present invention, and the capacitor C112 configures the coupling capacitor element according to the present invention.

The supply line (power supply potential) of the power supply voltage VCC corresponds to the first reference potential, and the ground potential GND corresponds to the second reference potential.

Further, in the first embodiment, the data line and the predetermined potential line are shared.

In the pixel circuit 101, between the first reference potential (the power supply potential VCC in the present embodiment) and the second reference potential (the ground potential GND in the present embodiment), the drive transistor constituted by the TFT 111, the third node ND113, the first switch constituted by the TFT 112, the first node ND111, and the light emitting element (OLED) 119 are connected in series.

Specifically, a cathode of the light emitting element 119 is connected to the ground potential GND, an anode is connected to the first node ND111, the source of the TFT 112 is connected to the first node ND111, source and drain of the TFT 112 are connected between the first node ND111 and the third node ND113, a source of the TFT 111 is connected to the third node ND113, and a drain of the TFT 111 is connected to the power supply potential VCC.

A gate of the TFT 111 is connected to the second node ND112, and a gate of the TFT 112 is connected to the drive line DSL111 driven by the second drive scanner 106.

A source and drain of the second switch constituted by the TFT 113 are connected between the third node ND113 and the fourth node ND114, and a gate of the TFT 113 is connected to the drive line DSL141 driven by the fifth drive scanner 109.

A drain of the third switch constituted by the TFT 114 is connected to the first node ND111 and a first electrode of the capacitor C111, a source is connected to the fixed potential (the ground potential GND in the present embodiment), and a gate of the TFT 114 is connected to the drive line DSL151 driven by the sixth drive scanner. Further, a second electrode of the capacitor C111 is connected to the second node ND112.

A source and drain of the seventh switch constituted by the TFT 118 are connected to the second node ND112 and a first electrode of the capacitor C112, and a gate driven by the third drive scanner of the TFT 118 is connected to the drive line DSL121.

A source and drain of the fourth switch constituted by the TFT 115 are connected to the data line (predetermined potential line) DTL101 and the second node ND112, and a gate of the TFT 115 is connected to the drive line DSL131 driven by the fourth drive scanner 108.

A source and drain of the fifth switch constituted by the TFT 116 are connected to the data line DTL101 and the fourth node ND114. A gate of the TFT 116 is connected to the scanning line WSL101 driven by the write scanner 104.

Further, the source and drain of the sixth switch constituted by the TFT 117 are connected between the third node ND113 and the reference current supply source line ISL101. A gate of the TFT 117 is connected to the drive line DSL101 driven by the first drive scanner 105.

In this way, the pixel circuit 101 according to the present embodiment is configured so that the pixel capacitance constituted by the capacitor C111 is connected between the gate and source of the drive transistor constituted by the TFT 111, a source side potential of the TFT 111 is connected to the fixed potential via the switch transistor constituted by the TFT 114 in a non-light emission period, the predetermined reference current (for example 2 μA) is supplied to the source of the TFT 111 (third node ND13) at a predetermined timing, a voltage corresponding to the reference current Iref is held, and the input signal voltage is coupled centered on the voltage, whereby the EL light emitting element 119 is driven centered about the center value of variations of the mobilities, and an image quality suppressing the variation of the uniformity due to variation of the mobilities of the drive transistor constituted by the TFT 111 is obtained.

Next, the operation of the above configuration will be explained focusing on the operation of the pixel circuit with reference to FIGS. 10A to 10I and FIG. 11, FIGS. 12A and 12B, and FIG. 13 and FIG. 14.

Note that FIG. 10A shows a drive signal ds[4] applied to the drive line DSL131 of the first row in the pixel alignment, FIG. 10B shows a scanning signal ws[1] applied to the scanning line WSL101 of the first row in the pixel alignment, FIG. 10C shows a drive signal ds[3] applied to the drive line DSL121 of the first row in the pixel alignment, FIG. 10D shows a drive signal ds[5] applied to the drive line DSL141 of the first row in the pixel alignment, FIG. 10E shows a drive signal ds[6] applied to the drive line DSL151 of the first row in the pixel alignment, FIG. 10F shows a drive signal ds[2] applied to the drive line DSL111 of the first row in the pixel alignment, FIG. 10G shows a drive signal ds[1] applied to the drive line DSL101 of the first row in the pixel alignment, FIG. 10H shows a gate potential Vg111 of the drive transistor constituted by the TFT 111, and FIG. 10I shows a potential VND111 of the first node ND111.

First, at the time of the light emission state of the ordinary EL light emitting element 119, as shown in FIGS. 10A to 10G, the scanning signal ws[1] to the scanning line WSL101 is set at the low level by the write scanner 104, the drive signal ds[1] to the drive line DSL101 is set at the low level by the drive scanner 105, the drive signal ds[3] to the drive line DSL121 is set at the low level by the drive scanner 107, the drive signal ds[4] to the drive line DSL131 is set at the low level by the drive scanner 108, the drive signal ds[5] to the drive line DSL141 is set at the low level by the drive scanner 109, the drive signal ds[6] to the drive line DSL151 is set at the low level by the drive scanner 110, and only the drive signal ds[2] to the drive line DSL111 is selectively set at a high level by the drive scanner 106.

Figure 11B:
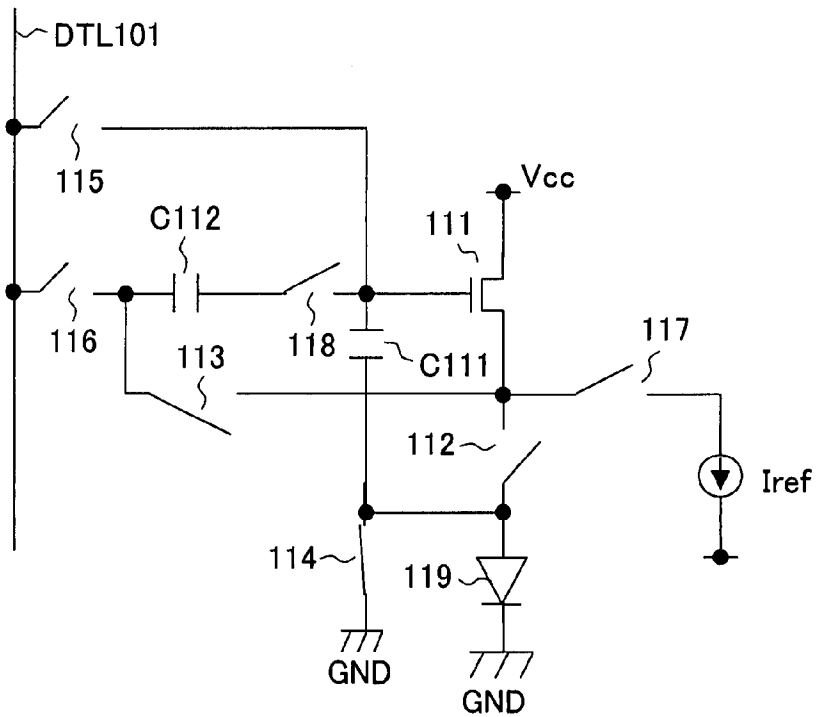
FIGS. 11A and 11B are diagrams for explaining an operation according to the method of driving the circuit of FIG. 9.
Figure 11A:
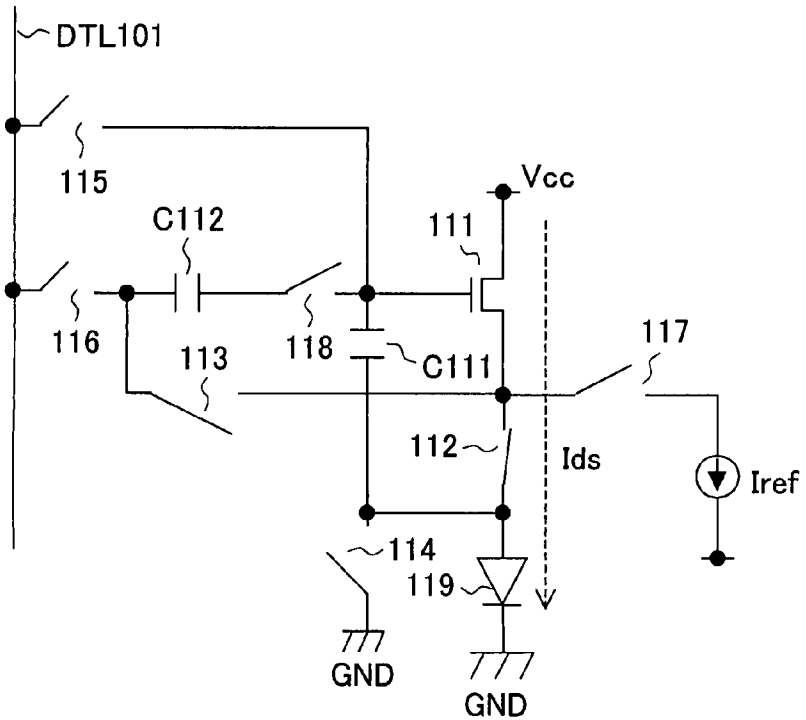

As a result, in the pixel circuit 101, as shown in FIG. 11A, the TFT 112 is held in the ON state (conductive state), and the TFT 113 to TFT 118 are held in the OFF state (non-conductive state).

The drive transistor 111 is designed so as to operate in the saturated region, and the current Ids flowing in the EL light emitting element 119 takes a value shown by the above Equation 1.

Next, in the non-light emission period of the EL light emitting element 119, as shown in FIGS. 10A to 10G, the scanning signal ws[1] to the scanning line WSL101 is held at the low level by the write scanner 104, the drive signal ds[1] to the drive line DSL101 is held at the low level by the drive scanner 105, the drive signal ds[2] to the drive line DSL111 is switched to the low level by the drive scanner 106, the drive signal ds[3] to the drive line DSL121 is held at the low level by the drive scanner 107, the drive signal ds[4] to the drive line DSL131 is held at the low level by the drive scanner 108, the drive signal ds[5] to the drive line DSL141 is held at the low level by the drive scanner 109, and the drive signal ds[6] to the drive line DSL151 is selectively set at the high level by the drive scanner 110.

As a result, in the pixel circuit 101, as shown in FIG. 11B, the TFT 112 becomes OFF, and the TFT 114 becomes ON in the state where the TFT 113, and TFT 115 to TFT 118 are held in the OFF state as they are.

At this time, the current flows via the TFT 114, and the potential VND111 of the first node ND111 falls to the ground potential GND as shown in FIGS. 10H and 10I. For this reason, the voltage applied to the EL light emitting element 119 becomes 0V, and the EL light emitting element 119 no longer emits light.

Next, as shown in FIGS. 10A to 10G, in the state where the scanning signal ws[1] to the scanning line WSL101 is held at the low level by the write scanner 104, the drive signal ds[2] to the drive line DSL111 is held at the low level by the drive scanner 106, and the drive signal ds[6] to the drive line DSL151 is held at the high level by the drive scanner 110, the drive signal ds[1] to the drive line DSL101 from the drive scanner 105, the drive signal ds[3] to the drive line DSL121 by the drive scanner 107, the drive signal ds[4] to the drive line DSL131 by the drive scanner 108, and the drive signal ds[5] to the drive line DSL141 are selectively set at the high level by the drive scanner 109.

Figure 12B:
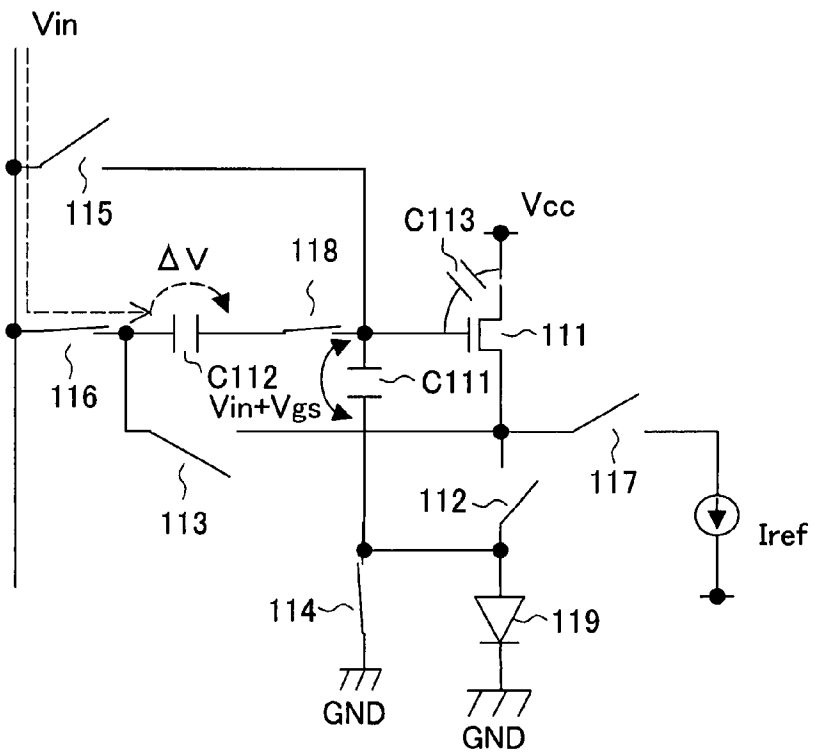
FIGS. 12A and 12B are diagrams for explaining the operation according to the method of driving the circuit of FIG. 9.
Figure 12A:
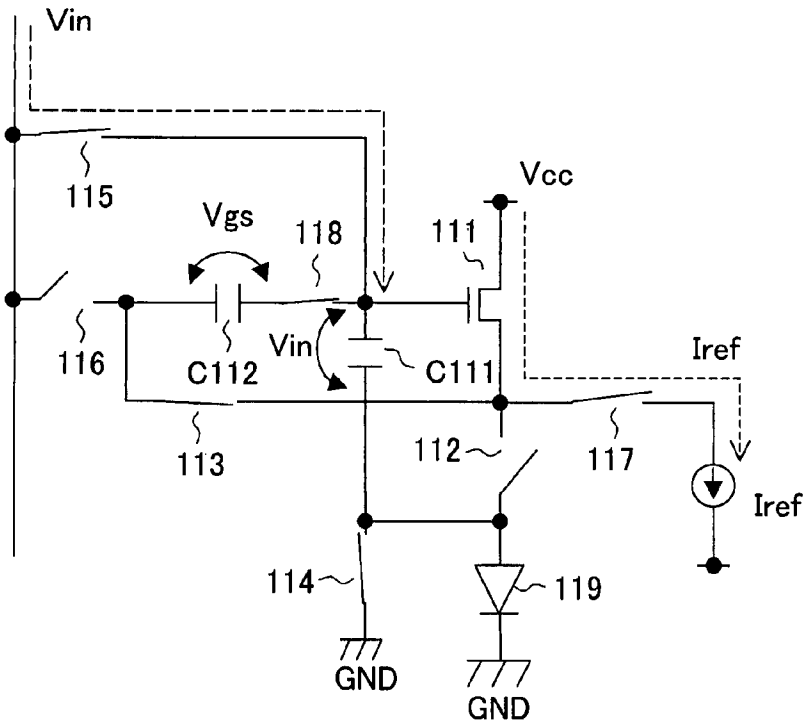

As a result, in the pixel circuit 101, as shown in FIG. 12A, the TFT 113, TFT 115, TFT 117, and TFT 118 become ON in the state where the TFT 114 is held in the ON state and the TFT 112 and 116 are held in the OFF state as they are.

Due to this, the input voltage Vin propagated through the data line DTL101 via the TFT 115 is input to the second node ND112, and the reference current Iref (for example 2 μA) supplied to the reference current supply line ISL101 by the constant current source 111 flows in the third node ND113 parallel to this. As a result, the voltage Vgs between the gate and source of the drive transistor constituted by the TFT 111 is charged in the capacitor C112.

At this time, the TFT 111 operates in the saturated region, therefore, as shown in the following Equation (2), the gate/source voltage Vgs of the TFT 111 becomes a term including the mobility μ and the threshold value Vth. Further, at this time, Vin is charged in the capacitor C111.

(Equation 2)

$$Vgs=Vth+\{2Ids/(\mu(W/L)Cox)\}^2 \quad (2)$$

Next, after Vin is charged in the capacitor C111, as shown in FIGS. 10A to 10G, in the state where the scanning signal ws[1] to the scanning line WSL101 is held at the low level by the write scanner 104, the drive signal ds[2] to the drive line DSL111 is held at the low level by the drive scanner 106, the drive signal ds[3] to the drive line DSL121 is held at the high level by the drive scanner 107, the drive signal ds[4] to the drive line DSL131 is held at the high level by the drive scanner 108, and the drive signal ds[6] to the drive line DSL151 is held at the high level by the drive scanner 110, the drive signal ds[1] to the drive line DSL101 is selectively set at the low level by the drive scanner 105, and the drive signal ds[4] to the drive line DSL141 is selectively set at the low level by the drive scanner 109.

As a result, in the pixel circuit 101, from the state of FIG. 12A, the TFT 113 and the TFT 117 become OFF. Due to this, the source potential of the TFT 111 (potential of the third node ND113) rises up to (Vin−Vth).

Then, further, the scanning signal ws[1] to the scanning line WSL101 is switched to the high level by the write scanner 104, and the drive signal ds[4] to the drive line DSL131 is switched to the low level by the drive scanner 108.

As a result, in the pixel circuit 101, as shown in FIG. 12B, in the state where the TFT 114 and the TFT 118 are held in the ON state, and the TFT 112, the TFT 113, and the TFT 117 are held in the OFF state as they are, the TFT 116 becomes ON, and the TFT 115 becomes OFF.

By the turning on of the TFT 116, the input voltage Vin propagated through the data line DTL101 via the TFT 116 couples the voltage ΔV with the gate of the TFT 111 through the capacitor C112.

This coupling amount ΔV is determined according to the voltage change between the first node ND111 and the second node ND112 (Vgs of the TFT 111), capacitances of capacitors C111 and C112, and the parasitic capacitance 113 of the TFT 111. When the capacitance of the capacitor C112 is made large in comparison with the capacitance of the capacitor C111 and the parasitic capacitance C113, almost all of the change is coupled with the gate of the TFT 111, and the gate potential of the TFT 111 becomes (Vin+Vgs).

After the end of the writing, as shown in FIGS. 10A to 10G, the scanning signal ws[1] to the scanning line WSL101 is switched to the low level by the write scanner 104, the drive signal ds[3] to the drive line DSL121 is switched to the low level by the drive scanner 107, further the drive signal ds[2] to the drive line DSL111 is switched to the high level by the drive scanner 106, and the drive signal ds[6] to the drive line DSL151 is switched to the low level by the drive scanner 110.

Figure 13:
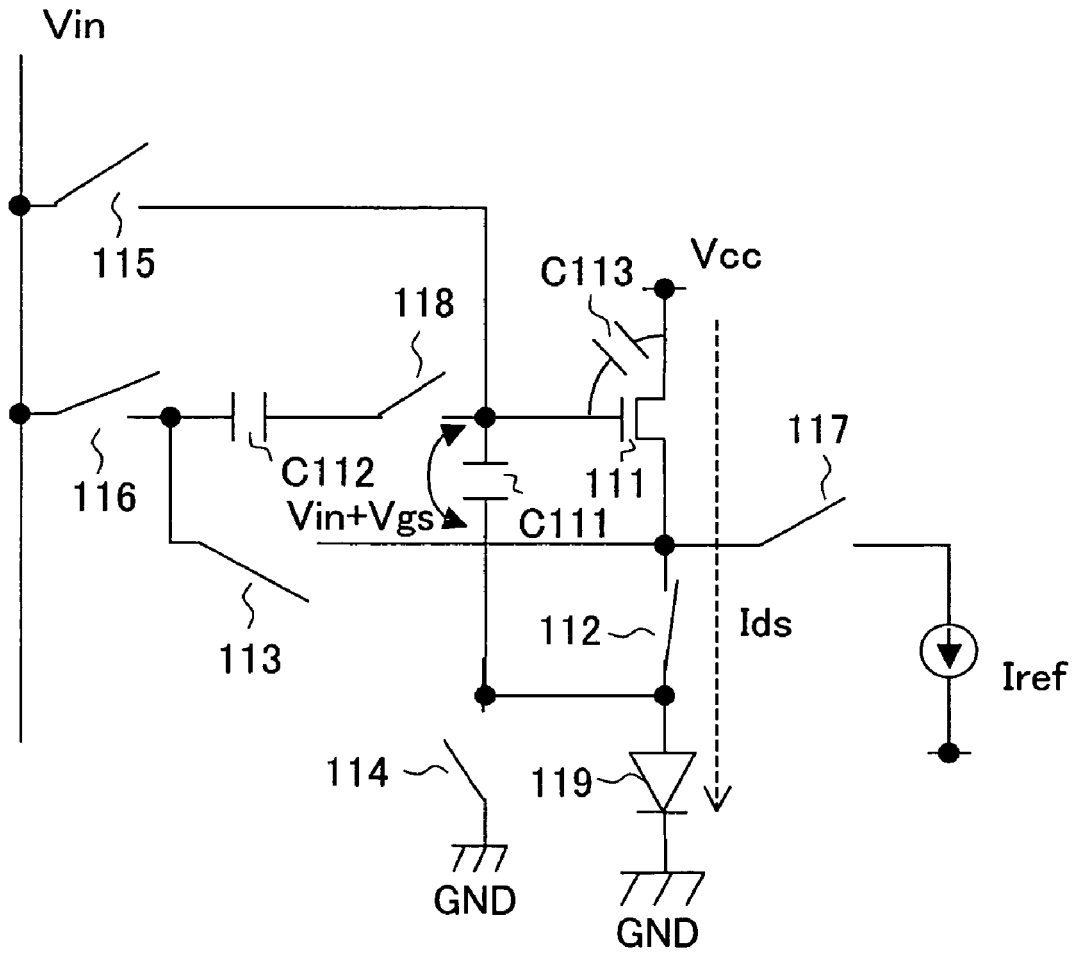
FIG. 13 is a diagram for explaining the operation according to the method of driving the circuit of FIG. 9.

Due to this, in the pixel circuit 101, as shown in FIG. 13, the TFT 116 and the TFT 118 become OFF, and further the TFT 112 becomes ON, and the TFT 114 becomes OFF.

Due to this, the source potential of the TFT 111 once falls to the ground potential GND then rises, and current starts to flow also in the EL light emitting element 119. Irrespective of the fluctuation of the source potential of the TFT 111, the capacitor C111 exists between the gate and source thereof. By making the capacitance of the capacitor C111 larger than the parasitic capacitance C113 of the TFT 111, the gate/source potential is constantly held at the constant value such as (Vin+Vgs).

At this time, the TFT 111 is driven in the saturated region, therefore the value of the current Ids flowing in the TFT 111 becomes the value shown by Equation 1 and is determined by the gate/source voltage. This Ids flows also in the EL light emitting element 119 in the same way, and the EL light emitting element 119 emits light.

Figure 14:
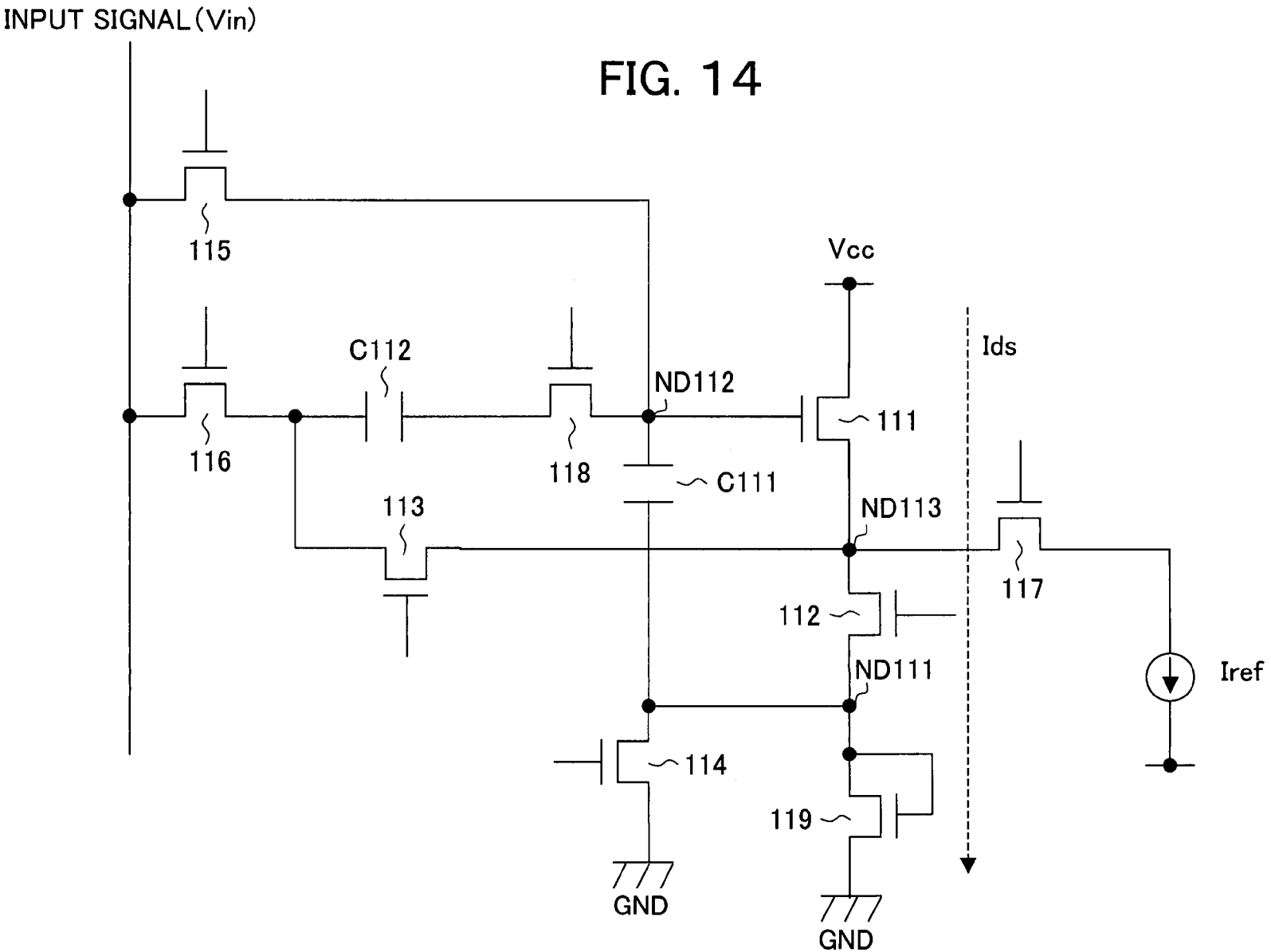
FIG. 14 is a diagram for explaining the operation according to the method of driving the circuit of FIG. 9.

An equivalent circuit of the pixel circuit 101 including this EL light emitting element 119 becomes as shown in FIG. 14, therefore the source potential of the TFT 111 rises up to the gate potential for running the current Ids through the EL light emitting element 119. Along with this potential rise, the gate potential of the TFT 111 rises in the same way via the capacitor C111.

Due to this, the gate/source potential of the TFT 111 is held constant as previously explained.

Here, the reference current Iref will be considered.

As explained above, by running the reference current Iref, the gate/source voltage of the TFT 111 is given the value represented by Equation 2.

Figure 15:
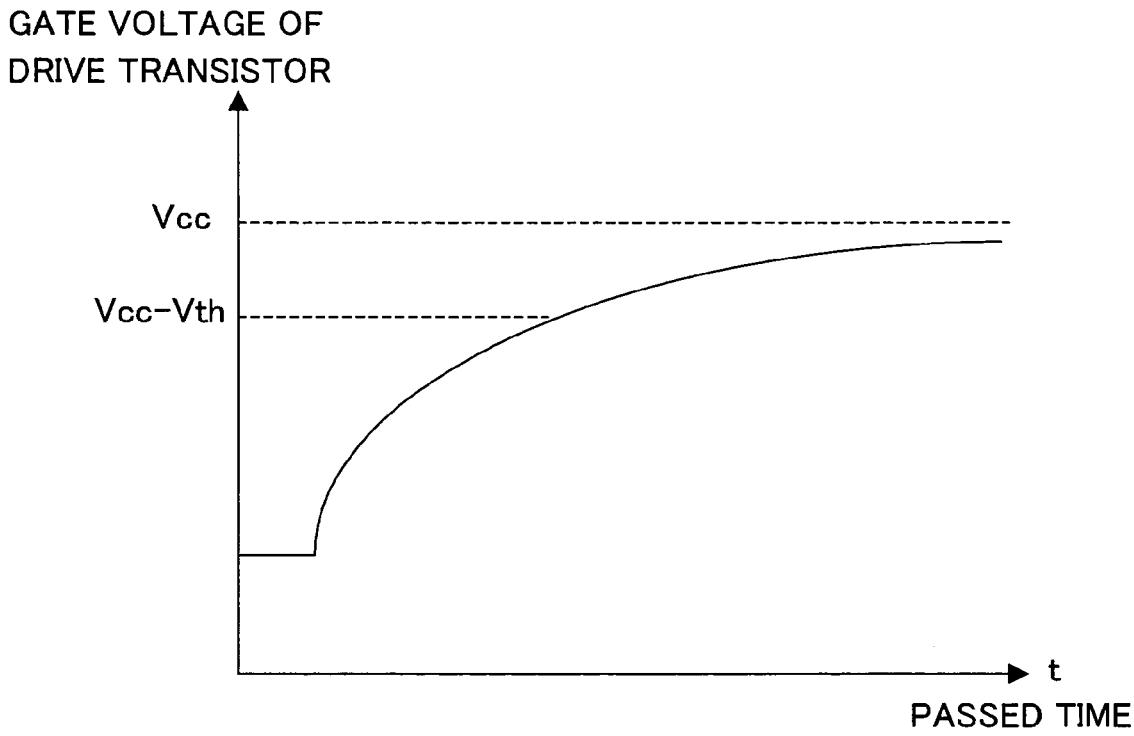
FIG. 15 is a diagram for explaining a reason why a reference current is supplied to the source of the drive transistor.

However, the gate/source voltage does not become Vth when Iref=0. This is because even when the gate/source voltage becomes Vth, a leakage current slightly flows in the TFT 111, therefore, as shown in FIG. 15, the source voltage of the TFT 111 rises up to Vcc.

In order to make the gate/source voltage of the TFT 111 Vth, it is necessary to adjust the period for turning on the TFT 113 and turn off the TFT 113 when the gate/source voltage becomes Vth. This timing must be adjusted for each panel in a real device.

Figure 16:
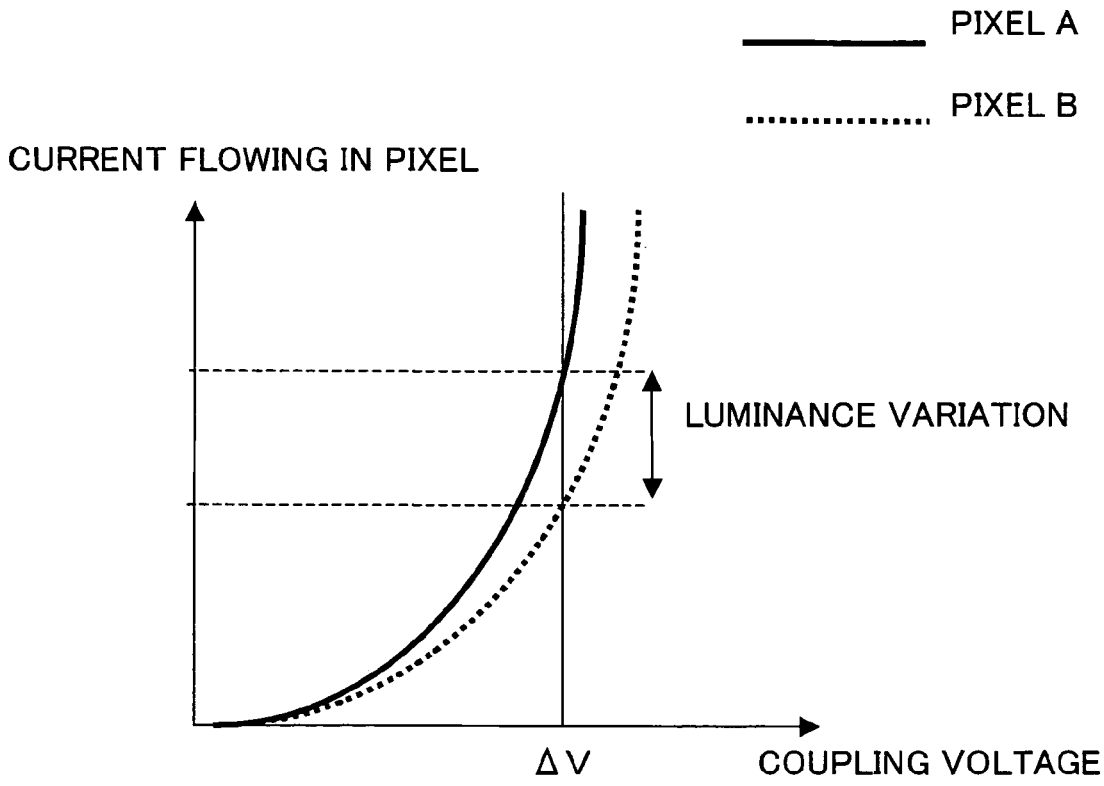
FIG. 16 is a diagram for explaining the reason why a reference current is supplied to the source of the drive transistor.

As in the present embodiment, when the reference current Iref is not flowing, even if the gate/source voltage can be set at Vth by adjusting the timing of the TFT 113, even when the same input voltage Vin is applied in for example the pixels A and B having different mobilities, according to Equation 1, variation of the current Ids occurs according to the mobility μ as shown in FIG. 16, and the luminance of the pixel becomes different. That is, as a larger value of current flows and it becomes brighter, the current value is affected by the variation of mobilities, the uniformity varies, and the image quality is degraded.

Figure 17:
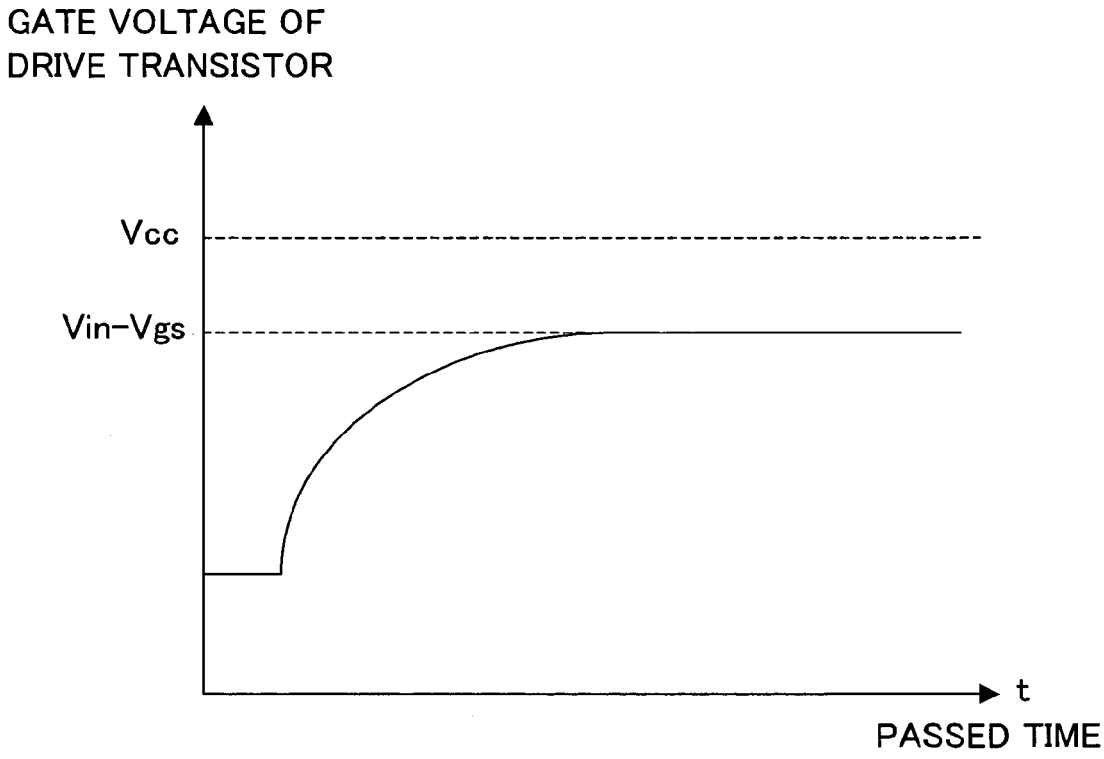
FIG. 17 is a diagram for explaining the reason why a reference current is supplied to the source of the drive transistor.
Figure 18:
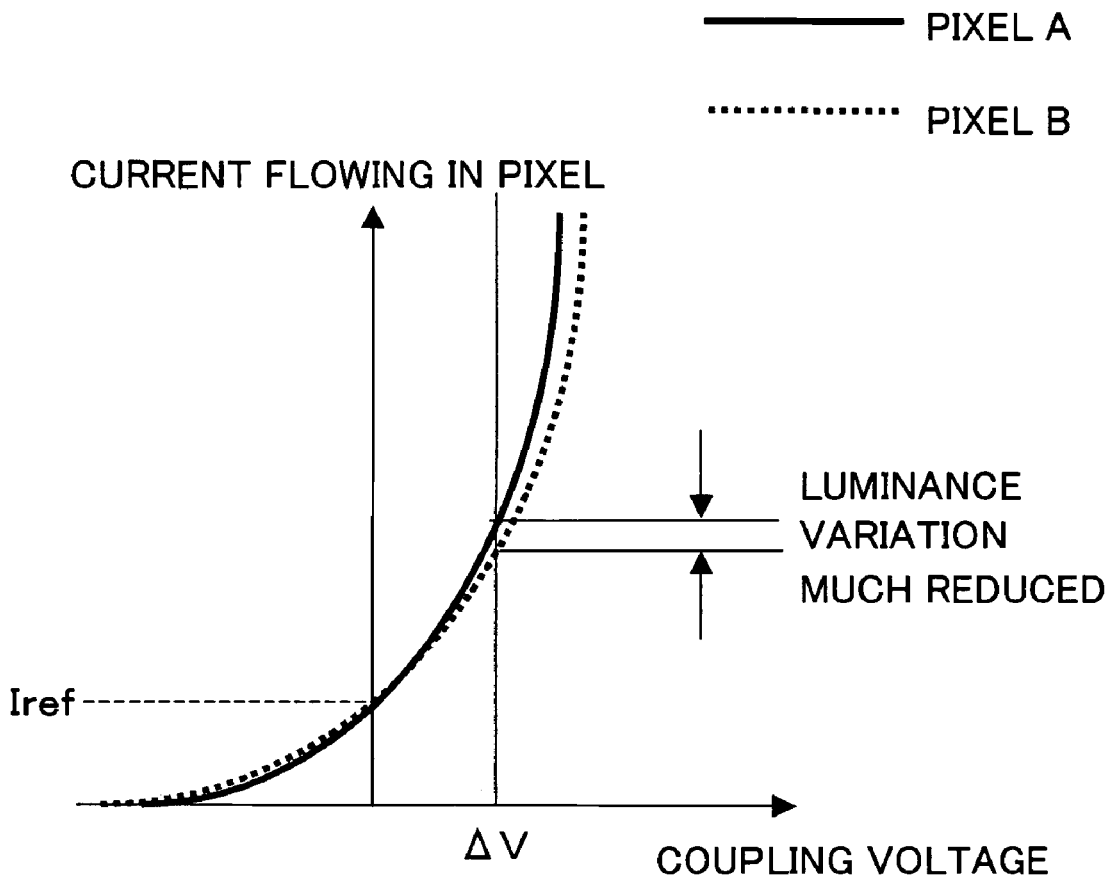
FIG. 18 is a diagram for explaining the reason why a reference current is supplied to the source of the drive transistor.

However, as in the present embodiment, by running a constant amount of reference current Iref, as shown in FIG. 17, not according to the ON/OFF timing of the TFT 113, the gate/source voltage of the TFT 111 can be set to a constant value shown in Equation 2. Even in the pixels A and B having different mobilities, as shown in FIG. 18, the variation of the current Ids can be kept small, therefore variation of the uniformity can be suppressed.

Further, the circuit of the present embodiment will be considered based on problems of the usual source-follower. Also in the present circuit, as the light emission time of the EL light emitting element 119 becomes longer, the I-V characteristic thereof deteriorates. For this reason, even when the TFT 111 passes the same value of current, the potential applied to the EL light emitting element 119 changes, and the potential VND111 of the first node ND111 falls.

However, in the present circuit, the potential VND111 of the first node ND111 falls in the state where the gate/source potential of the TFT 111 is held constant as it is, therefore the current flowing in the TFT 111 does not change.

Accordingly, even when the current flowing in the EL light emitting element 119 does not change, and the I-V characteristic of the EL light emitting element 119 deteriorates, a current corresponding to the gate/source voltage constantly continuously flows, so the past problems can be solved.

As explained above, according to the first embodiment, the voltage drive type TFT active matrix organic EL display device is configured so that the capacitor C111 is connected between the gate and source of the drive transistor constituted by the TFT 111, the source side of the TFT 111 (the first node ND111) is connected through the TFT 114 to the fixed potential (GND in the present embodiment), the predetermined reference current (for example 2 μA) Iref is supplied to the source of the TFT 111 (the third node ND13) at a predetermined timing, the voltage corresponding to the reference current Iref is held, and the input signal voltage is coupled centered about the voltage, to thereby drive the EL light emitting element 119 centered about the center value of variations of mobilities, therefore the following effects can be obtained.

Namely, even when the I-V characteristic of the EL light emitting element changes by aging, a source-follower output without luminance deterioration can be obtained.

A source-follower circuit of an n-channel transistor becomes possible, and the n-channel transistor can be used as the drive element of the EL light emitting element by using current anode/cathode electrodes as they are.

Further, not only variation of threshold values of drive transistors, but also variation of mobilities can be greatly suppressed, and an image quality having good uniformity can be obtained.

Further, variation of the threshold values of drive transistors is cancelled out by the reference current, therefore it is not necessary to cancel the threshold value by setting the ON/OFF timing of the switch for each panel, therefore an increase of the number of steps for setting the timing can be suppressed.

Further, the transistors of the pixel circuits can be configured by only n-channel transistors, and it becomes able to use the a-Si process in TFT fabrication. Due to this, a reduction of the cost of the TFT substrate becomes possible.

Second Embodiment

Figure 19:
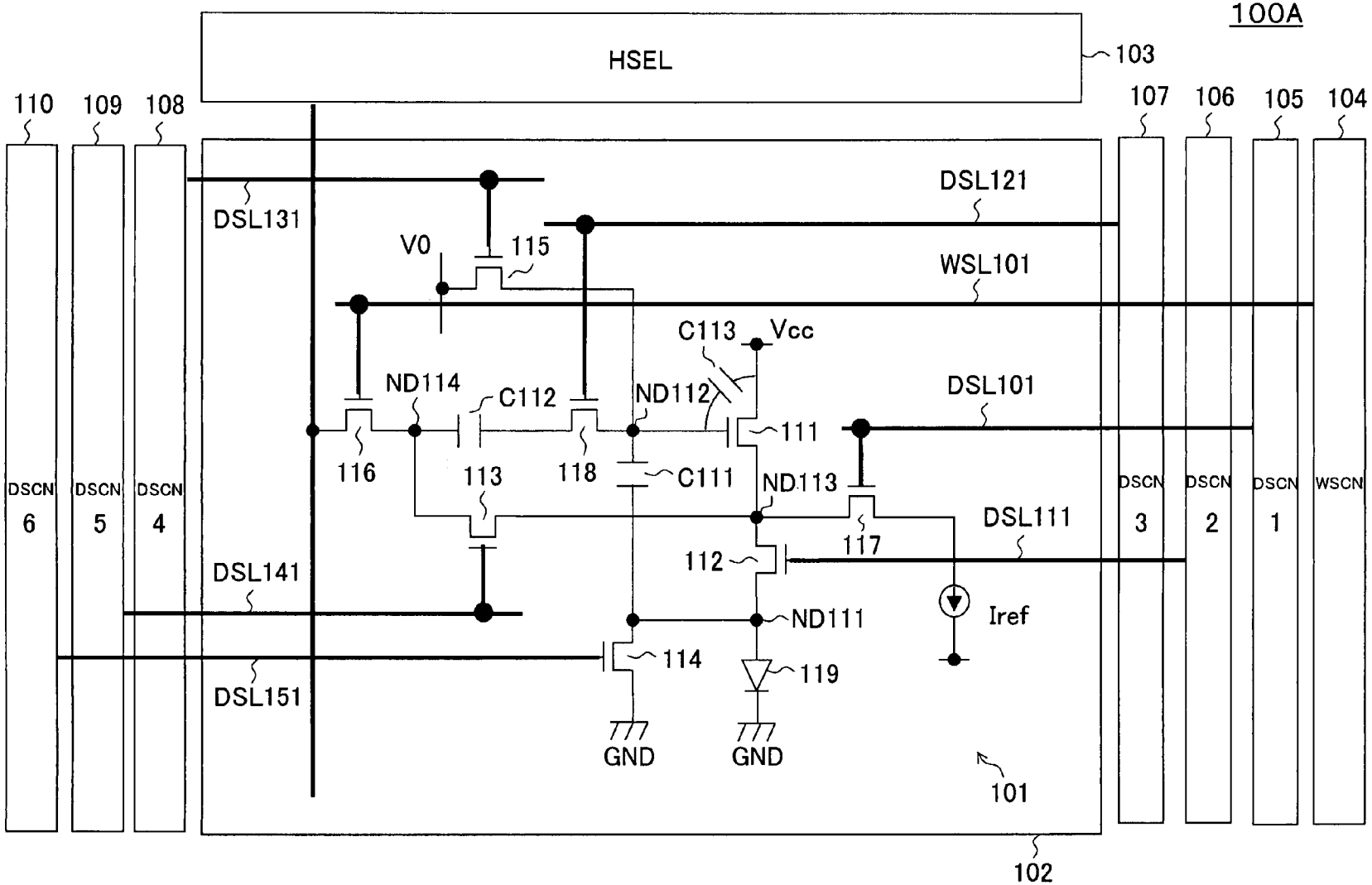
FIG. 19 is a circuit diagram showing a specific configuration of a pixel circuit according to a second embodiment.
Figure 20:
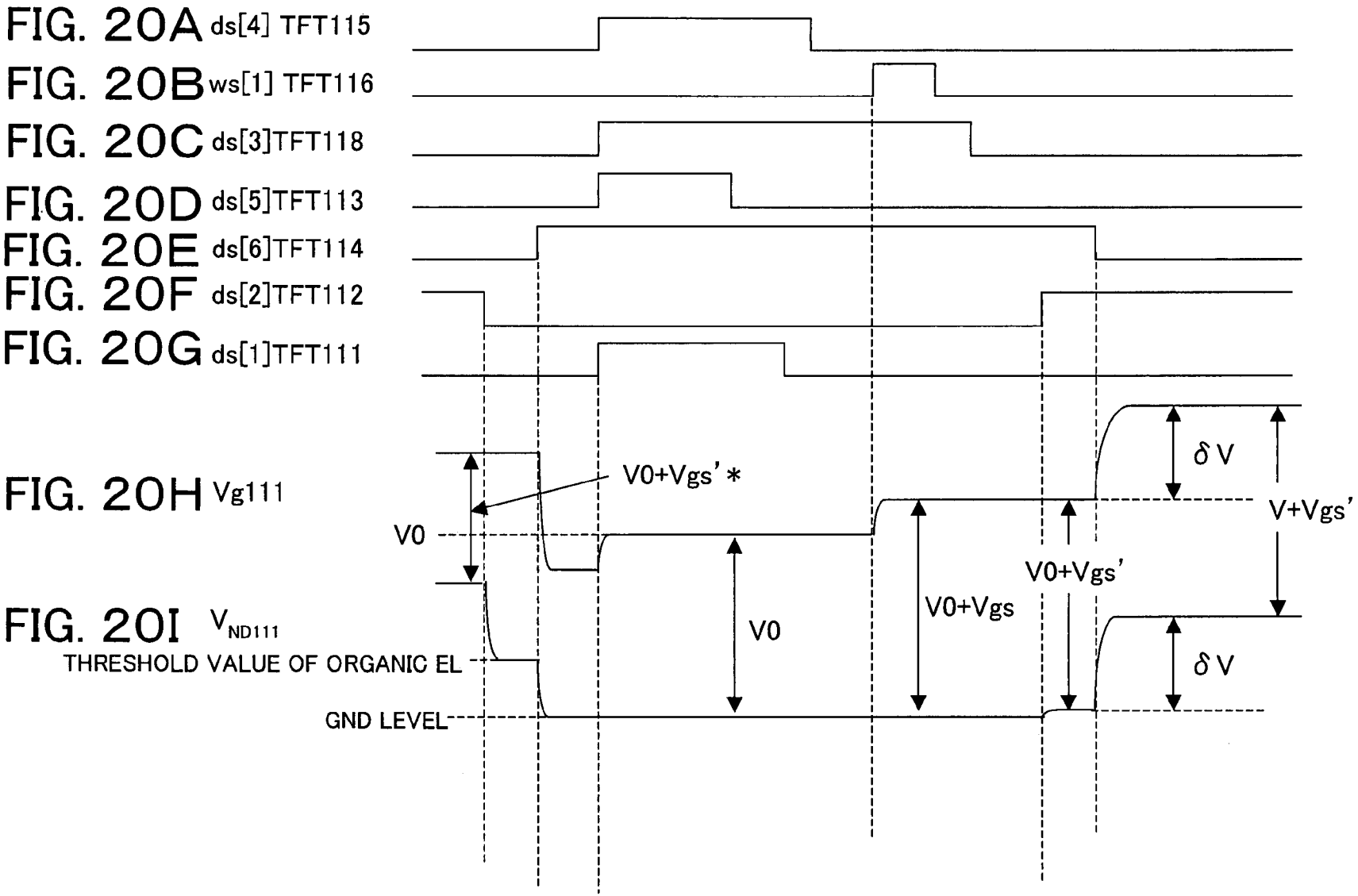
FIGS. 20A to 20I are timing charts for explaining the method of driving the circuit of FIG. 19.

FIG. 19 is a circuit diagram showing the specific configuration of a pixel circuit according to a second embodiment. Further, FIG. 20 is a timing chart of the circuit of FIG. 19.

The difference of the second embodiment from the first embodiment explained above resides in that the fourth switch constituted by the TFT 115 does not share the predetermined potential line to which the TFT 115 is connected together with the data line DTL, but is separately provided.

The rest of the configuration is the same as that of the first embodiment, so a detailed explanation concerning the configuration and function is omitted here.

In the second embodiment, when running the reference current Iref to the source of the driver transistor constituted by the TFT 111, the input voltage Vin is not input to the gate voltage of the TFT 111, but the fixed potential V0 is input. By inputting the fixed potential V0 and running the reference current Iref, the time during which the Vin is input into the pixel can be shortened, and the data can be written into the pixel at a high speed.

For this reason, it becomes possible to cope with a drive system dividing that 1 H into several parts and writing that data into the pixel as in a three-part write system.

Third Embodiment

Figure 21:
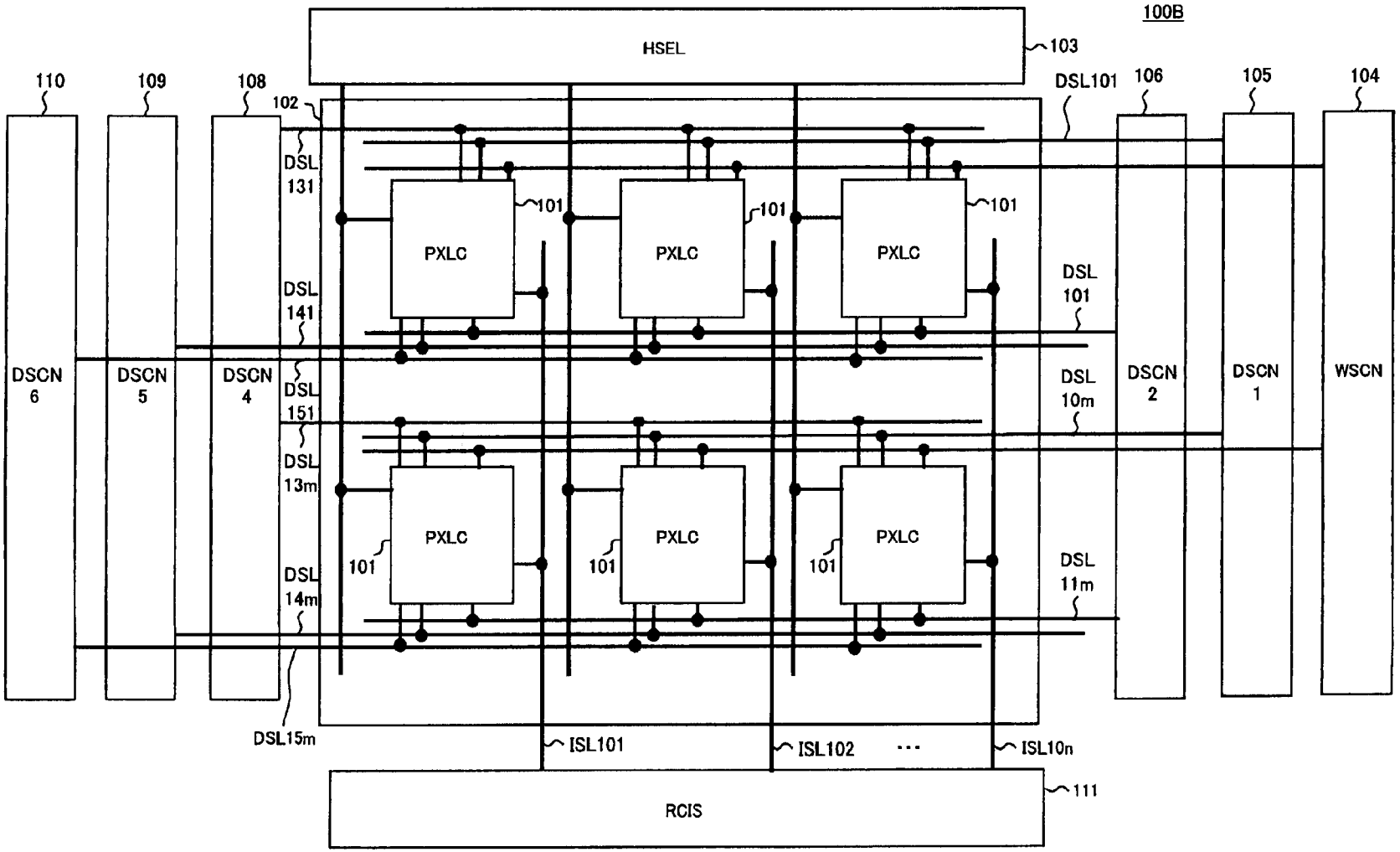
FIG. 21 is a block diagram showing the configuration of an organic EL display device employing a pixel circuit according to a third embodiment.

FIG. 21 is a block diagram showing the configuration of an organic EL display device employing a pixel circuit according to a third embodiment.

Figure 22:
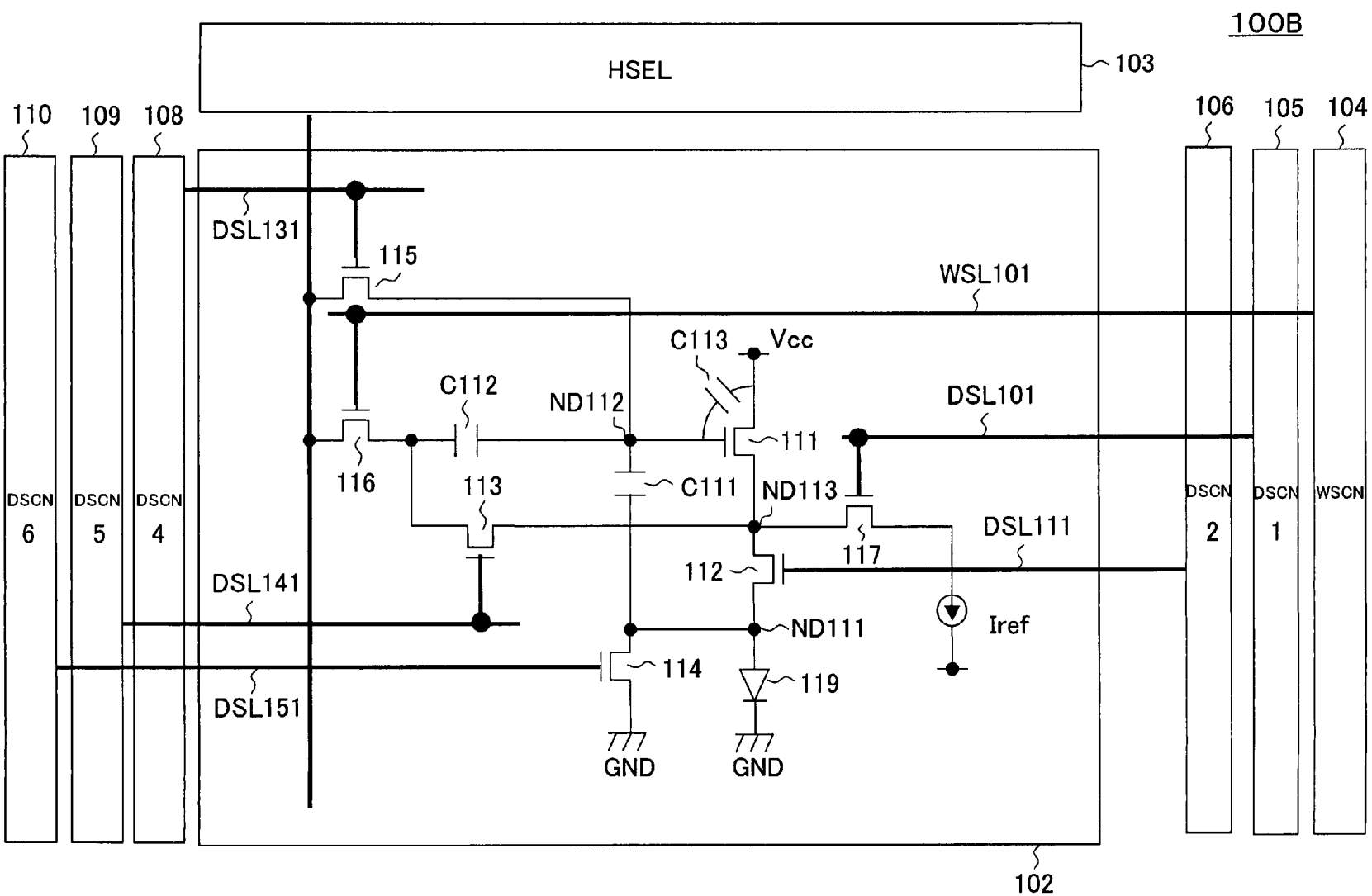
FIG. 22 is a circuit diagram showing a specific configuration of a pixel circuit according to a third embodiment in the organic EL display device of FIG. 21.
Figure 23:
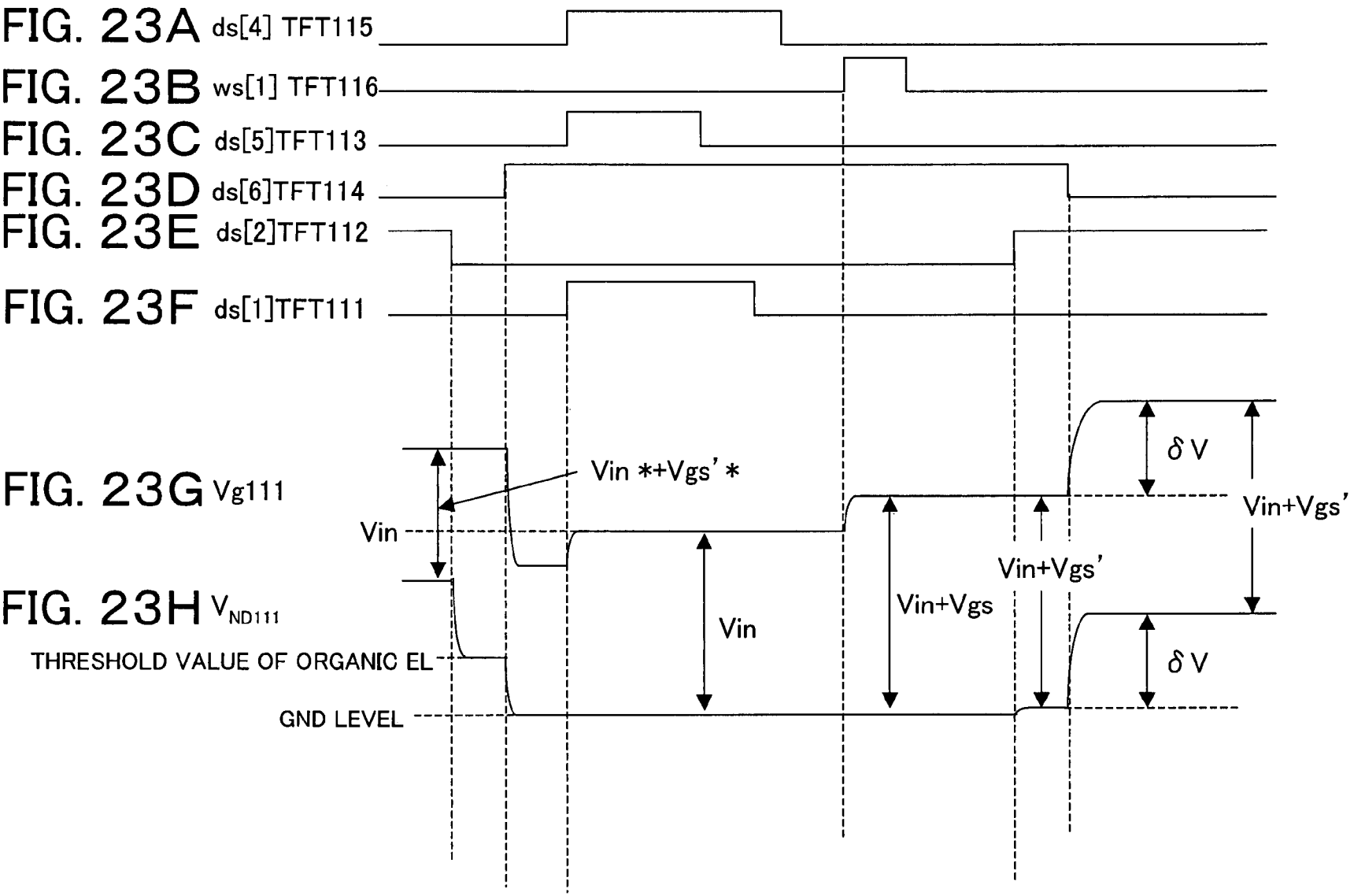
FIGS. 23A to 23H are timing charts for explaining the method of driving the circuit of FIG. 22.

FIG. 22 is a circuit diagram showing the specific configuration of a pixel circuit according to the third embodiment in the organic EL display device of FIG. 21. Further, FIGS. 23A to 23H are timing charts of the circuit of FIG. 22.

The difference of the third embodiment from the first embodiment resides in that, in place of the configuration in which the electric connecting means for connecting the first electrode of the capacitor C112 and the second node ND112 is configured by the switch 118 for selectively connecting the two, they are directly connected by an electric interconnect.

As a result, the third drive scanner 107 and the drive line DSL121 become unnecessary.

The rest of the configuration is the same as that of the second embodiment explained above.

According to the third embodiment, in addition to the effects of the first embodiment explained above, there are the advantages that the number of elements in the pixel circuit can be decreased, and the circuit configuration can be simplified.

Fourth Embodiment

Figure 24:
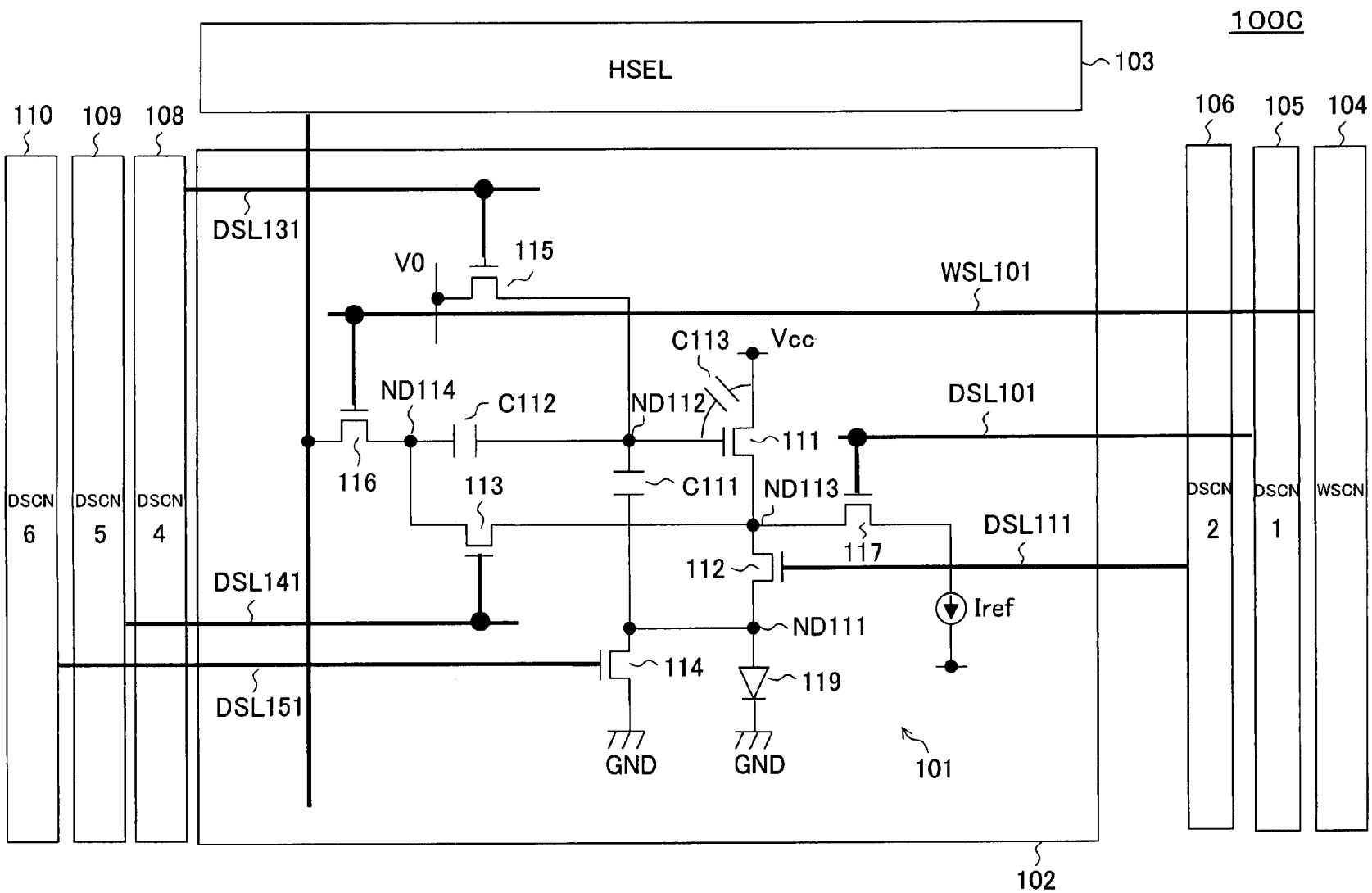
FIG. 24 is a circuit diagram showing a specific configuration of the pixel circuit according to a fourth embodiment.
Figure 25:
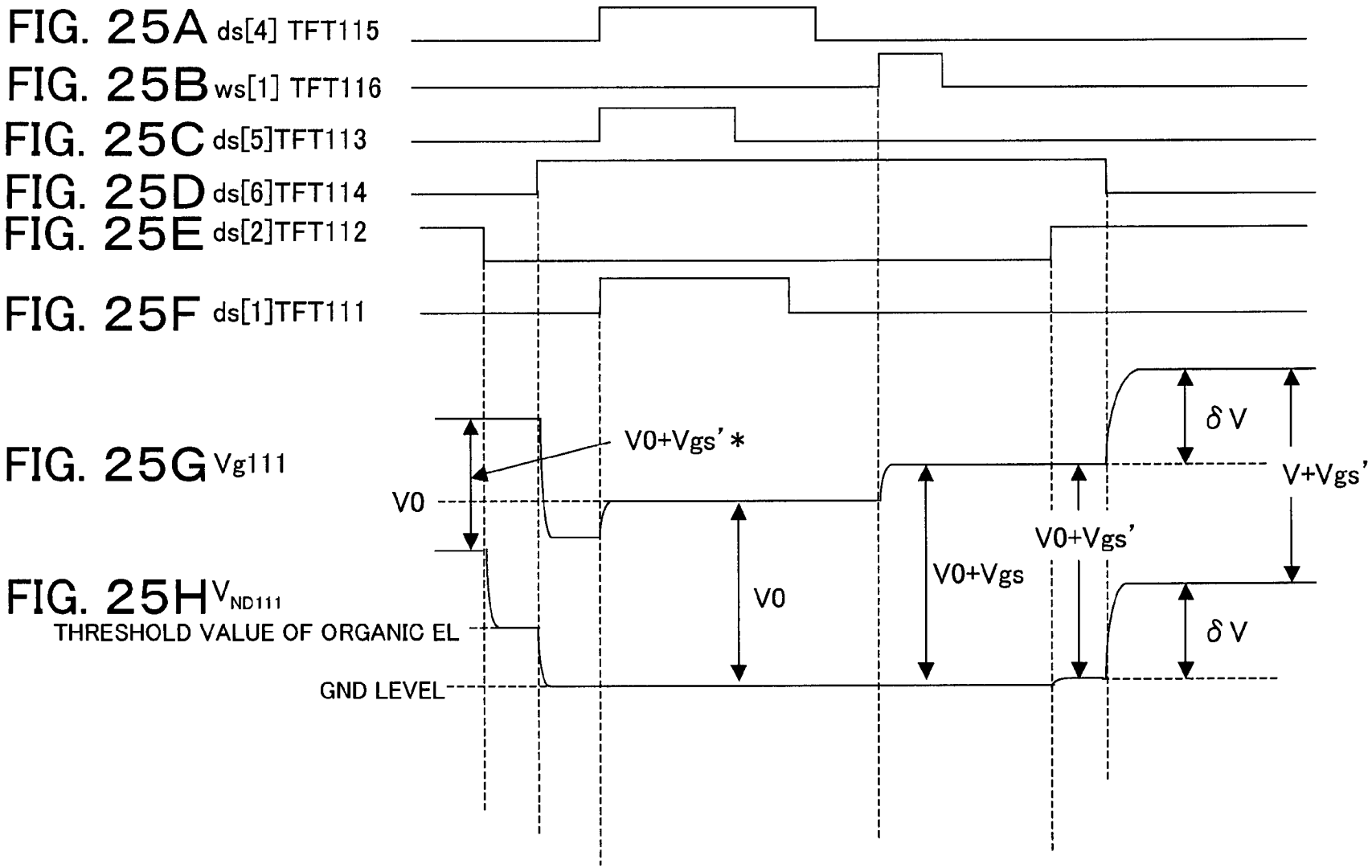
FIGS. 25A to 25H are timing charts for explaining the method of driving the circuit of FIG. 24.

FIG. 24 is a circuit diagram showing a specific configuration of the pixel circuit according to the fourth embodiment. Further, FIGS. 25A to 25H are timing charts of the circuit of FIG. 24.

The difference of the fourth embodiment from the third embodiment explained above resides in that the predetermined potential line to which the TFT 115 as the fourth switch is connected is not shared together with the data line DTL, but is separately provided.

The rest of the configuration is the same as that of the first embodiment, so a detailed explanation concerning the configuration and function is omitted here.

In the fourth embodiment, when running the reference current Iref to the source of the driver transistor constituted by the TFT 111, the input voltage Vin is not input to the gate voltage of the TFT 111, but the fixed potential V0 is input. By inputting the fixed potential V0 and running the reference current Iref, the time during which the Vin is input into the pixel can be shortened, and the data can be written into the pixel at a high speed.

For this reason, it becomes possible to cope with a drive system dividing that 1H into several parts and writing that data into the pixel as in a three-part write system.

Fifth Embodiment and Sixth Embodiment

Figure 26:
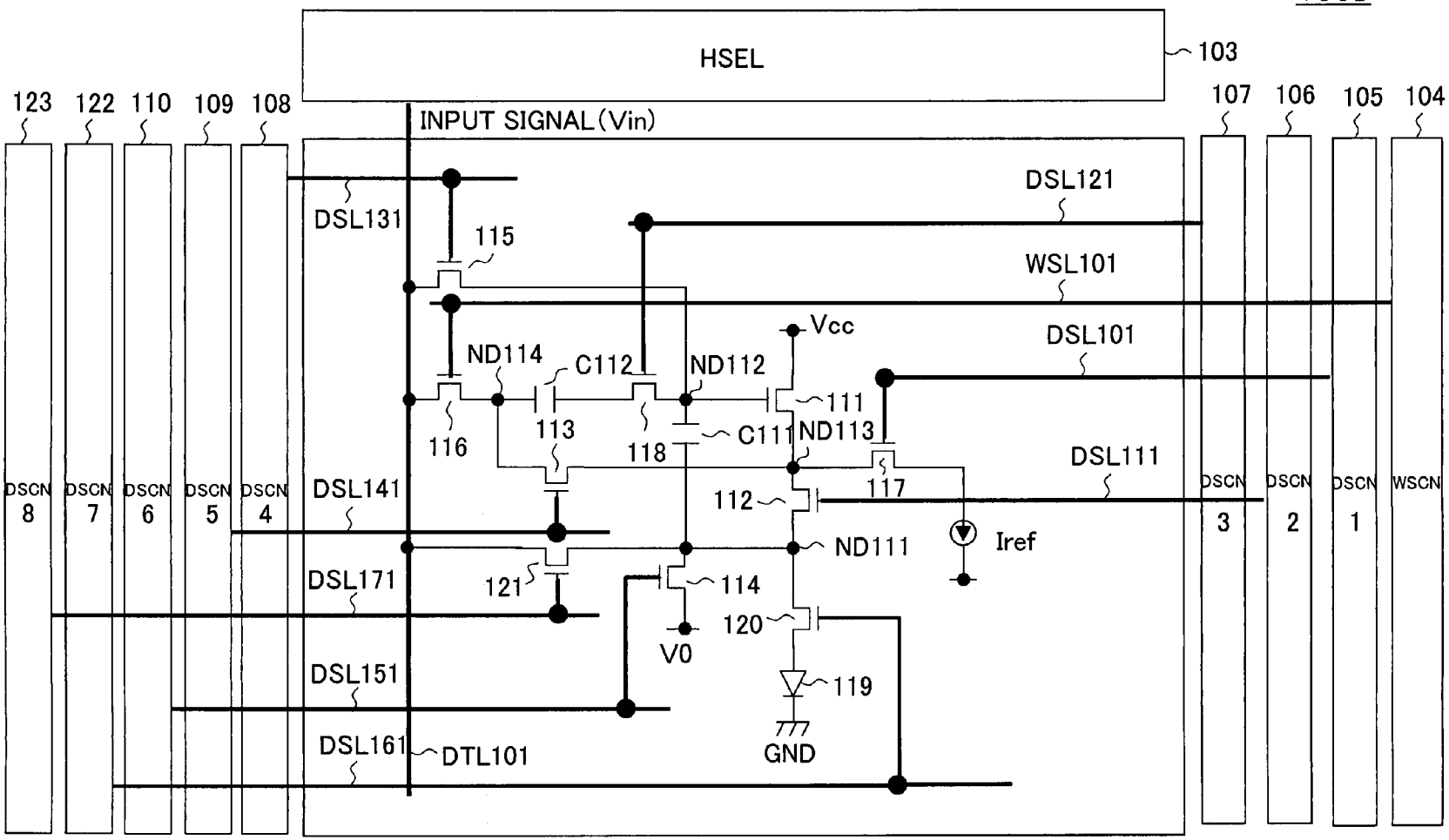
FIG. 26 is a circuit diagram showing a specific configuration of the pixel circuit according to a fifth embodiment.
Figure 27:
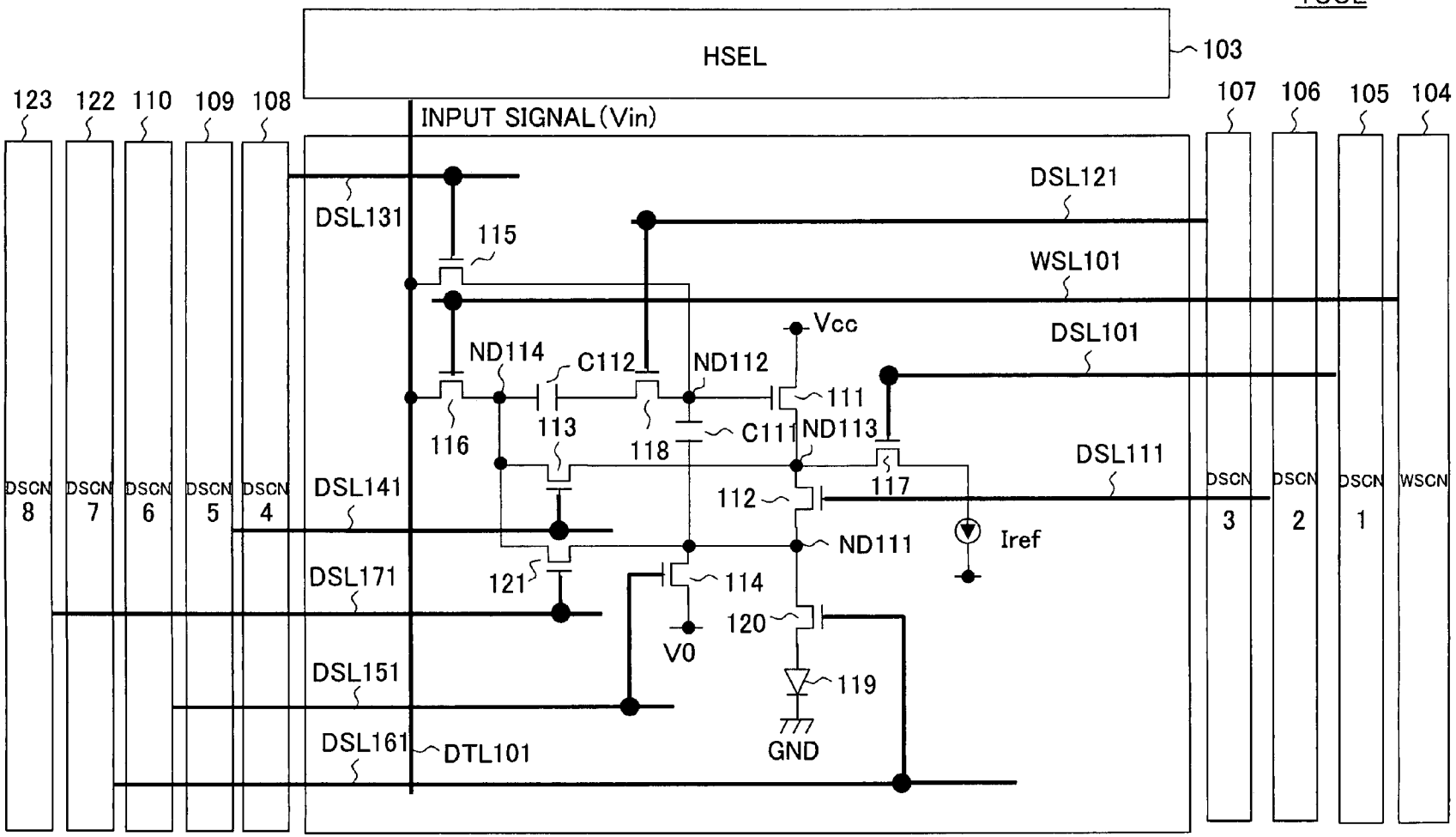
FIG. 27 is a circuit diagram showing a specific configuration of the pixel circuit according to a sixth embodiment.

FIG. 26 is a circuit diagram showing the specific configuration of a pixel circuit according to a fifth embodiment. Further, FIG. 27 is a circuit diagram showing a specific configuration of the pixel circuit according to a sixth embodiment.

The difference of the fifth embodiment from the first embodiment explained above resides in that an eighth switch constituted by a TFT 120 is inserted between the first node ND111 and the anode of the light emitting element 119, the first node ND111 and the data line DTL101 are connected by a ninth switch constituted by a TFT 121, and the source of the TFT 114 is connected to the fixed potential V0.

A gate of the TFT 120 is connected to drive lines DSL161 (to 16m) driven by a seventh drive scanner (DSCN7) 122, and a gate of the TFT 121 is connected to drive lines DSL171 (to 17m) driven by an eighth drive scanner (DSCN8) 123.

Further, the difference of the sixth embodiment from the fifth embodiment resides in that the first node ND111 is selectively connected to the fourth node ND114 in place of selectively connecting the first node ND111 to the data line DTL101 by the TFT 121.

Basically, the same operation is carried out in the fifth and sixth embodiments.

FIGS. 28A to 28K and FIGS. 29A to 29K show timing charts of examples of those operations.

Figures 29A, 29B, 29C, 29D, 29E, 29F, 29G, 29H, 29I, 29J, 29K:
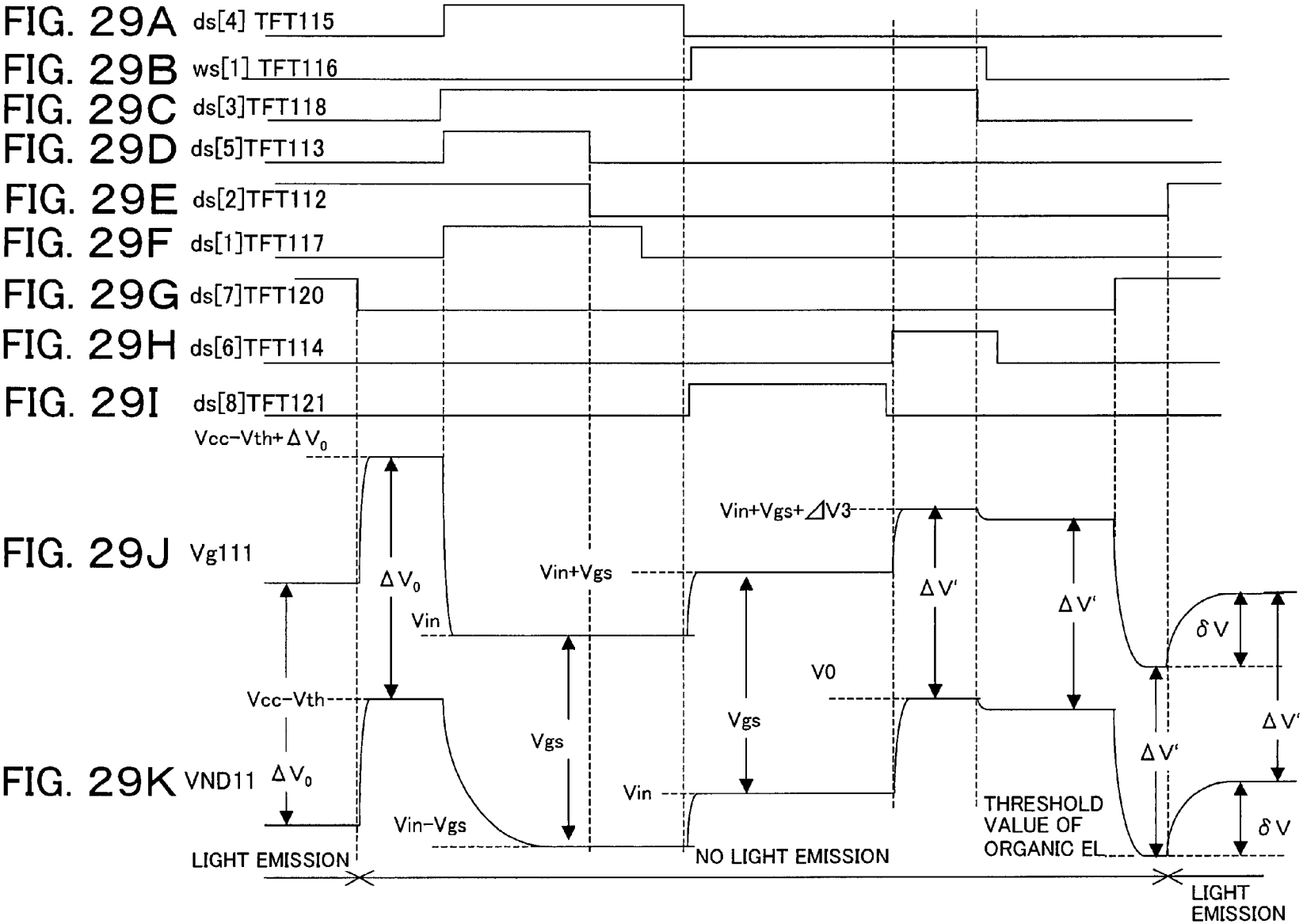
FIGS. 29A to 29K are timing charts of the circuit of FIG. 27.

Note that FIG. 28A and FIG. 29A show the drive signal ds[4] applied to the drive line DSL131 of the first row in the pixel alignment, FIG. 28B and FIG. 29B show the scanning signal ws[1] applied to the scanning line WSL101 of the first row in the pixel alignment, FIG. 28C and FIG. 29C show the drive signal ds[3] applied to the drive line DSL121 of the first row in the pixel alignment, FIG. 28D and FIG. 29D show the drive signal ds[5] applied to the drive line DSL141 of the first row in the pixel alignment, FIG. 28E and FIG. 29E show the drive signal ds[2] applied to the drive line DSL111 of the first row in the pixel alignment, FIG. 28F and FIG. 29F show the drive signal ds[1] applied to the drive line DSL101 of the first row in the pixel alignment, FIG. 28G and FIG. 29G show the drive signal ds[7] applied to the drive line DSL161 of the first row in the pixel alignment, FIG. 28H and FIG. 29H show the drive signal ds[6] applied to the drive line DSL141 of the first row in the pixel alignment, FIG. 28I and FIG. 29I show the drive signal ds[8] applied to the drive line DSL171 of the first row in the pixel alignment, FIG. 28J and FIG. 29J show the gate potential Vg111 of the TFT 111 as the drive transistor, and FIG. 28K and FIG. 29K show the potential VND111 of the first node ND111.

Below, the operation of the circuit of FIG. 26 will be explained with reference to FIGS. 30A and 30B, FIGS. 31A and 31B, FIGS. 32A and 32B, and FIGS. 33A and 33B.

Figure 30B:
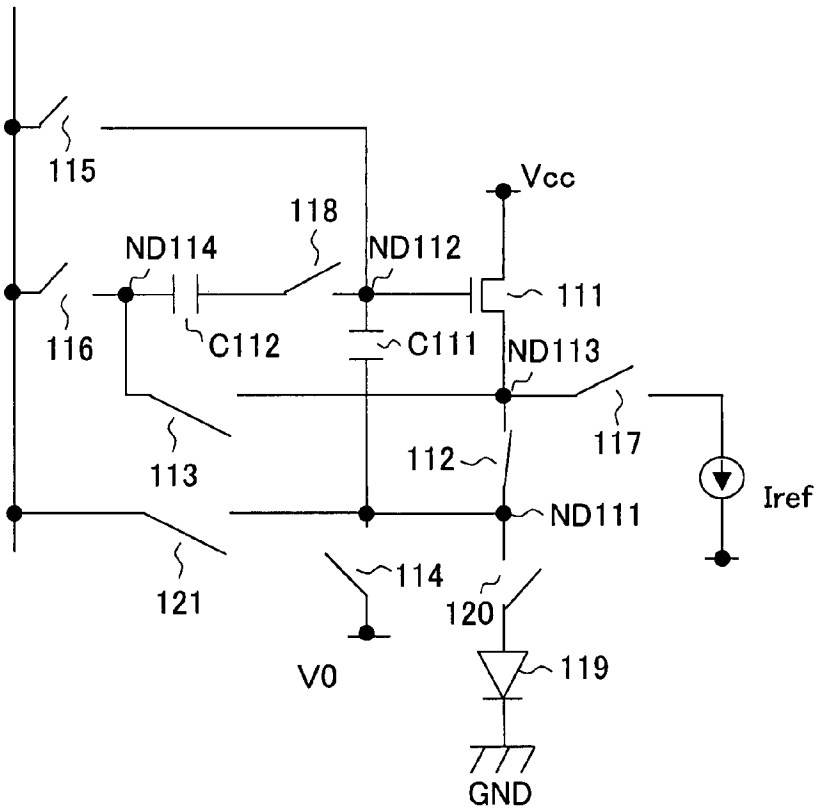
FIGS. 30A and 30B are diagrams for explaining the operation of the circuit of FIG. 26.
Figure 30A:
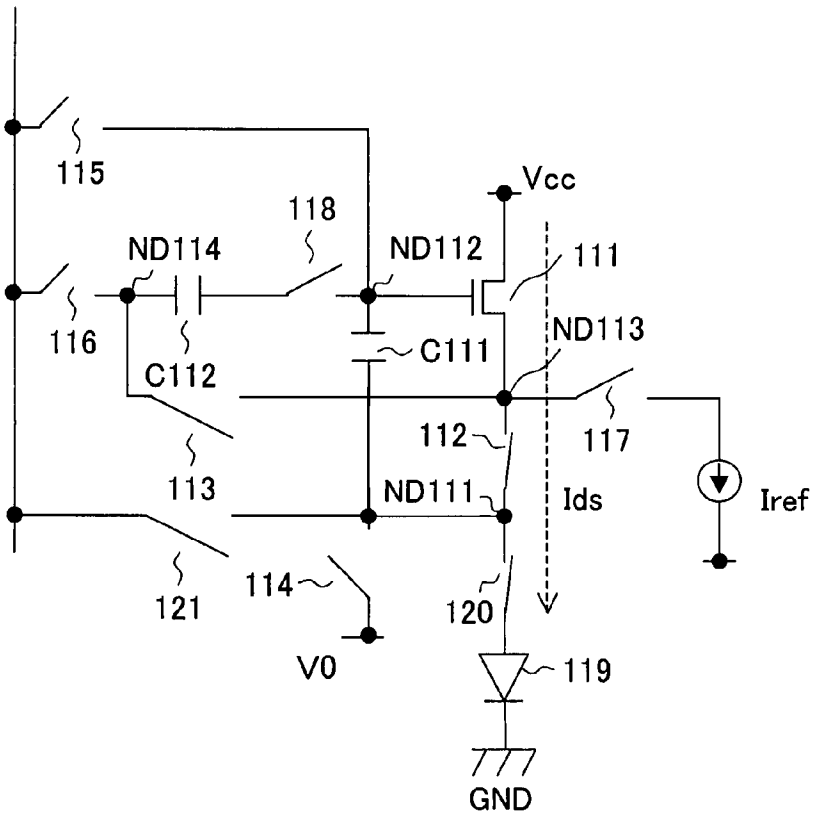

First, the light emission state of the ordinary EL light emitting element 119 is the state where the TFT 112 and the TFT 120 become ON as shown in FIG. 30A.

Next, in the non-light emission period of the EL light emitting element 119, as shown in FIG. 30B, the TFT 120 is turned off while turning on the TFT 112 as it is.

At this time, a current is no longer supplied to the EL light emitting element 119, so it no longer emits the light.

Figure 31B:
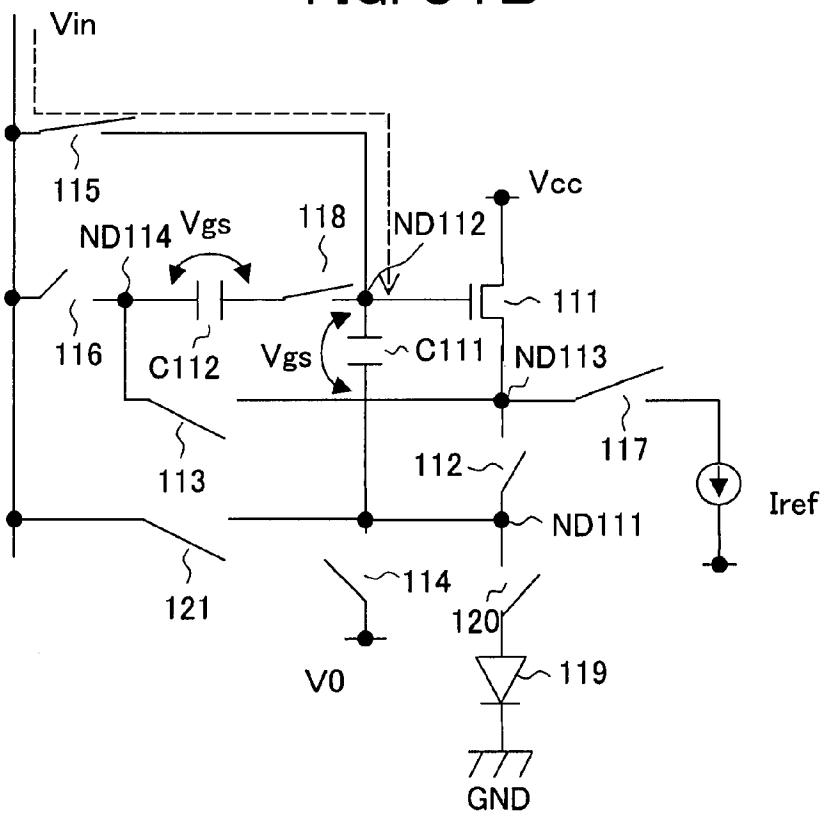
FIGS. 31A and 31B are diagrams for explaining the operation of the circuit of FIG. 26.
Figure 31A:
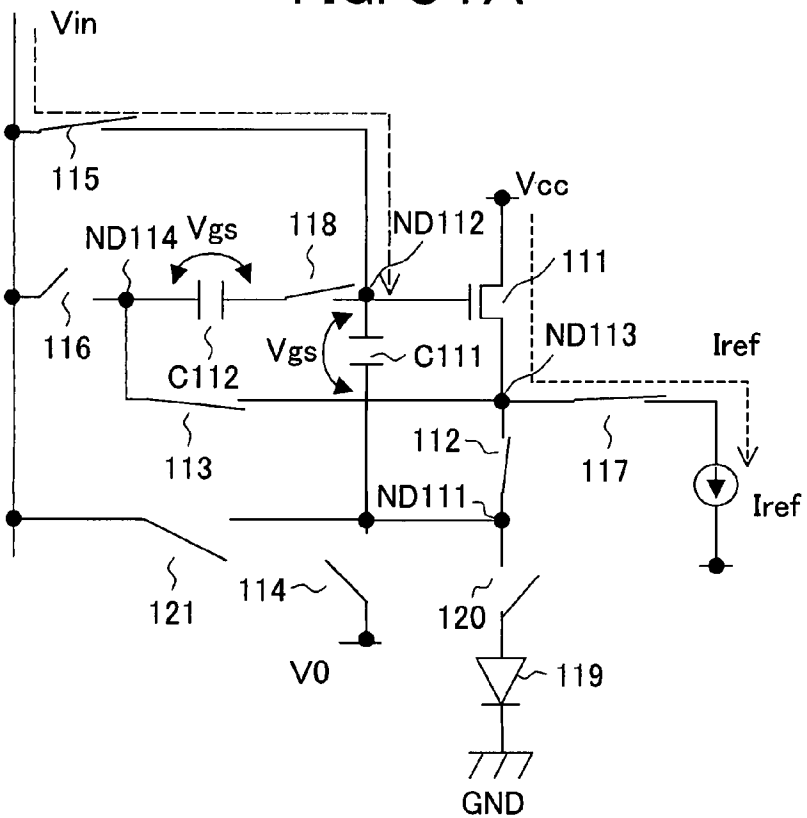

Next, as shown in FIG. 31A, the TFT 115, TFT 118, TFT 113 and TFT 117 are turned on and the input voltage (Vin) is input to the gate of the drive transistor constituted by the TFT 111. By running the current Iref from the current source, the gate/source voltage Vgs of the drive transistor is charged in the capacitors C111 and C112. At this time, the TFT 114 operates in the saturated region, therefore Vgs becomes a term including μ and Vth as shown in Equation 3.

(Equation 3)

$$Vgs=Vth+[2I/(\mu(W/L)Cox]^{1/2} \quad (3)$$

After Vgs is charged in the capacitors C111 and C112, the TFT 113 and TFT 112 are turned off. Due to this, the voltages charged in the capacitors C111 and C112 are set to Vgs.

Thereafter, as shown in FIG. 31B, by turning off the TFT 117 and suspending the supply of the current, the source potential of the TFT 111 rises up to Vin−Vth.

Figure 32B:
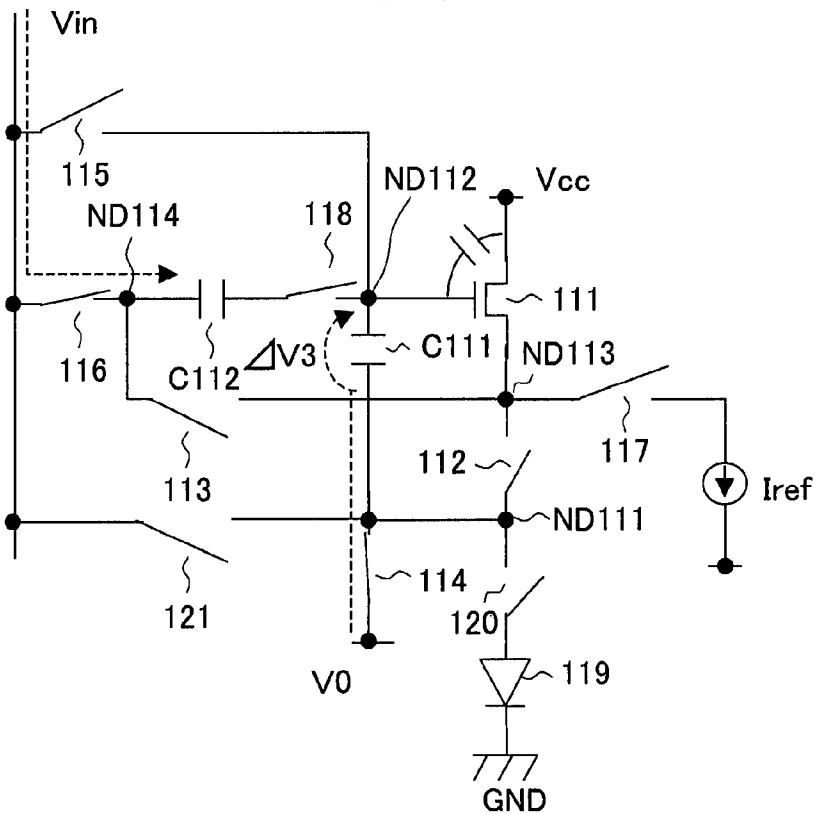
FIGS. 32A and 32B are diagrams for explaining the operation of the circuit of FIG. 26.
Figure 32A:
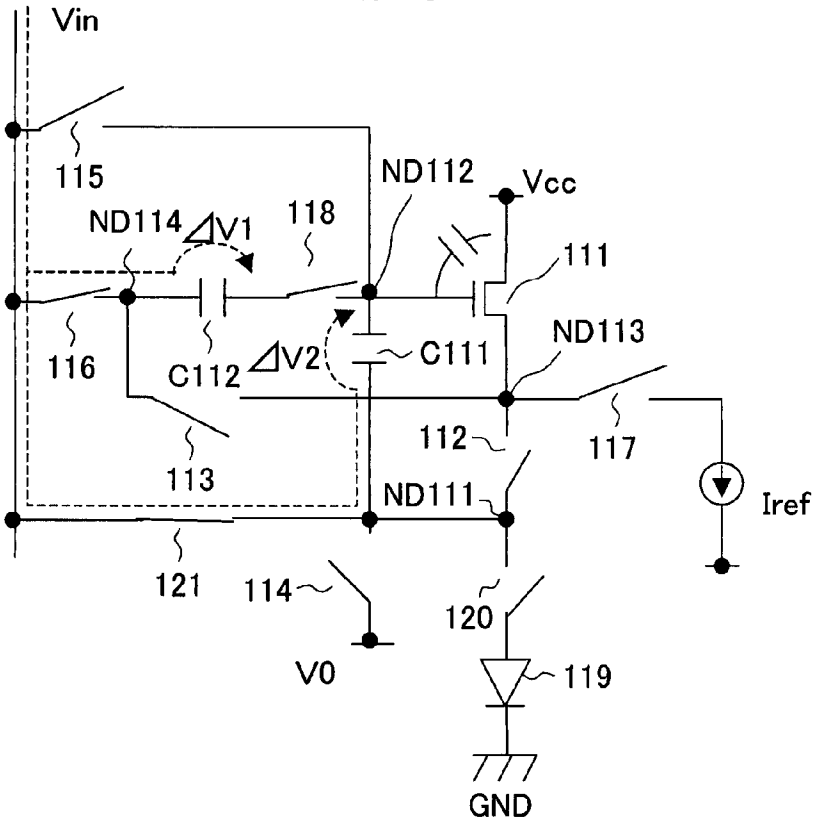

Further, as shown in FIG. 32A, the TFT 115 is turned off and the TFT 116 and TFT 121 are turned on.

By turning on the TFT 116 and TFT 121, Vin is passed through the capacitors C111 and C112 and the voltage ΔV is coupled with the gate of the drive transistor constituted by the TFT 111. This coupling amount ΔV is determined according to the voltage change (Vgs) of a point A and a point B in the figure and a ratio of a sum of capacitances C1 and C2 of the capacitors C111 and C112 and the parasitic capacitance C3 of the TFT 111 (Equation 4). When the sum of C1 and C2 is made larger than C3, almost all of the change is coupled with the gate of the TFT 111, and the gate potential of the TFT 111 becomes Vin+Vgs.

(Equation 4)

$$\Delta V=\Delta V_1+\Delta V_2=\{(C1+C2)/(C1+C2+C3)\}\cdot Vgs \quad (4)$$

After the writing ends, as shown in FIG. 32B, the TFT 121 is turned off and the TFT 114 is turned on.

The TFT 114 is connected to a fixed potential such as V0. By turning on it, the voltage change (V0−Vin) of the node ND112 is coupled with the gate of the TFT 111 through the capacitor C111 again. This coupling amount $\Delta V_3$ is determined according to voltage change of the node ND112 and the ratio of the sum of C1 and C3 and C2 (Equation 5). When defining this ratio as α, the gate potential of the TFT 111 becomes (1−α)Vin+Vgs+αV0, and the voltage held in the capacitor C111 rises from Vgs by exactly (1−α) (Vin−V0).

(Equation 5)

$$\Delta V=\{C1/(C1+C2+C3)\}\cdot(V_0-V_{in})=\alpha \quad (5)$$

Figure 33B:
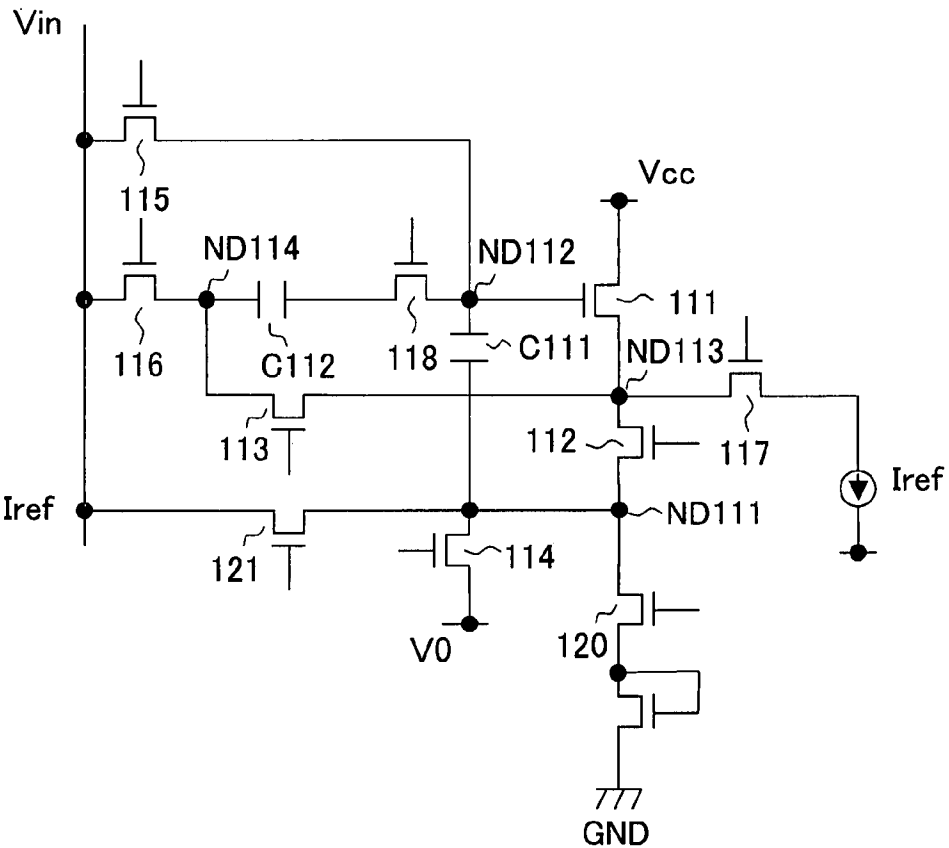
FIGS. 33A and 33B are diagrams for explaining the operation of the circuit of FIG. 26.
Figure 33A:
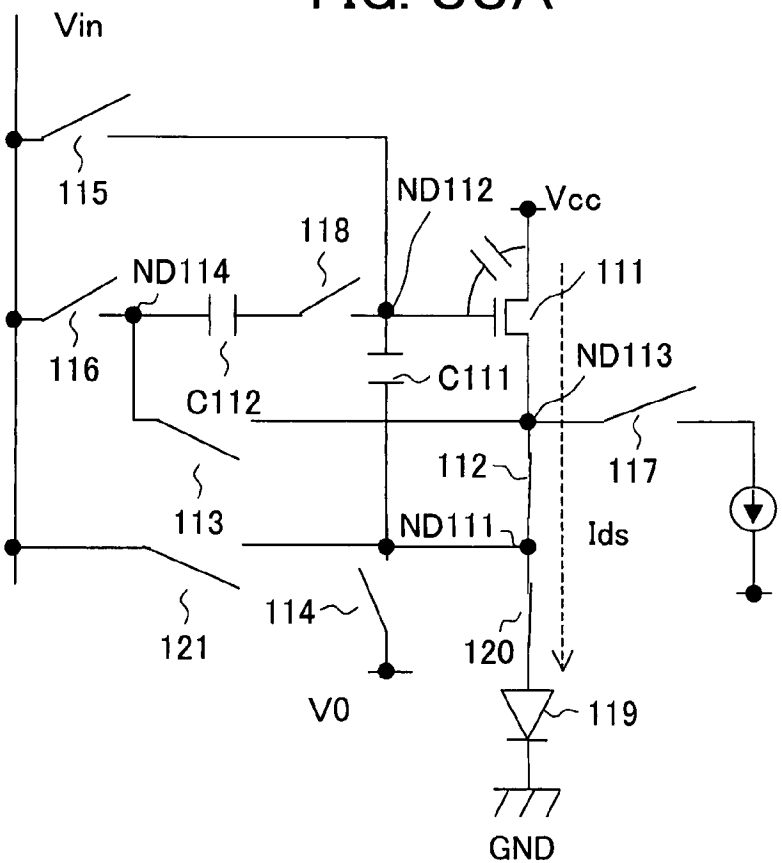

Thereafter, as shown in FIG. 33A, the TFT 116 and TFT 118 are turned off, the TFT 112 and TFT 120 are turned on, and the TFT 114 is turned off. Due to this, the source potential of the TFT 111 once becomes the V0 level, then current starts to flow in the EL light emitting element 119. Irrespective of the fact that the source potential of the TFT 111 fluctuates, the capacitor C111 exists between the gate and the source. By making the capacitance C1 of the capacitor C111 larger than the parasitic capacitance C3, the gate/source potential is constantly held at a constant value.

At this time, the TFT 111 is driven in the saturated region, therefore the value of current Ids flowing in the TFT 111 becomes the value indicated by Equation 1 and is determined by the gate/source voltage. This Ids flows also in the EL light emitting element 119 in the same way, and the EL light emitting element 119 emits light.

The equivalent circuit of the element becomes as shown in FIG. 33B, therefore the source voltage of the TFT 111 rises up to the gate potential for running the current Ids through the EL light emitting element 119. Along with this potential rise, the gate potential of the TFT 111 rises in the same way via the capacitor C111. Due to this, the gate/source voltage is held constant as previously explained, the EL light emitting element 119 is deteriorated by aging, therefore even when the source potential of the TFT 111 changes, the gate/source voltage is constant as it is, and the value of current flowing in the EL light emitting element 119 will not change.

Here, the capacitances C1 and C2 of the capacitors C111 and C112 will be considered.

First, the sum of C1 and C2 must be set to C1+C2>>C3. By making the sum much larger than C3, all of the potential change of the nodes ND111 and ND112 can be coupled with the gate of the TFT 111.

Figure 34:
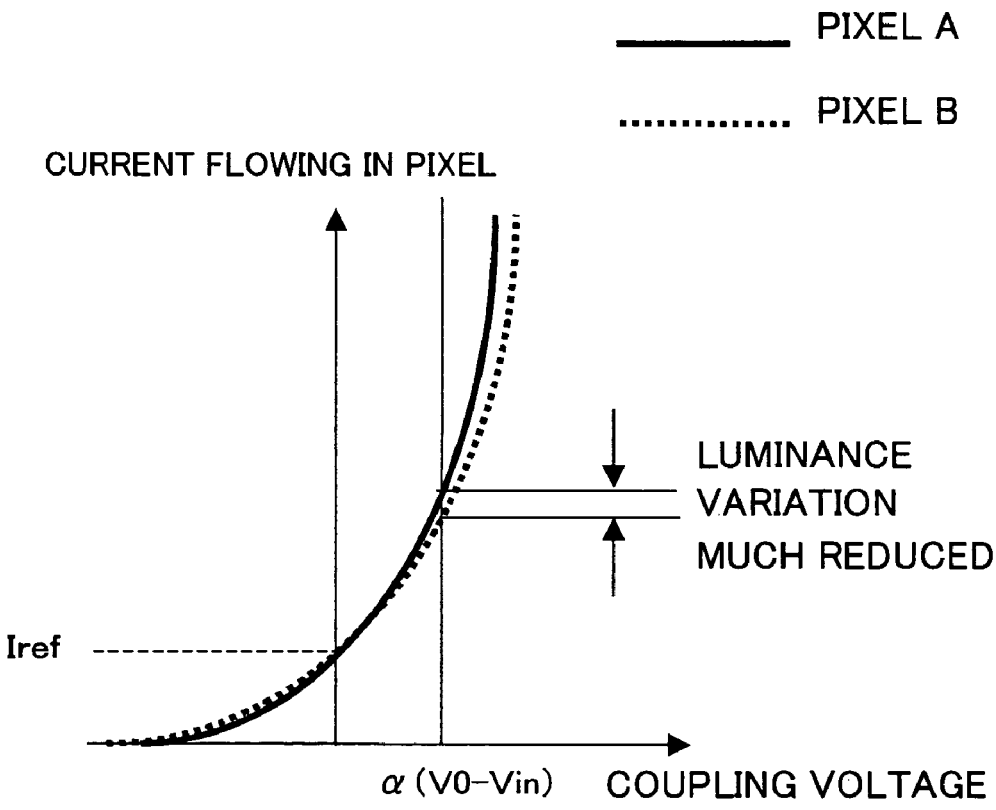
FIG. 34 is a diagram for explaining the reason why the reference current is supplied to the source of the drive transistor in the circuit of FIG. 26.

At this time, the value of current flowing through the TFT 111 becomes the value shown by Equation 1, the gate/source voltage of the TFT 111 becomes larger than the voltage flowing through the Iref by exactly a constant value such as α(V0−Vin) as in FIG. 34, and even in pixels A and B having different mobilities, the variation of Ids can be suppressed to small, therefore the variation of the uniformity can be suppressed.

Figure 35:
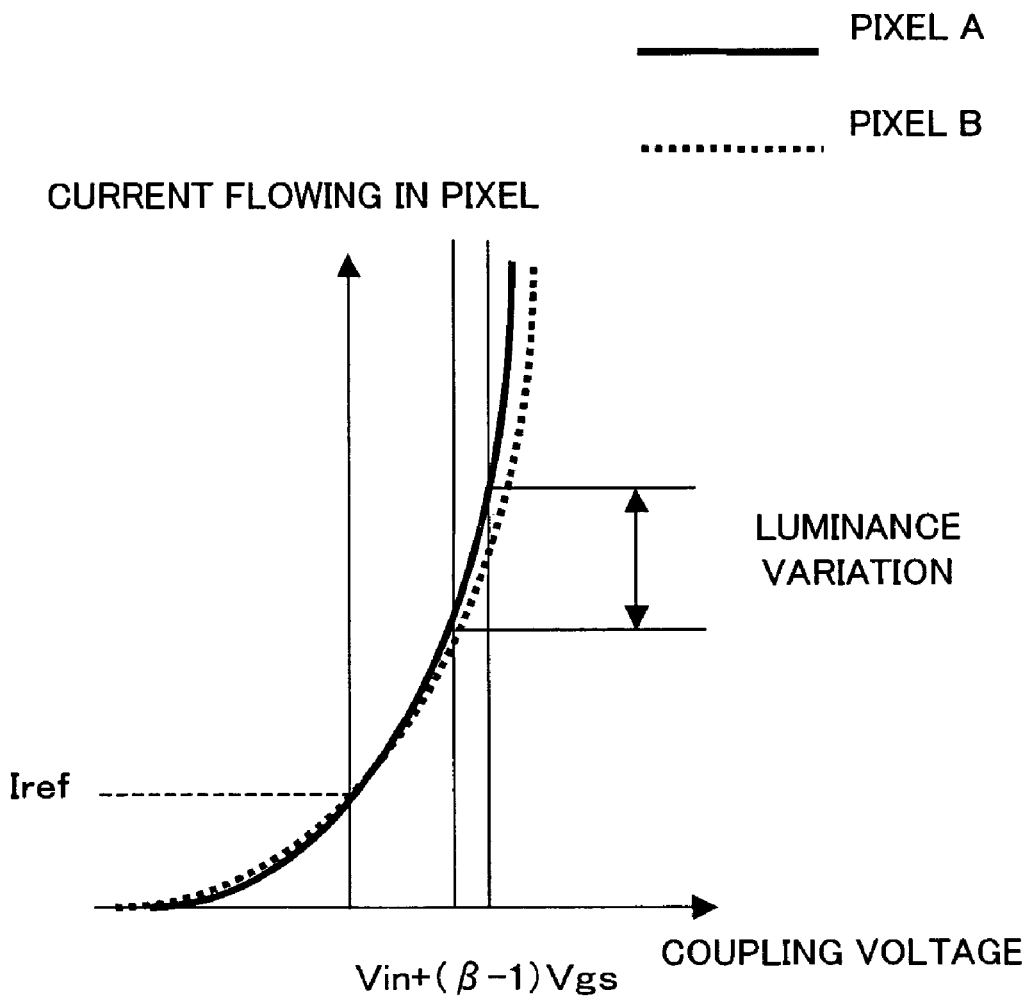
FIG. 35 is a diagram for explaining the reason why the reference current is supplied to the source of the drive transistor in the circuit of FIG. 26.

However, when C1+C2 is made small, all of the voltage change of the nodes ND111 and ND112 is not coupled, but a gain ends up occurring. When this gain is defined as the amount of current flowing in the TFT 111 is represented by Equation 6, and the gate/source voltage of T10 becomes larger than the voltage for sending Iref by exactly a value such as Vin+(β−1)Vgs, but Vgs has a different value for each pixel, therefore it becomes unable to keep variation of the Ids small (FIG. 35). Due to this, C1+C2 must be made larger than C3.

(Equation 6)

$$\Delta V=\{C1/(C1+C2+C3)\}\cdot V_{gs} \quad (6)$$

Next, the magnitude of C1 will be considered. C1 must be much larger than the parasitic capacitance C3. If C1 is at the same level as C3, the fluctuation of the source potential of the TFT 114 is coupled with the gate of the TFT 114 through the capacitor C111, and the voltage held in the capacitor C111 fluctuates. For this reason, the TFT 111 becomes unable to carry a constant amount of current, and variation occurs for each pixel. Due to this, C1 must be made very large in comparison with the parasitic capacitance C3 of the TFT 111.

Further, C2 will be considered. Assuming that C2>>C1, when turning on the TFT 114 and coupling the voltage change such as V0−Vin with the gate of the TFT 111 through the capacitor C111, the potential difference held in the capacitor C111 increases from the potential such as Vgs held by running Iref through the TFT 111 by exactly a constant value such as Vin−V0, therefore, even in the pixels A and B having different mobilities, the variation of Ids can be kept small, and variation of the uniformity can be suppressed.

However, assuming that C2>>C1, the variation of Ids cannot be kept small, and also variation of the uniformity cannot be suppressed.

Next, if C2<<C1, when turning on the TFT 114, the voltage change such as V0−Vin is completely coupled with the gate of the TFT 111 through the capacitor C111, therefore the voltage held in the capacitor C111 does not change at all from Vgs. Due to this, the EL light emitting element 119, irrespective of the input voltage, can only carry a constant current such as Iref, therefore the pixel can only perform raster display.

Due to the above, it is necessary to set the magnitudes of C1 and C2 at the same level and impart a constant gain in the coupling by turning on the TFT 114.

Here, as previously explained, C3 is the parasitic capacitance of the TFT 114, and the magnitude thereof is an order of several tens to several hundreds of fF, but the relationships of C1, C2, and C3 are C2>>C3 and C1>>C3, and C1 and C2 must be the same level, therefore C1 and C2 may have magnitudes of from several hundreds fF to several pF. Due to this, the capacitance can be easily set in a limited magnitude inside the pixel, and also the conventional problems of the current value varying for each pixel and unevenness of pixels occurring can be overcome.

Seventh Embodiment and Eighth Embodiment

Figure 36:
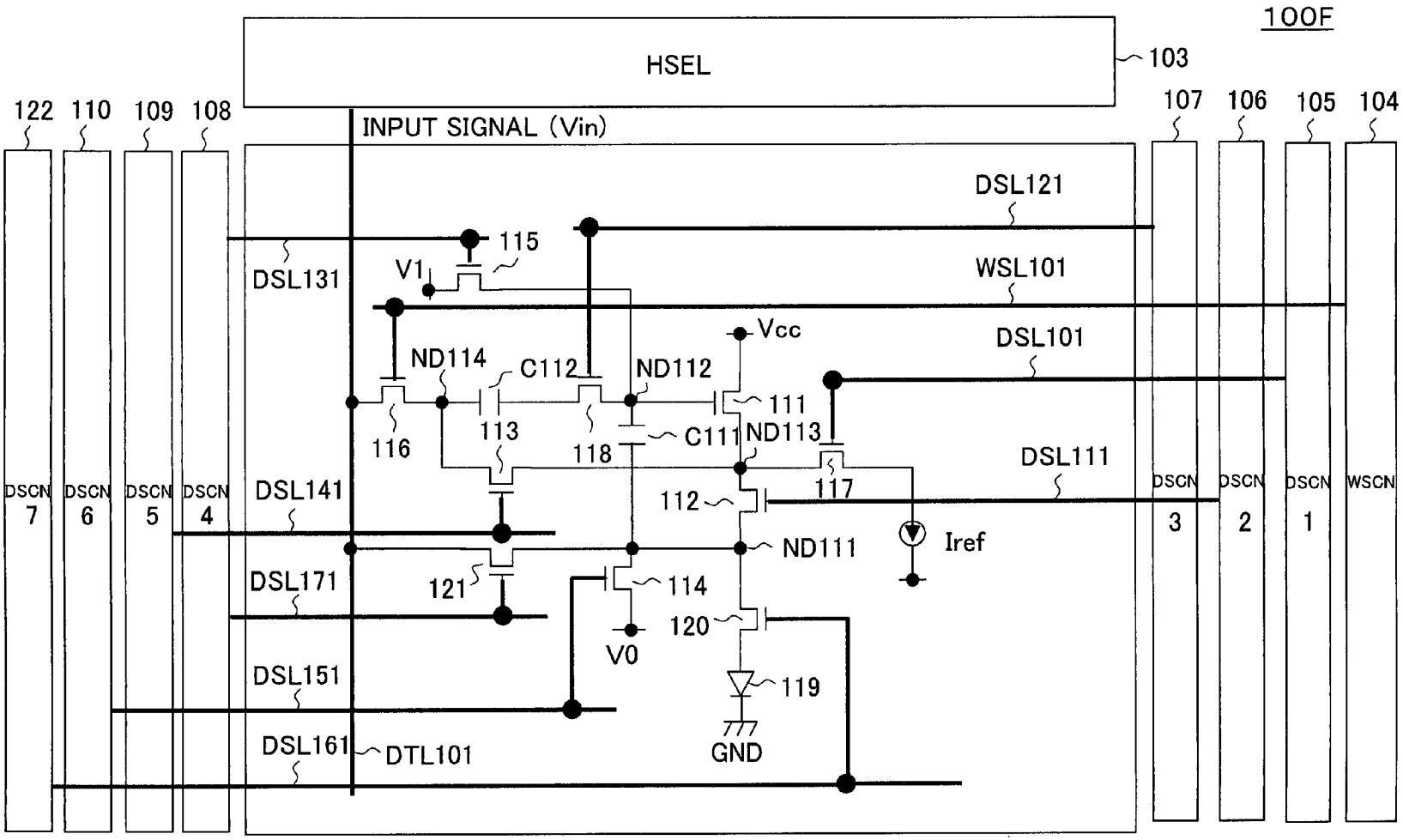
FIG. 36 is a circuit diagram showing a specific configuration of the pixel circuit according to a seventh embodiment.
Figure 37:
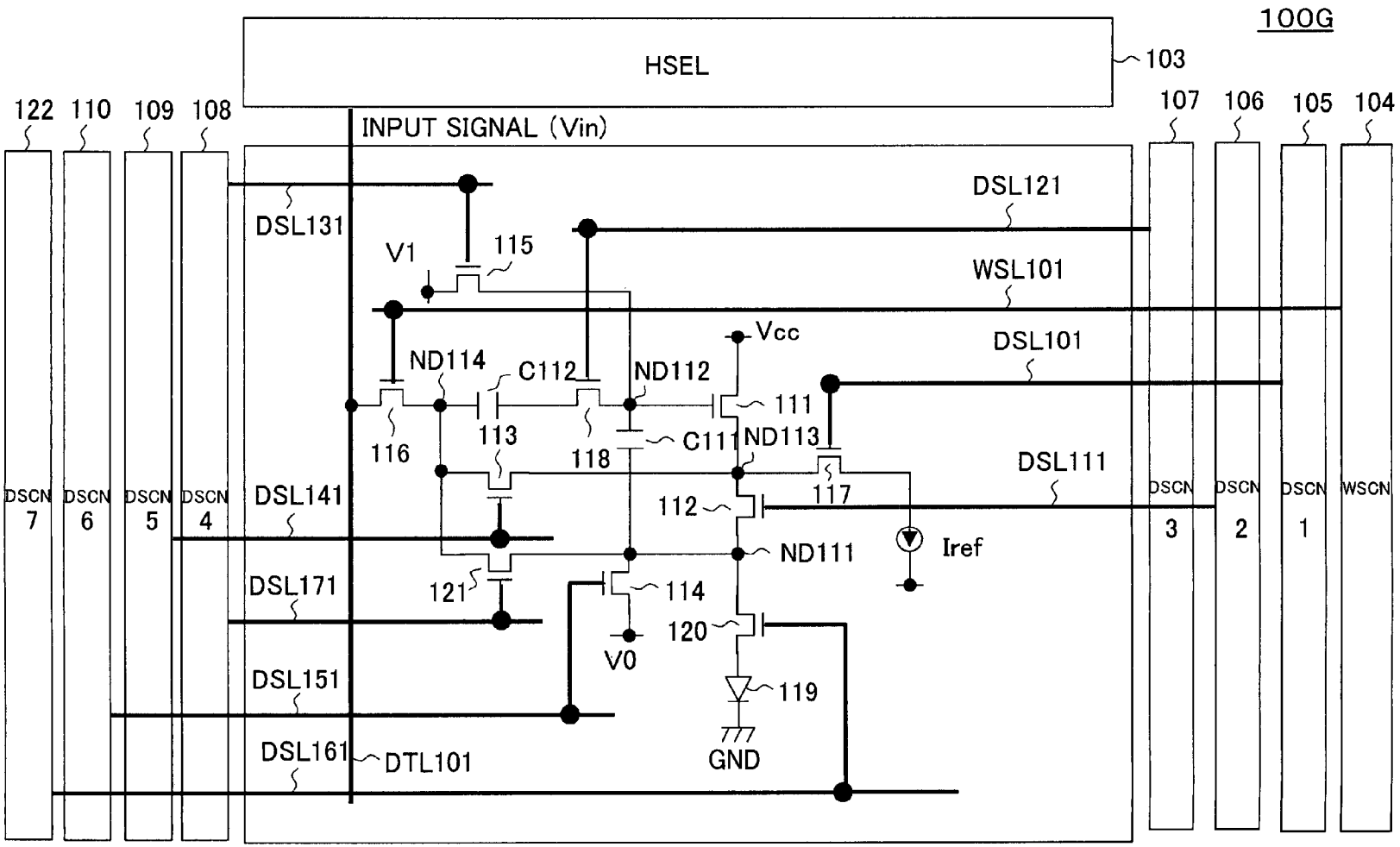
FIG. 37 is a circuit diagram showing a specific configuration of the pixel circuit according to an eighth embodiment.
Figure 38:
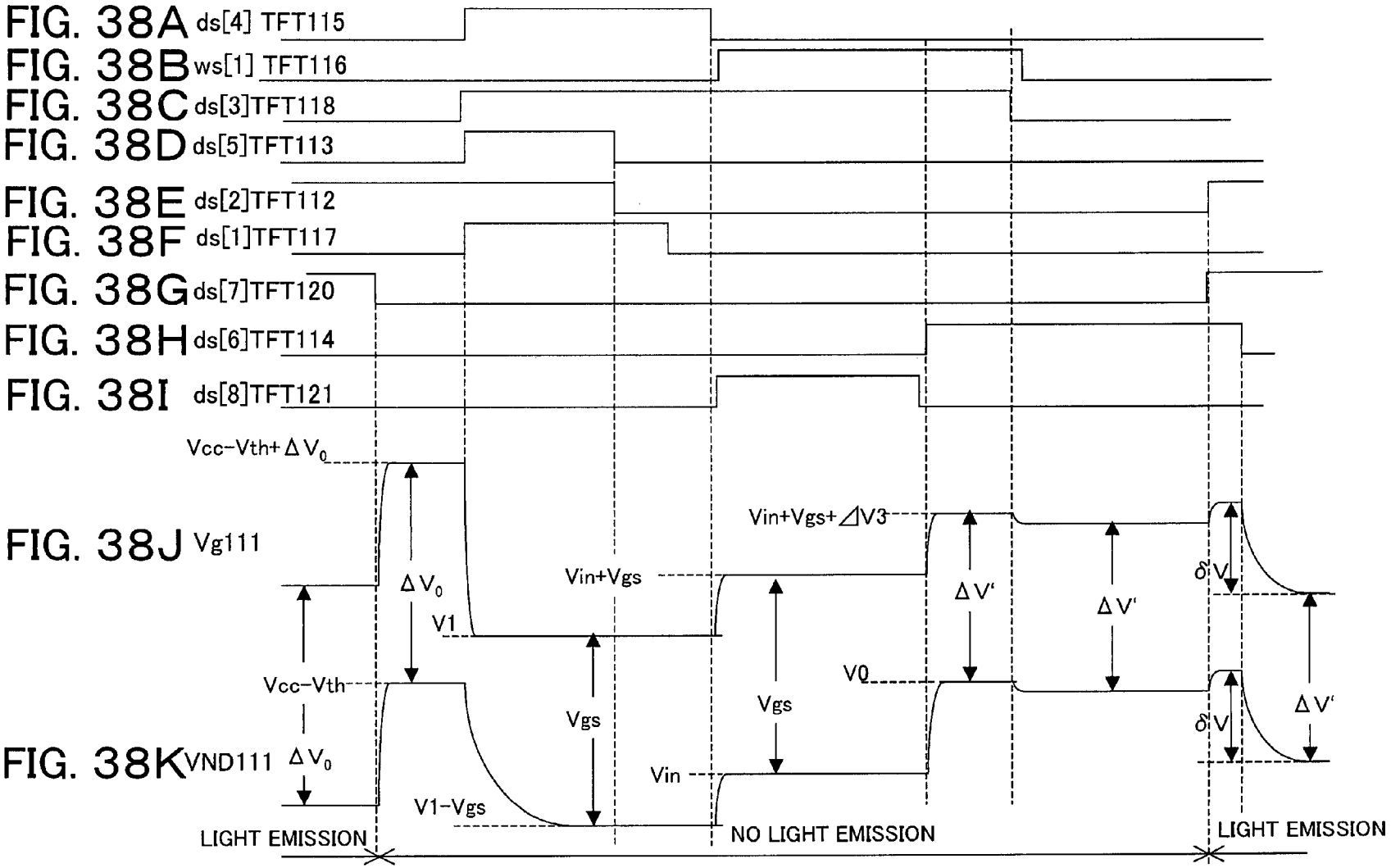
FIGS. 38A to 38K are timing charts for explaining the operation of the circuit of FIG. 36.
Figure 39:
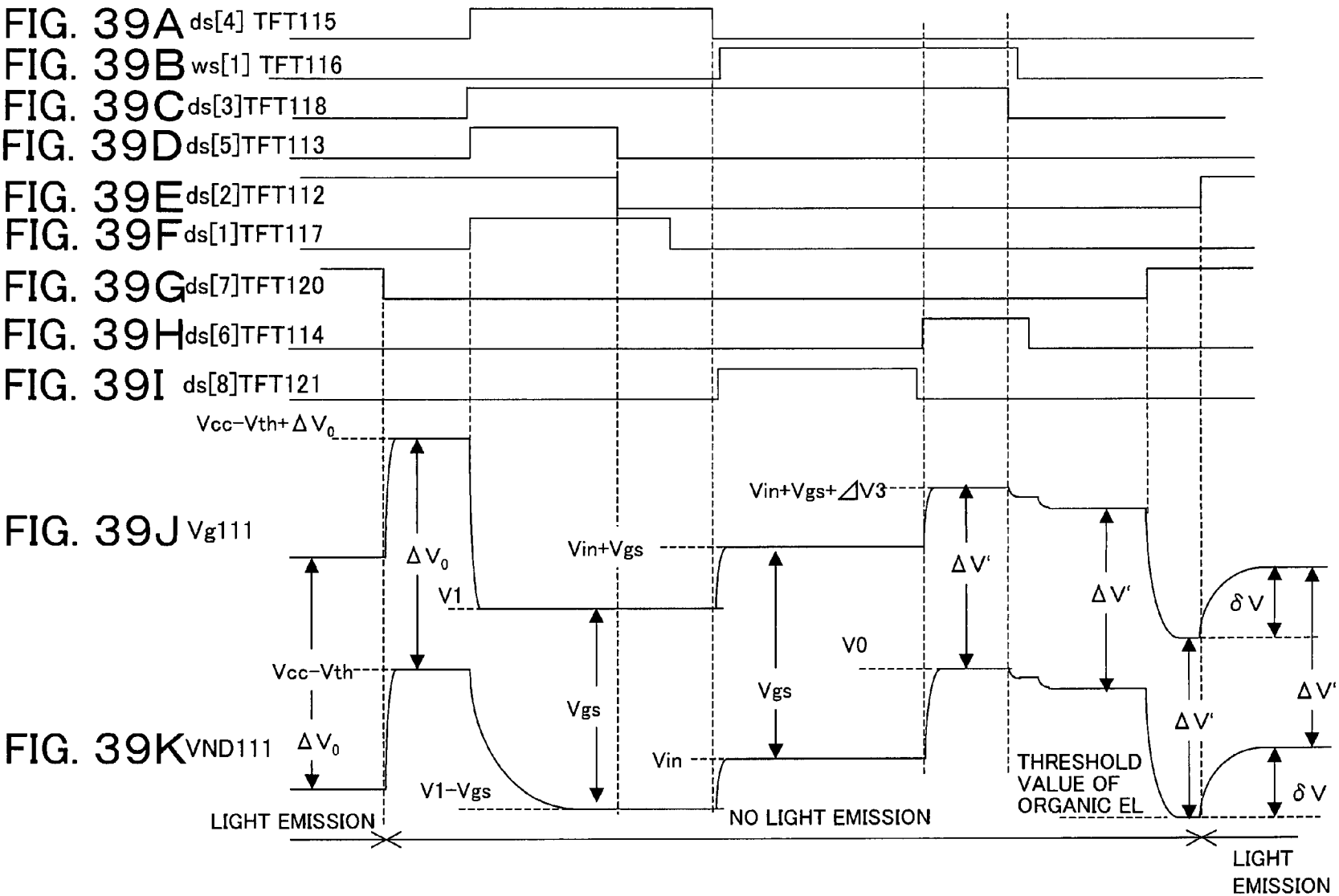
FIGS. 39A to 39K are timing charts for explaining the operation of the circuit of FIG. 37.

FIG. 36 is a circuit diagram showing the specific configuration of a pixel circuit according to a seventh embodiment. FIG. 37 is a circuit diagram showing the specific configuration of a pixel circuit according to an eighth embodiment.

The difference of the seventh embodiment from the fifth embodiment explained above resides in that the predetermined potential line to which the fourth switch constituted by the TFT 115 is connected is not shared together with the data line DTL, but is separately provided.

In the same way, the difference of the eighth embodiment from the sixth embodiment explained above resides in that the predetermined potential line to which the fourth switch constituted by the TFT 115 is connected is not shared together with the data line DTL, but is separately provided.

The rests of the configurations are the same as those of the fifth and sixth embodiments, so a detailed explanation concerning the configurations and functions is omitted here.

The seventh and eighth embodiments basically operate in the same way.

FIGS. 38A to 38K and FIGS. 39A to 39K show timing charts of examples of those operations.

In the seventh and eighth embodiments, when running the reference current Iref to the source of the driver transistor constituted by the TFT 111, the input voltage Vin is not input to the gate voltage of the TFT 111, but the fixed potential V0 is input. By inputting the fixed potential V0 and running the reference current Iref, the time during which the Vin is input into the pixel can be shortened, and the data can be written into the pixel at a high speed.

For this reason, it becomes possible to cope with a drive system dividing that 1H into several parts and writing that data into the pixel as in three-part write system.

Ninth Embodiment and 10th Embodiment

Figure 40:
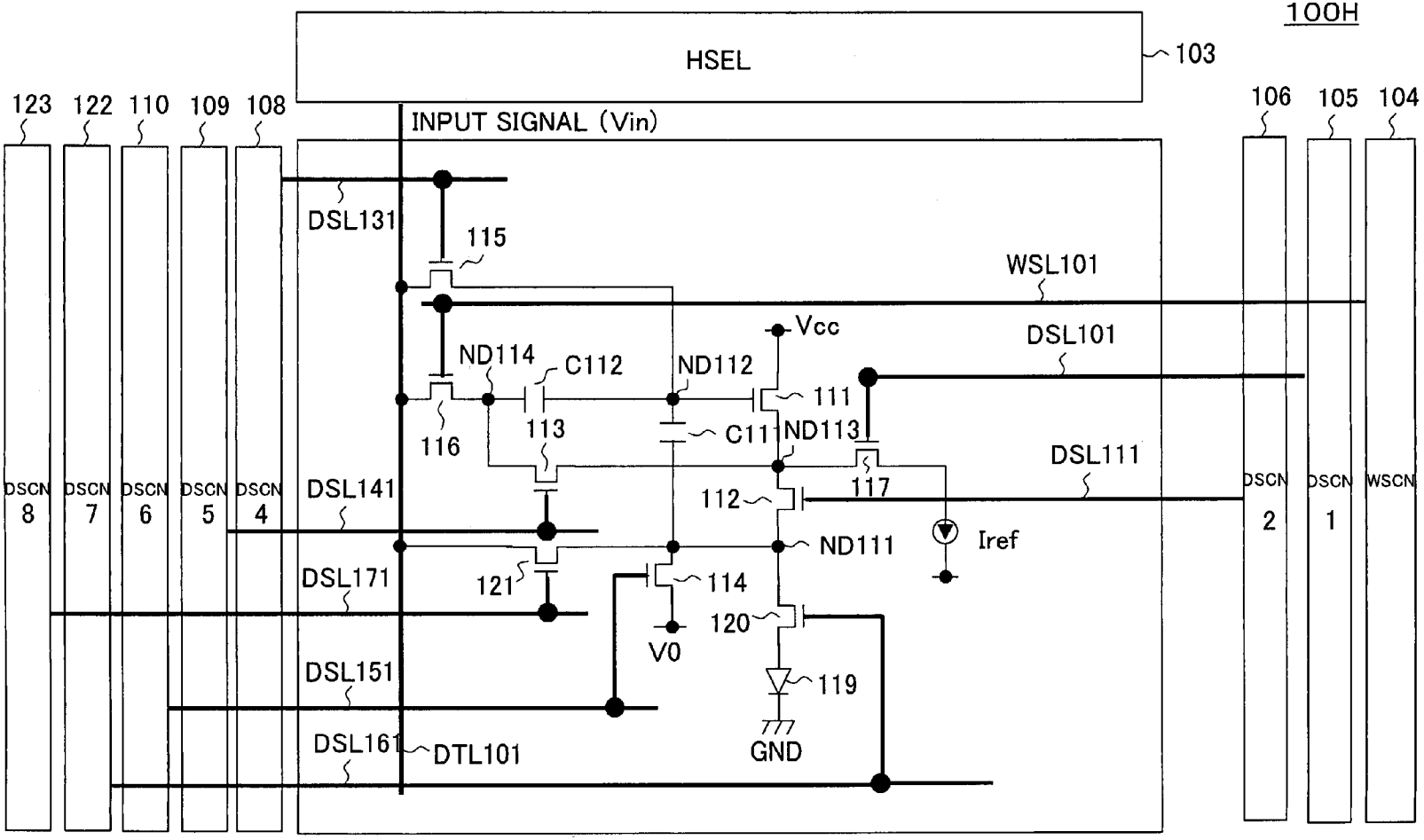
FIG. 40 is a circuit diagram showing a specific configuration of the pixel circuit according to a ninth embodiment.
Figure 41:
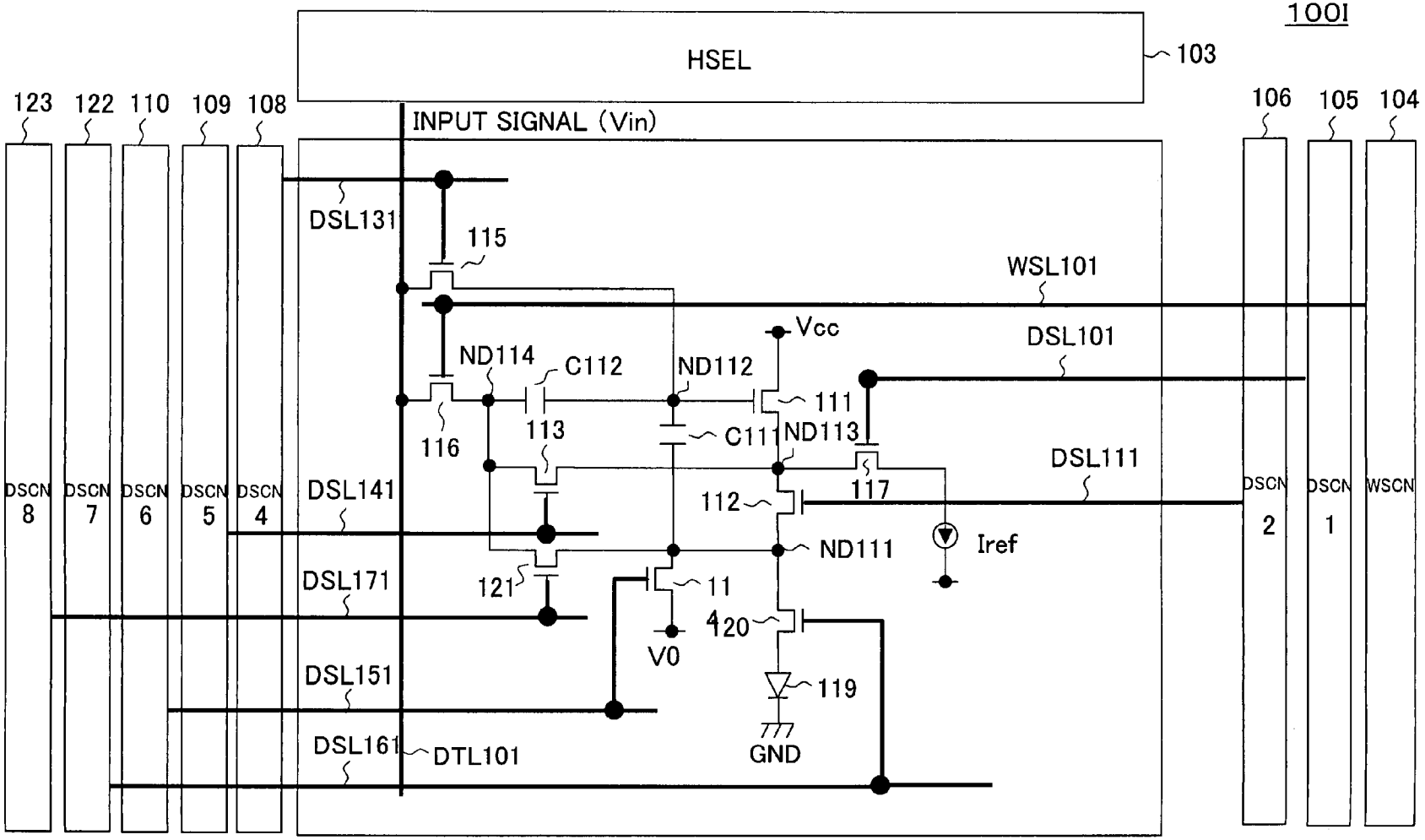
FIG. 41 is a circuit diagram showing a specific configuration of the pixel circuit according to a 10th embodiment.
Figure 42:
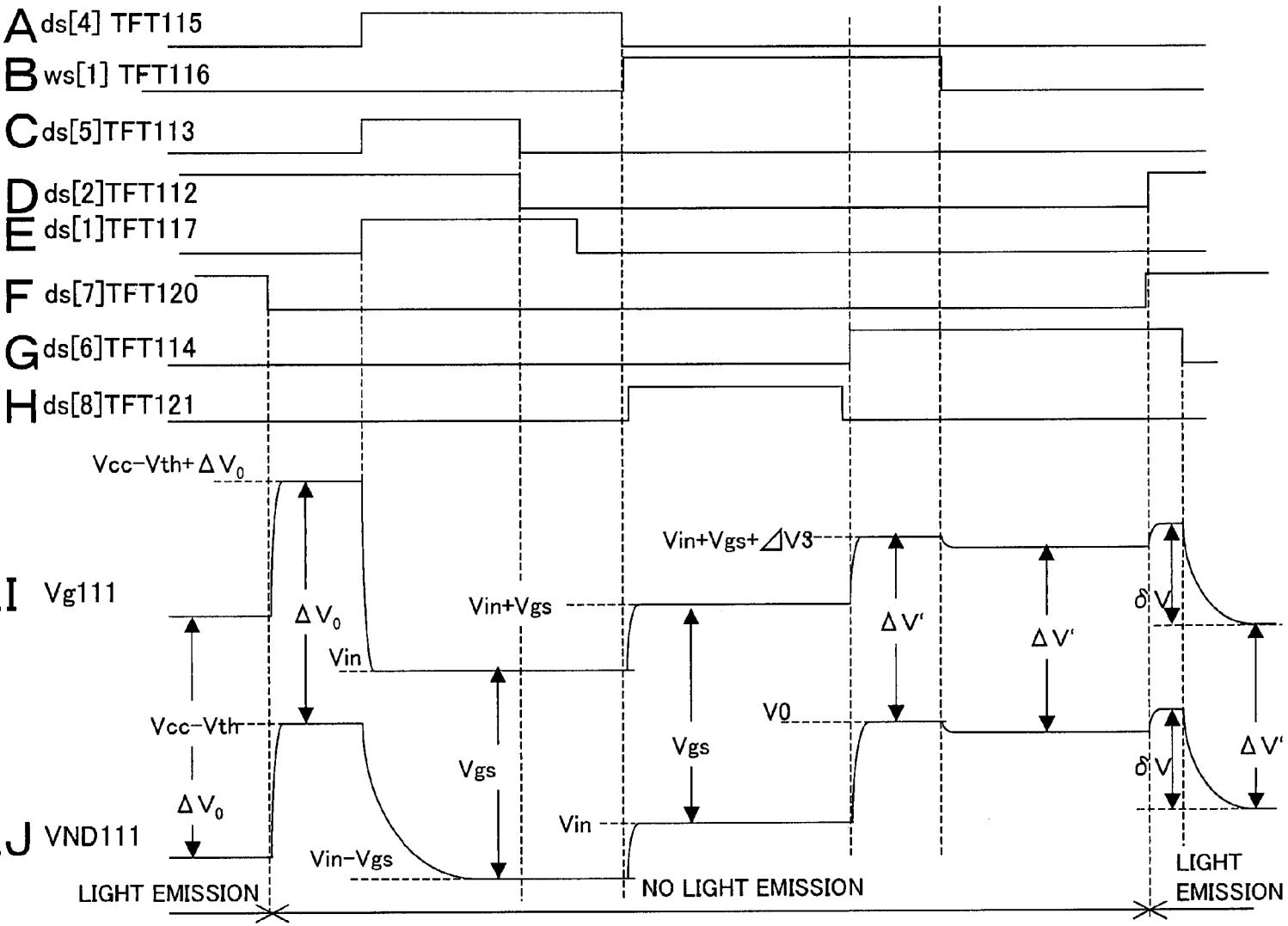
FIGS. 42A to 42J are timing charts for explaining the operation of the circuit of FIG. 40.
Figure 43:
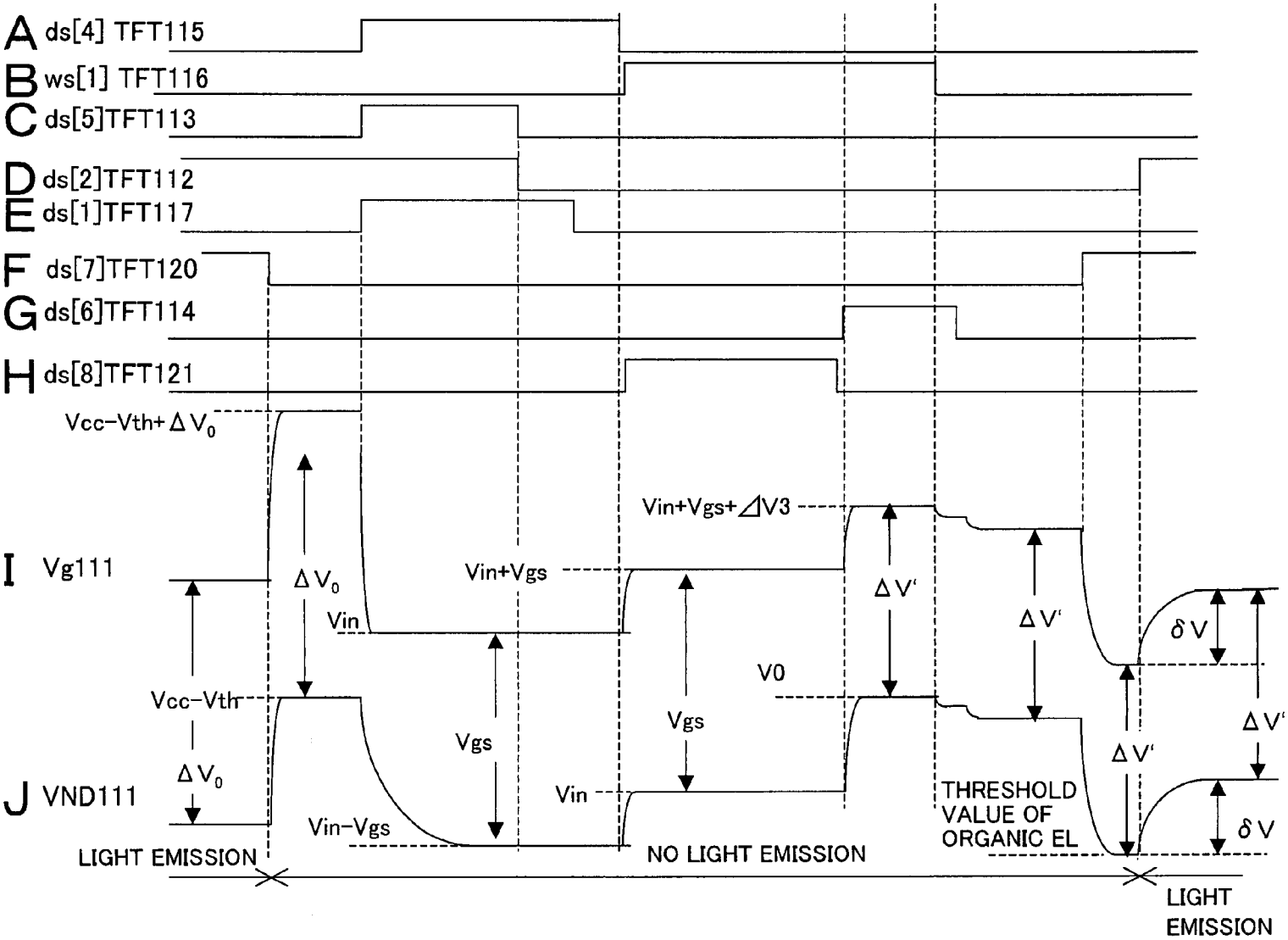
FIGS. 43A to 43J are timing charts for explaining the operation of the circuit of FIG. 41.

FIG. 40 is a circuit diagram showing the specific configuration of a pixel circuit according to a ninth embodiment. FIG. 41 is a circuit diagram showing the specific configuration of a pixel circuit according to a 10th embodiment.

The difference of the ninth embodiment from the fifth embodiment resides in that, in place of the configuration in which the electric connecting means for connecting the first electrode of the capacitor C112 and the second node ND112 is configured by the switch 118 for selectively connecting the two, they are directly connected by an electric interconnect.

The difference of the 10th embodiment from the sixth embodiment resides in that, in place of the configuration in which the electric connecting means for connecting the first electrode of the capacitor C112 and the second node ND112 is configured by the switch 118 for selectively connecting the two, they are directly connected by an electric interconnect.

As a result, the third drive scanner 107 and the drive line DSL121 become unnecessary.

The rests of the configurations are the same as those of the fifth and sixth embodiments explained above.

The ninth and 10th embodiments basically operate in the same way.

FIGS. 42A to 42J and FIGS. 43A to 43J show timing charts of examples of those operations.

According to the ninth and 10th embodiments, in addition to the effects of the fifth and sixth embodiments explained above, there are the advantages that the number of elements in the pixel circuit can be decreased, and the circuit configuration can be simplified.

11th Embodiment and 12th Embodiment

Figure 44:
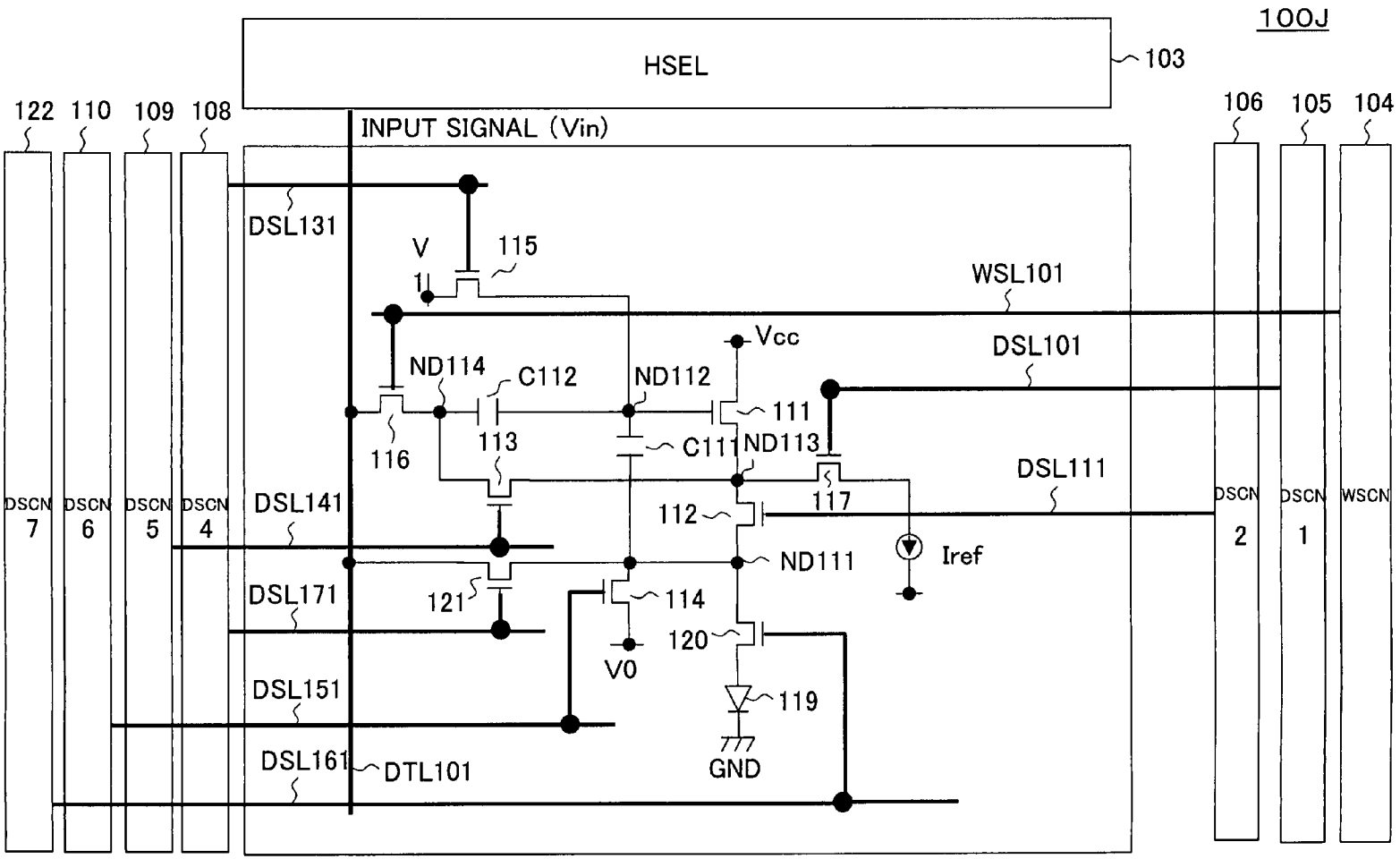
FIG. 44 is a circuit diagram showing a specific configuration of the pixel circuit according to an 11th embodiment.
Figure 45:
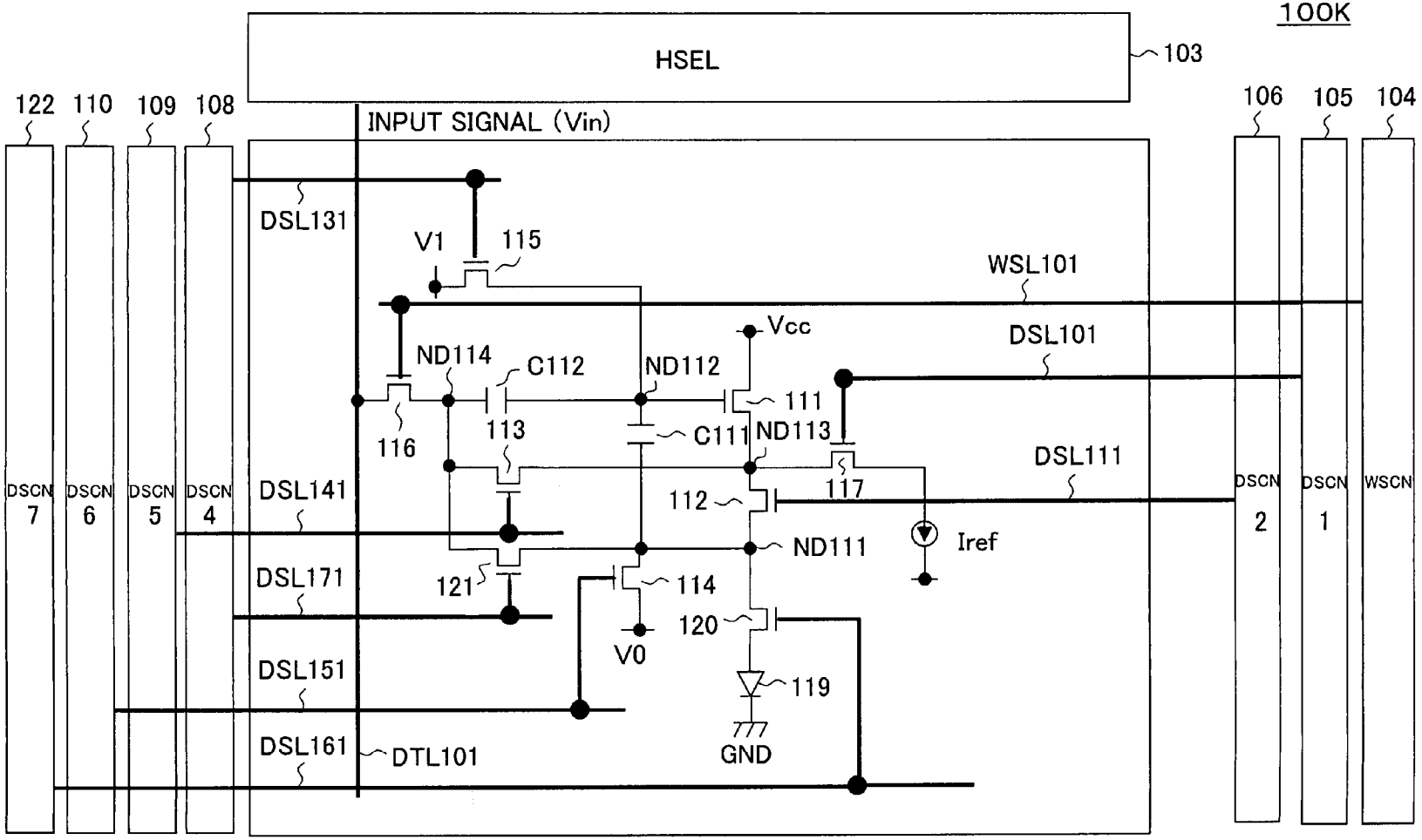
FIG. 45 is a circuit diagram showing a specific configuration of the pixel circuit according to a 12th embodiment.

FIG. 44 is a circuit diagram showing the specific configuration of a pixel circuit according to an 11th embodiment. FIG. 45 is a circuit diagram showing the specific configuration of a pixel circuit according to a 12th embodiment.

The difference of the 11th embodiment from the seventh embodiment resides in that, in place of the configuration in which the electric connecting means for connecting the first electrode of the capacitor C112 and the second node ND112 is configured by the switch 118 for selectively connecting the two, they are directly connected by an electric interconnect.

The difference of the 12th embodiment from the eighth embodiment resides in that, in place of the configuration in which the electric connecting means for connecting the first electrode of the capacitor C112 and the second node ND112 is configured by the switch 118 for selectively connecting the two, they are directly connected by an electric interconnect.

As a result, the third drive scanner 107 and the drive line DSL121 become unnecessary.

The rests of the configurations are the same as those of the seventh and eighth embodiments explained above.

The 11th and 12th embodiments basically operate in the same way.

FIGS. 46A to 46J and FIGS. 47A to 47J show timing charts of examples of those operations.

According to the 11th and 12th embodiments, in addition to the effects of the seventh and eighth embodiments explained above, there are the advantages that the number of elements in the pixel circuit can be decreased, and the circuit configuration can be simplified.

INDUSTRIAL CAPABILITY

According to the pixel circuit, display device, and method of driving a pixel circuit of the present invention, even when the current-voltage characteristic of a light emitting element changes due to aging, source-follower output without a luminance deterioration can be obtained, the source-follower circuit of the n-channel transistor becomes possible. In addition, it is possible to display uniform and high quality images without regard to variations of the threshold values and mobilities of the active elements inside the pixels. Therefore, the present invention can be applied to electronic devices such as display devices for personal digital assistants, personal computers, and car navigation systems, mobile phones, digital cameras, and video cameras.

The invention claimed is:

1. A pixel circuit for driving an electro-optical element changing in luminance according to a flowing current, comprising:

a data line to which a data signal in accordance with a luminance information is supplied;

first, second, third, and fourth nodes;

first and second reference potentials;

a reference current supplying means for supplying a predetermined reference current;

an electric connecting means connected to the second node;

a pixel capacitor element connected between the first node and the second node;

a coupling capacitor element connected between the electric connecting means and the fourth node;

a drive transistor forming a current supply line between a first terminal and a second terminal and controlling a current flowing in the current supply line in accordance with the potential of the control terminal connected to the second node;

a first switch connected between the first node and the third node;

a second switch connected between the third node and the fourth node;

a third switch connected between the first node and a fixed potential;

a fourth switch connected between the second node and a predetermined potential line;

a fifth switch connected between the data line and the fourth switch; and a sixth switch connected between the third node and the reference current supplying means, wherein, between the first reference potential and the second reference potential, the current supply line of the drive transistor, the first node, the third node, the first switch, and the electro-optical element are connected in series.

2. A pixel circuit as set forth in claim 1, wherein the electric connecting means includes an interconnect for directly connecting the second node and the coupling capacitor element.

3. A pixel circuit as set forth in claim 2, wherein, when the electro-optical element is driven, as a first stage, in a state where the first, second, fourth, fifth, and sixth switches are held in a non-conductive state, the third switch is held in the conductive state and the first node is connected to a fixed potential;

as a second stage, the second, fourth, and sixth switches are held in the conductive state, a predetermined potential is input to the second node, the reference current flows in the third node, and the predetermined potential is charged in the pixel capacitor element;

as a third stage, the second and sixth switches are held in the non-conductive state, further the fourth switch is held in the non-conductive state, the fifth switch is held in the conductive state, the data propagated through the data line is input to the second node, then the fifth switch is held in the non-conductive state; and as a fourth stage, the first switch is held in the conductive state, and the third switch is held in the non-conductive state.

4. A pixel circuit as set forth in claim 1, wherein the electric connecting means includes a seventh switch selectively connecting the second node and the coupling capacitor element.

5. A pixel circuit as set forth in claim 4, further including:

a seventh switch connected between the first node and the electro-optical element and an eighth switch connected between the first node and the data line.

6. A pixel circuit as set forth in claim 4, further including:

a seventh switch connected between the first node and the electro-optical element and an eighth switch connected between the first node and the fourth node.

7. A pixel circuit as set forth in claim 4, wherein, when the electro-optical element is driven, as a first stage, in a state where the first, second, fourth, fifth, sixth, and seventh switches are held in the non-conductive state, the third switch is held in the conductive state, and the first node is connected to the fixed potential;

as a second stage, the second, fourth, sixth, and seventh switches are held in the conductive state, the data potential propagated through the data line is input to the second node, the reference current flows in the third node, and a predetermined potential is charged in the pixel capacitor element;

as a third stage, the second and sixth switches are held in the non-conductive state, further the fourth switch is held in the non-conductive state, the fifth switch is held in the conductive state, the data propagated through the data line is input to the second node via the fourth node, then the fifth and seventh switches are held in the non-conductive state; and as a fourth stage, the first switch is held in the conductive state, and the third switch is held in the non-conductive state.

8. A pixel circuit as set forth in claim 1, further including:

a seventh switch connected between the first node and the electro-optical element and an eighth switch connected between the first node and the data line.

9. A pixel circuit as set forth in claim 1, further including:

a seventh switch connected between the first node and the electro-optical element and an eighth switch connected between the first node and the fourth node.

10. A pixel circuit as set forth in claim 1, wherein the predetermined potential line is shared together with the data line.

11. A pixel circuit as set forth in claim 1, wherein the drive transistor is a field effect transistor, a source is connected to the third node, and a drain is connected to the first reference potential.

12. A display device comprising:

a plurality of pixel circuits arranged in a matrix;

data lines interconnected for each column of a matrix array of the pixel circuits and supplied with a data signal in accordance with the luminance information;

first and second reference potentials; and a reference current supplying means for supplying a predetermined reference current, wherein the pixel circuit has:

an electro-optical element changing in luminance according to a flowing current;

first, second, third, and fourth nodes;

an electric connecting means connected to the second node;

a pixel capacitor element connected between the first node and the second node;

a coupling capacitor element connected between the electric connecting means and the fourth node;

a drive transistor forming a current supply line between a first terminal and a second terminal and controlling a current flowing in the current supply line in accordance with the potential of the control terminal connected to the second node;

a first switch connected between the first node and the third node;

a second switch connected between the third node and the fourth node;

a third switch connected between the first node and a fixed potential;

a fourth switch connected between the second node and a predetermined potential line;

a fifth switch connected between the data line and the fourth switch; and a sixth switch connected between the third node and the reference current supplying means, and, between the first reference potential and the second reference potential, the current supply line of the drive transistor, the first node, the third node, the first switch, and the electro-optical element are connected in series.

13. A method for driving a pixel circuit having an electro-optical element changing in luminance according to a flowing current;

a data line to which a data signal in accordance with luminance information is supplied;

first, second, third, and fourth nodes;

first and second reference potentials;

a reference current supplying means for supplying a predetermined reference current;

an electric connecting means connected to the second node;

a pixel capacitor element connected between the first node and the second node;

a coupling capacitor element connected between the electric connecting means and the fourth node;

a drive transistor forming a current supply line between a first terminal and a second terminal and controlling a current flowing in the current supply line in accordance with the potential of the control terminal connected to the second node;

a first switch connected between the first node and the third node;

a second switch connected between the third node and the fourth node;

a third switch connected between the first node and a fixed potential;

a fourth switch connected between the second node and a predetermined potential line;

a fifth switch connected between the data line and the fourth switch; and a sixth switch connected between the third node and the reference current supplying means, wherein the current supply line of the drive transistor, the first node, the third node, the first switch, and the electro-optical element are connected in series between the first reference potential and the second reference potential, comprising steps of holding the third switch in the conductive state and connecting the first node to a fixed potential in the state where the first, second, fourth, fifth, and sixth switches are held in the non-conductive state;

holding the second, fourth, and the sixth switches in the conductive state and inputting the predetermined potential to the second node, sending the reference current in the third node, and charging the predetermined potential in the pixel capacitor element;

holding the second and sixth switches in the non-conductive state, and further holding the fourth switch in the non-conductive state, holding the fifth switch in the conductive state and inputting the data propagated through the data line to the second node, then holding the fifth switch in the non-conductive state; and holding the first switch in the conductive state and holding the third switch in the non-conductive state.

* * * * *

UNITED STATES PATENT AND TRADEMARK OFFICE

CERTIFICATE OF CORRECTION

PATENT NO. : 7,355,572 B2
APPLICATION NO. : 10/578002
DATED : April 8, 2008
INVENTOR(S) : Katsuhide Uchino et al.

It is certified that error appears in the above-identified patent and that said Letters Patent is hereby corrected as shown below:

Title Page:
Item (75) should read:
-- Katsuhide Uchino, Kanagawa (JP);
Junichi Yamashita, Tokyo (JP);
Tetsuro Yamamoto, Kanagawa (JP) --.

Signed and Sealed this

First Day of July, 2008

JON W. DUDAS
*Director of the United States Patent and Trademark Office*